US010876270B2

(12) United States Patent
Imaizumi et al.

(10) Patent No.: US 10,876,270 B2
(45) Date of Patent: Dec. 29, 2020

(54) WHEEL LOADER

(71) Applicant: Komatsu Ltd., Tokyo (JP)

(72) Inventors: Masaaki Imaizumi, Mooka (JP); Yuu Sakon, Hitachinaka (JP); Yuuji Fukuda, Chigasaki (JP)

(73) Assignee: Komatsu Ltd., Tokyo (JP)

( * ) Notice: Subject to any disclaimer, the term of this patent is extended or adjusted under 35 U.S.C. 154(b) by 729 days.

(21) Appl. No.: 15/514,401

(22) PCT Filed: Mar. 24, 2016

(86) PCT No.: PCT/JP2016/059451
§ 371 (c)(1),
(2) Date: Mar. 24, 2017

(87) PCT Pub. No.: WO2016/152994
PCT Pub. Date: Sep. 29, 2016

(65) Prior Publication Data

US 2017/0298591 A1 Oct. 19, 2017

(30) Foreign Application Priority Data

Mar. 25, 2015 (JP) ..... PCT/JP2015/059222

(51) Int. Cl.
*E02F 3/43* (2006.01)
*E02F 9/20* (2006.01)
(Continued)

(52) U.S. Cl.
CPC ..... *E02F 3/434* (2013.01); *E02F 3/283* (2013.01); *E02F 9/0841* (2013.01);
(Continued)

(58) Field of Classification Search
None
See application file for complete search history.

(56) References Cited

U.S. PATENT DOCUMENTS 5,875,854 A * 3/1999 Yamamoto ..... E02F 3/432 172/4.5
5,996,703 A 12/1999 Yamamoto et al.
(Continued)

FOREIGN PATENT DOCUMENTS

CN 102482866 5/2012
CN 102770644 11/2012
(Continued)

OTHER PUBLICATIONS

International Search Report in International Application No. PCT/JP2016/059451, dated Jun. 21, 2016, 13 pages, with English translation.

(Continued)

*Primary Examiner* — Christian Chace
*Assistant Examiner* — Kyung J Kim
(74) *Attorney, Agent, or Firm* — Fish & Richardson P.C.

(57) ABSTRACT

A wheel loader includes: an operating state detecting unit detecting an operating state; a target setting unit setting a relationship between a target position of a working equipment and a travel distance of the wheel loader for the operating state detected by the operating state detecting unit; a travel distance detecting unit detecting the travel distance of the wheel loader; and a working equipment controlling unit moving a boom and a bucket to the target position of the working equipment determined depending on the travel distance detected by the travel distance detecting unit.

8 Claims, 32 Drawing Sheets

(51) Int. Cl.

| | |
|---|---|
| ***E02F 3/28*** | (2006.01) |
| ***E02F 9/26*** | (2006.01) |
| ***E02F 9/22*** | (2006.01) |
| ***E02F 9/08*** | (2006.01) |

(52) U.S. Cl.
CPC ..... *E02F 9/2004* (2013.01); *E02F 9/2029* (2013.01); *E02F 9/2296* (2013.01); *E02F 9/265* (2013.01); *E02F 9/268* (2013.01)

(56) References Cited

U.S. PATENT DOCUMENTS

| | | | | |
|---|---|---|---|---|
| 6,098,322 | A | 8/2000 | Tozawa et al. | |
| 6,167,336 | A | 12/2000 | Singh et al. | |
| 6,247,538 | B1 | 6/2001 | Takeda et al. | |
| 2001/0027366 | A1 | 10/2001 | Ikari | |
| 2006/0276948 | A1 | 12/2006 | Toda | |
| 2010/0312437 | A1 | 12/2010 | Saito | |
| 2011/0231070 | A1 | 9/2011 | Toda | |
| 2011/0276238 | A1 | 11/2011 | Toda | |
| 2012/0158234 | A1 | 6/2012 | Choi | |
| 2012/0296533 | A1 | 11/2012 | Ota et al. | |
| 2013/0041561 | A1* | 2/2013 | Asami ..... | E02F 9/0841 701/50 |
| 2013/0073151 | A1 | 3/2013 | Wada et al. | |
| 2014/0169923 | A1 | 6/2014 | Shirao | |
| 2017/0247860 | A1* | 8/2017 | Lehtinen ..... | E02F 9/2029 |

FOREIGN PATENT DOCUMENTS

| | | |
|---|---|---|
| CN | 102884296 | 1/2013 |
| CN | 103429935 | 12/2013 |
| EP | 2568148 | 3/2013 |
| EP | 2543777 | 9/2013 |
| JP | 03-109593 | 11/1991 |
| JP | H05-085230 | 4/1993 |
| JP | H05-049859 | 7/1993 |
| JP | H10-088625 | 4/1998 |
| JP | H10-159124 | 6/1998 |
| JP | H10-183669 | 7/1998 |
| JP | 2000-303492 | 10/2000 |
| JP | 4140940 | 8/2008 |
| JP | 2008-248523 | 10/2008 |
| JP | 2009-057978 | 3/2009 |
| JP | 2009-197425 | 9/2009 |
| JP | 2011-236759 | 11/2011 |
| WO | WO 98/11305 | 9/1998 |
| WO | WO 98/24986 | 11/1998 |
| WO | WO 2010/052831 | 5/2010 |
| WO | WO 2011/108550 | 9/2011 |

OTHER PUBLICATIONS

Extended European Search Report in European Application No. 16768897.7, dated Feb. 21, 2018, 6 pages.

Japanese Notice of Reason(s) for Rejection in Japanese Application No. JP2017-508435, dated Oct. 30, 2018, 7 pages (with English Translation).

Japanese Notice of Reason(s) for Rejection in Japanese Application No. JP2017-508435, dated Apr. 5, 2018, 7 pages (with English Translation).

International Preliminary Report on Patentability in International Application No. PCT/JP2016/059451, dated Sep. 26, 2017, 11 pages (with English translation).

Chinese Office Action in Chinese Application. No. 201680002502.5 dated Jul. 15, 2019, 14 pages (with English translation).

* cited by examiner

WHEEL LOADER

CROSS-REFERENCE TO RELATED APPLICATIONS

This application claims priority to International Application No. PCT/JP2016/059451 filed on Mar. 24, 2016, which claims priority to International Application No. PCT/JP2015/059222 filed on Mar. 25, 2015, the contents of each are incorporated herein in their entirety.

TECHNICAL FIELD

The present invention relates to a wheel loader.

BACKGROUND ART

A wheel loader often repeats excavation and loading for the excavated substance on, for instance, the vessel of a dump truck. In particular, a large-sized wheel loader often repeats a so-called V-shape operation for a long time, which results in an increased workload on an operator. Accordingly, in order to reduce the workload on the operator, a mode for assisting loading on a vessel or the like may be installed in a wheel loader provided with semi-automatic boom and bucket (see, for instance, Patent Literature 1).

In the wheel loader of Patent Literature 1, loading from the bucket is automatically started when a predetermined operation is performed on a boom operation lever. The operator can thus only have to operate the boom lever to perform loading from the bucket.

CITATION LIST

Patent Literature(s)

Patent Literature 1: JP-A-2009-197425

SUMMARY OF THE INVENTION

Problem(s) to be Solved by the Invention

When a wheel loader is used for excavation, a distal end of the boom is lowered so that the bucket is positioned near the ground. In contrast, when a wheel loader is used for loading, the distal end of the boom is lifted to be positioned above the vessel of a haulage vehicle or a dump truck. Accordingly, in order to efficiently repeat excavation and loading, the wheel loader needs to travel with working equipment being moved.

The operator thus needs to operate the working equipment with his/her right hand while operating the wheel loader by, for instance, a combination of an accelerator operation (right foot), a brake operation (left foot) and a steering operation (left hand). Such a complicated operation entails an increased workload, so that an efficient operation is difficult for, especially, an inexperienced operator.

An object of the invention is to provide a wheel loader capable of easily transporting and loading, for instance, excavated soil and sand. MEANS FOR SOLVING THE PROBLEM(S)

According to an aspect of the invention, a wheel loader includes: working equipment including a boom and a bucket attached to the boom; an operating state detecting unit configured to detect an operating state of the wheel loader; a target setting unit configured to set a relationship between a target position of the working equipment and a travel distance of the wheel loader for the operating state detected by the operating state detecting unit; a travel distance detecting unit configured to detect the travel distance of the wheel loader; and a working equipment controlling unit configured to move the boom and the bucket to the target position of the working equipment determined depending on the travel distance detected by the travel distance detecting unit.

In the aspect, when the wheel loader is in any one of predetermined operating states, including a loaded reverse traveling state, a loaded forward traveling state and an unloaded reverse traveling state, and travels, the target setting unit sets a target position of the working equipment in accordance with the operating state and the travel distance of the wheel loader, and the working equipment controlling unit moves the boom and the bucket to the target position. The first exemplary embodiment thus eliminates a necessity for an operator to operate the boom lever and/or the bucket lever to move the working equipment simultaneously when operating a steering and/or an accelerator. The operator is merely required to mainly operate the steering, accelerator and brake. Consequently, even an inexperienced operator can easily operate the wheel loader.

Further, the working equipment is automatically moved to an appropriate position during the travel of the wheel loader, which results in an improved operating efficiency and a fuel-saving driving as compared with an instance where the working equipment is moved after the travel of the wheel loader.

In the wheel loader of the above aspect, it is preferable that the operating state detecting unit include: a load determining unit configured to determine whether or not the bucket is loaded; and a forward/reverse travel determining unit configured to determine whether the wheel loader travels forward or reverses, when the load determining unit determines that the bucket is loaded and the forward/reverse travel determining unit determines that the wheel loader reverses, the operating state be detected to be a loaded reverse traveling state, the target setting unit set the relationship between the target position of the working equipment and the travel distance of the wheel loader for the loaded reverse traveling state, and the working equipment controlling unit move the boom and the bucket to the target position of the working equipment determined depending on the travel distance detected by the travel distance detecting unit when the operating state is the loaded reverse traveling state.

In the wheel loader of the above aspect, it is preferable that the operating state detecting unit include: a load determining unit configured to determine whether or not the bucket is loaded; and a forward/reverse travel determining unit configured to determine whether the wheel loader travels forward or reverses, when the load determining unit determines that the bucket is loaded and the forward/reverse travel determining unit determines that the wheel loader travels forward, the operating state be detected to be a loaded forward traveling state, the target setting unit set the relationship between the target position of the working equipment and the travel distance of the wheel loader for the loaded forward traveling state, and the working equipment controlling unit move the boom and the bucket to the target position of the working equipment determined depending on the travel distance detected by the travel distance detecting unit when the operating state is the loaded forward traveling state.

In the wheel loader of the above aspect, it is preferable that the operating state detecting unit include: a load determining unit configured to determine whether or not the bucket is loaded; and a forward/reverse travel determining unit configured to determine whether the wheel loader travels forward or reverses, when the load determining unit determines that the bucket is unloaded and the forward/reverse travel determining unit determines that the wheel loader reverses, the operating state be detected to be an unloaded reverse traveling state, the target setting unit set the relationship between the target position of the working equipment and the travel distance of the wheel loader for the unloaded reverse traveling state, and the working equipment controlling unit move the boom and the bucket to the target position of the working equipment determined depending on the travel distance detected by the travel distance detecting unit when the operating state is the unloaded reverse traveling state.

In the wheel loader of the above aspect, it is preferable that the target setting unit: set a boom angle in proportion to the travel distance to define a target position of the boom for the loaded reverse traveling state, the boom angle varying from a value at a start of a movement of the boom in the loaded reverse traveling state to a value at which the boom is to get horizontal when the travel distance of the wheel loader 1 reaches a distance L1; and set a bucket cylinder length where the bucket is maintained at a tilting position in accordance with the boom angle to define a target portion of the bucket for the loaded reverse traveling state.

In the wheel loader of the above aspect, it is preferable that the target setting unit set a distance L2 as a target travel distance for the loaded forward traveling state, a first interim distance less than the distance L2, and a second interim distance equal to or more than the first interim distance but less than the distance L2, when the travel distance is less than the first interim distance, the target setting unit: set a first boom angle at which the boom is to get horizontal to define a target position of the boom for the loaded forward traveling state; and set a first bucket cylinder length where the bucket is maintained at a tilting position to define a target position of the bucket for the loaded forward traveling state, when the travel distance is equal to or more than the first interim distance but less than the second interim distance, the target setting unit: set a second boom angle in proportion to the travel distance to define the target position of the boom for the loaded forward traveling state, the second boom angle varying from a value at a time when the travel distance reaches the first interim distance to a value at which the boom is to reach a preset lifted positioner position when the travel distance reaches the second interim distance; and set a second bucket cylinder length where the bucket is maintained at the tilting position in accordance with the second boom angle to define a target portion of the bucket for the loaded forward traveling state, and when the travel distance is in a range from the second interim distance to the distance L2, the target setting unit: set a third boom angle at which the boom is to reach the lifted positioner position to define the target position of the boom for the loaded forward traveling state; and set a third bucket cylinder length where the bucket is maintained at the tilting position to define the target position of the bucket for the loaded forward traveling state.

In the wheel loader of the above aspect, it is preferable that the target setting unit set a distance L2 as a target travel distance for the loaded reverse traveling state, a third interim distance less than the distance L2, and a fourth interim distance equal to or more than the third interim distance but less than the distance L2, when the travel distance is less than the third interim distance, the target setting unit: set a first boom angle at which the boom is to reach a preset lifted positioner position to define a target position of the boom for the unloaded reverse traveling state; and set a first bucket cylinder length in proportion to the travel distance to define a target position of the bucket for the unloaded reverse traveling state, the first bucket cylinder length varying from a value at a start of a movement of the bucket in the unloaded reverse traveling state to a value where the bucket is to reach a preset initial position when the travel distance of the wheel loader reaches the third interim distance, when the travel distance is equal to or more than the third interim distance but less than the fourth interim distance, the target setting unit: set a second boom angel in proportion to the travel distance to define the target position of the boom for the unloaded reverse traveling state, the second boom angle varying from a value at a time when the travel distance reaches the third interim distance to a value at which the boom is to get horizontal when the travel distance reaches the fourth interim distance; and set a second bucket cylinder length where the bucket is maintained at the preset initial position to define the target position of the bucket for the unloaded reverse traveling state, and when the travel distance is in a range from the fourth interim distance to the distance L2, the target setting unit: set a third boom angle in proportion to the travel distance to define the target position of the boom for the unloaded reverse traveling state, the third boom angle varying from a value at a time when the travel distance reaches the fourth interim distance to a value at which the boom is to reach a preset lowered positioner position when the travel distance reaches the distance L2; and set a third bucket cylinder length where the bucket is maintained at the preset initial position to define the target position of the bucket for the unloaded reverse traveling state.

It is preferable that the wheel loader of the above aspect further include a boom position detecting unit configured to detect a current position of the boom; and a bucket position detecting unit configured to detect a current position of the bucket, in which the target setting unit calculates a current target position of each of the boom and the bucket from the current travel distance detected by the travel distance detecting unit, the working equipment controlling unit calculates a deviation between the current target position of the boom and the current position of the boom detected by the boom position detecting unit and a deviation between the current target position of the bucket and the current position of the bucket detected by the bucket position detecting unit, and each of the boom and the bucket is moved based on the deviations.

It is preferable that the wheel loader of the above aspect further include a boom lever for operating the boom; and a bucket lever for operating the bucket, in which the working equipment controlling unit adds displacement of the boom lever and the bucket lever by a manual operation to move the working equipment.

It is preferable that the wheel loader of the above aspect further include a boom lever for operating the boom; and a bucket lever for operating the bucket, in which the working equipment controlling unit stores a travel distance at a time when the working equipment reaches the target position when displacement of the boom lever and the bucket lever by a manual operation is added, and the target setting unit corrects the travel distance of the wheel loader defined by the relationship between the position of the working equipment and the travel distance of the wheel loader with the travel distance stored when the working equipment reaches the target position.

A wheel loader of the above aspect includes: working equipment including a boom and a bucket attached to the boom; a boom lever for operating the boom; a bucket lever for operating the bucket; an operating state detecting unit configured to detect an operating state of the wheel loader; a target setting unit configured to set a relationship between a target position of the working equipment and a travel distance of the wheel loader according to the operating state detected by the operating state detecting unit; a travel distance detecting unit configured to detect the travel distance of the wheel loader; and a working equipment controlling unit configured to move the boom and the bucket to the target position of the working equipment determined depending on the travel distance detected by the travel distance detecting unit. When the boom lever and the bucket lever are manually operated, the target setting unit obtains a deviation between a current position of the working equipment before the manual operation and the target position of the working equipment, sets a new target position by adding the deviation to a current position of the working equipment after the manual operation, and sets a new relationship between the target position of the working equipment and the travel distance of the wheel loader using the new target position.

In the above aspect of the invention, when the wheel loader travels while being in any one of predetermined operating states including a loaded reverse traveling state, a loaded forward traveling state and an unloaded reverse traveling state, the target setting unit sets a target position of the working equipment in accordance with the operating state and the travel distance of the wheel loader, and the working equipment controlling unit moves the boom and the bucket to the target position. The working equipment is automatically moved to an appropriate position during the travel of the wheel loader, which results in an improved operating efficiency and a fuel-saving driving as compared with an instance where the working equipment is moved after the travel of the wheel loader. When an operator manually operates the working equipment, the target setting unit sets a new relationship between the target position of the working equipment and the travel distance of the wheel loader based on the position of the working equipment after the manual operation of the working equipment. Accordingly, the working equipment controlling unit can move the working equipment in accordance with the new relationship, and the working equipment controlling unit enables an automatic control of the working equipment while the manual operation by the operator is reflected.

At this time, the deviation between the current position of the working equipment before the manual operation and the target position is obtained, and a new target position is set by adding the deviation to the current position of the working equipment after the manual operation. Accordingly, it is possible to set a target position in consideration of the delay of the actual travel relative to the control target at the time of operating the working equipment. Accordingly, it is possible to perform efficient control in which the travel distance from the current position after the manual operation to the final target position is the shortest.

BRIEF DESCRIPTION OF DRAWING(S)

FIG. 1 is a side view of a wheel loader according to a first exemplary embodiment of the invention.

FIG. 2 schematically illustrates a drive mechanism for working equipment according to the first exemplary embodiment.

FIG. 3 is a block diagram showing an arrangement of a working equipment controller.

FIG. 4 schematically illustrates a V-shape operation of the wheel loader according to the first exemplary embodiment.

FIG. 5 schematically illustrates a process of the V-shape operation according to the first exemplary embodiment.

Figure 16:
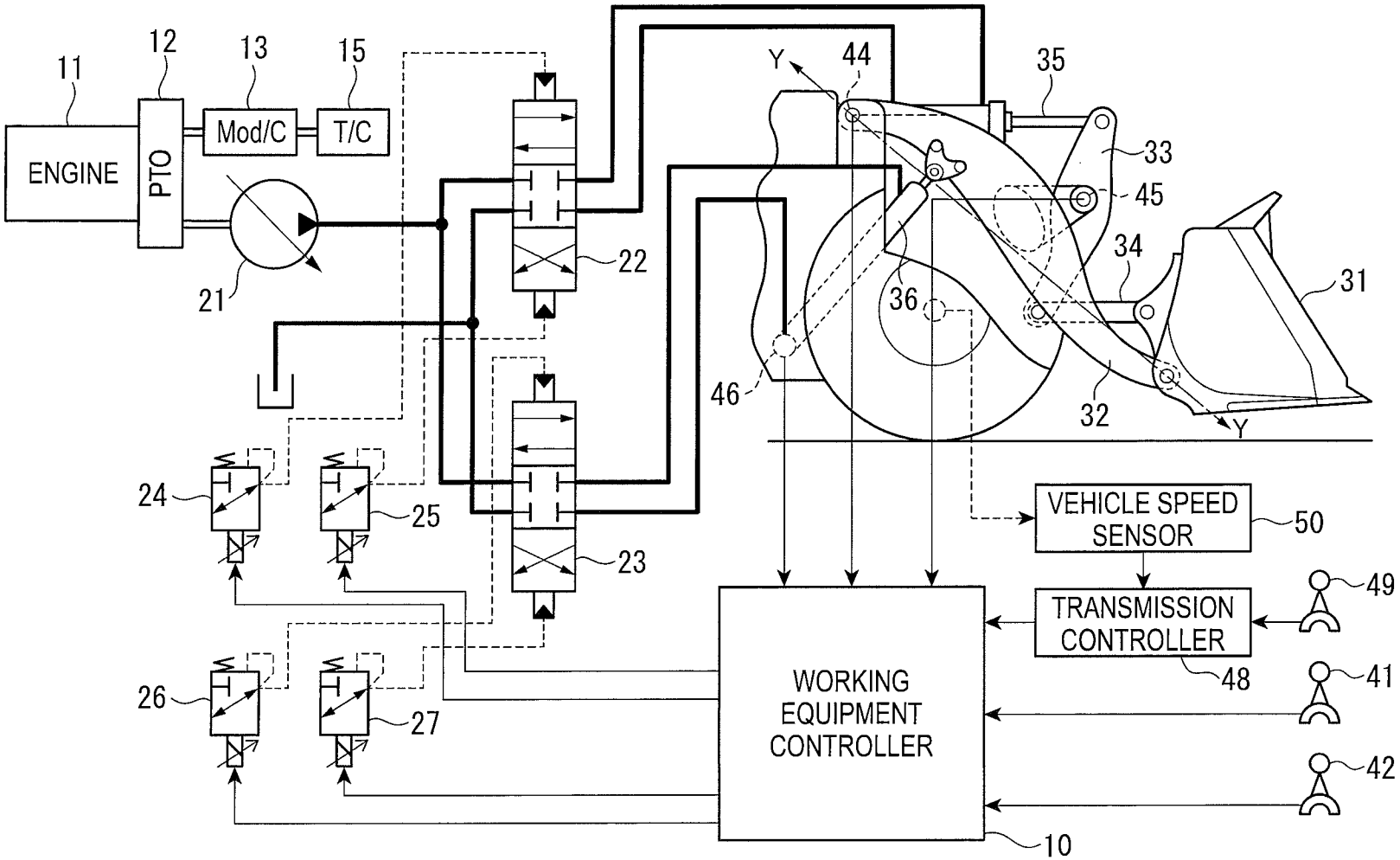

FIG. 16 schematically illustrates a drive mechanism for working equipment according to a second exemplary embodiment of the invention.

Figure 17:
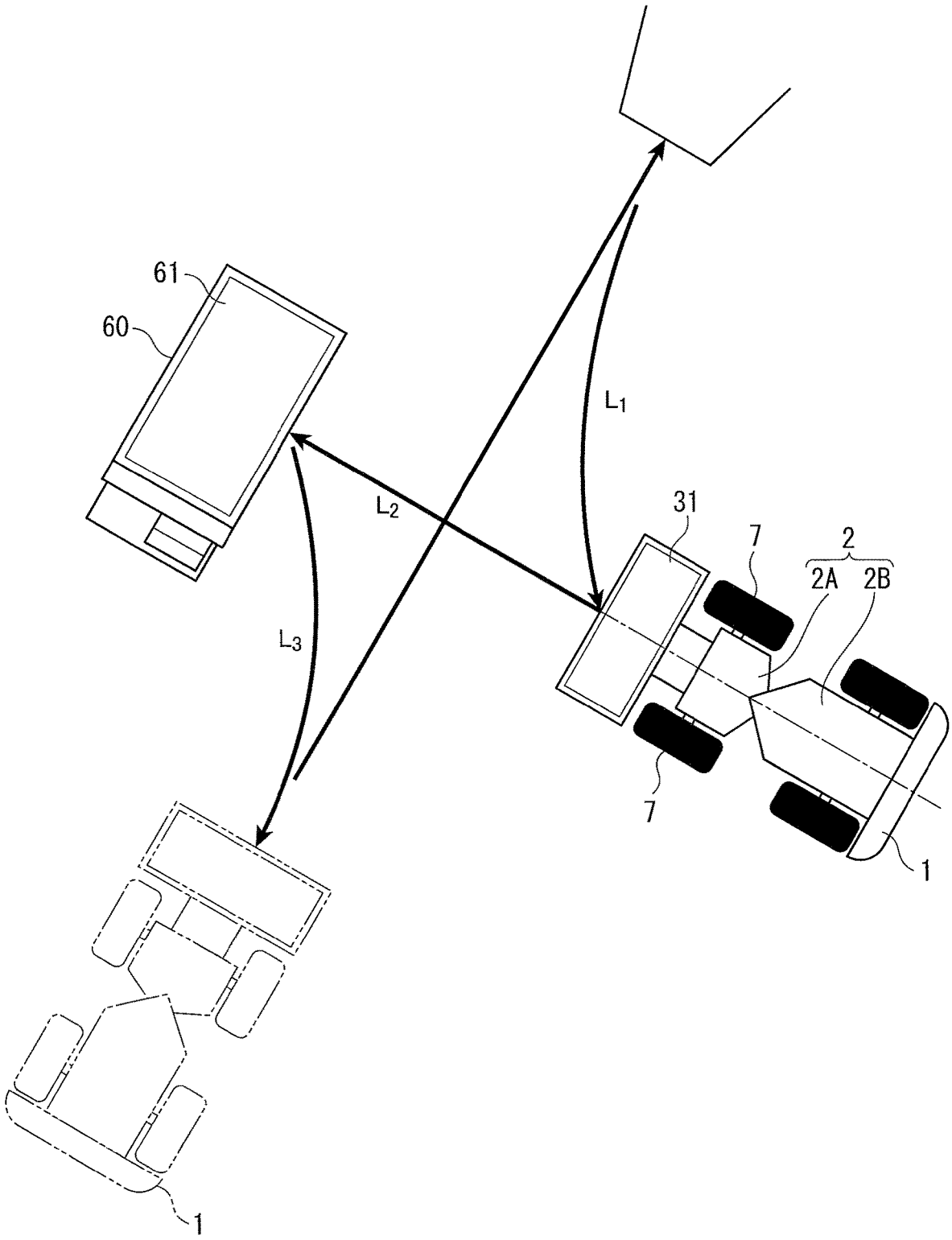

FIG. 17 schematically illustrates a V-shape operation according to the second exemplary embodiment.

Figure 18:
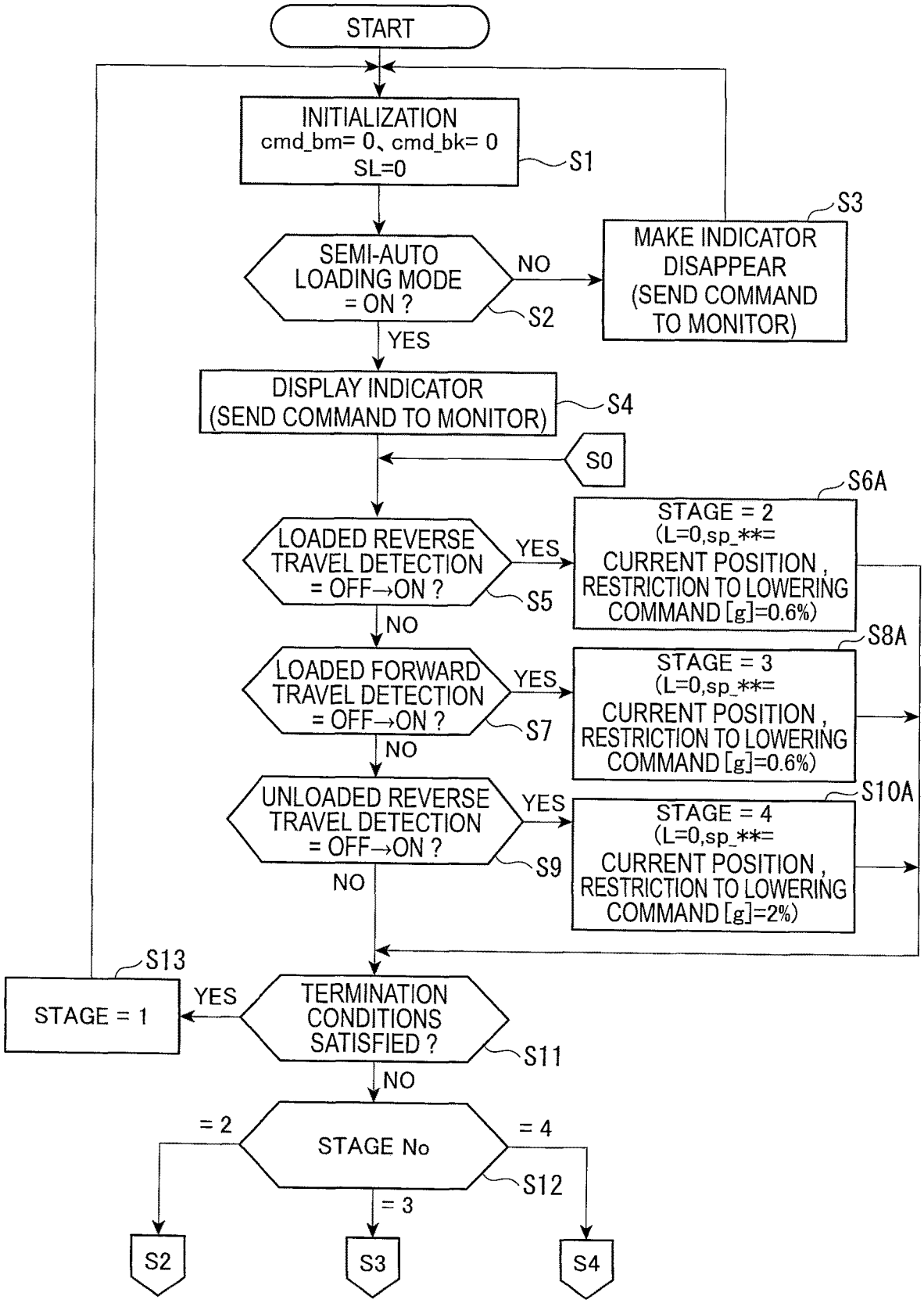

FIG. 18 is a flow chart showing a working equipment controlling process for the V-shape operation according to the second exemplary embodiment.

Figure 19:
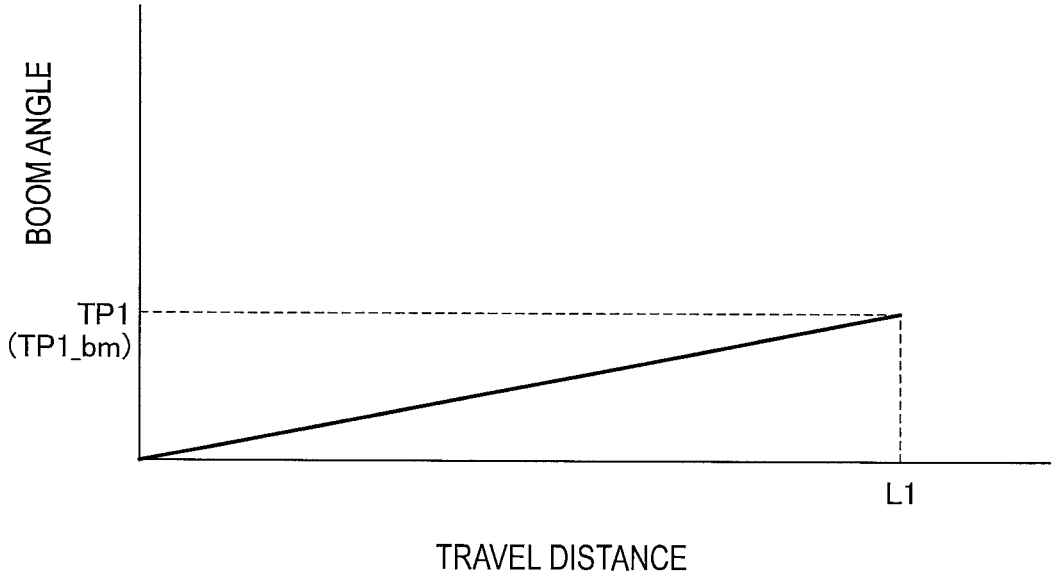

FIG. 19 is a graph showing a relationship between a travel distance and a target position of a boom angle in a loaded reverse traveling state according to the second exemplary embodiment.

Figure 20:
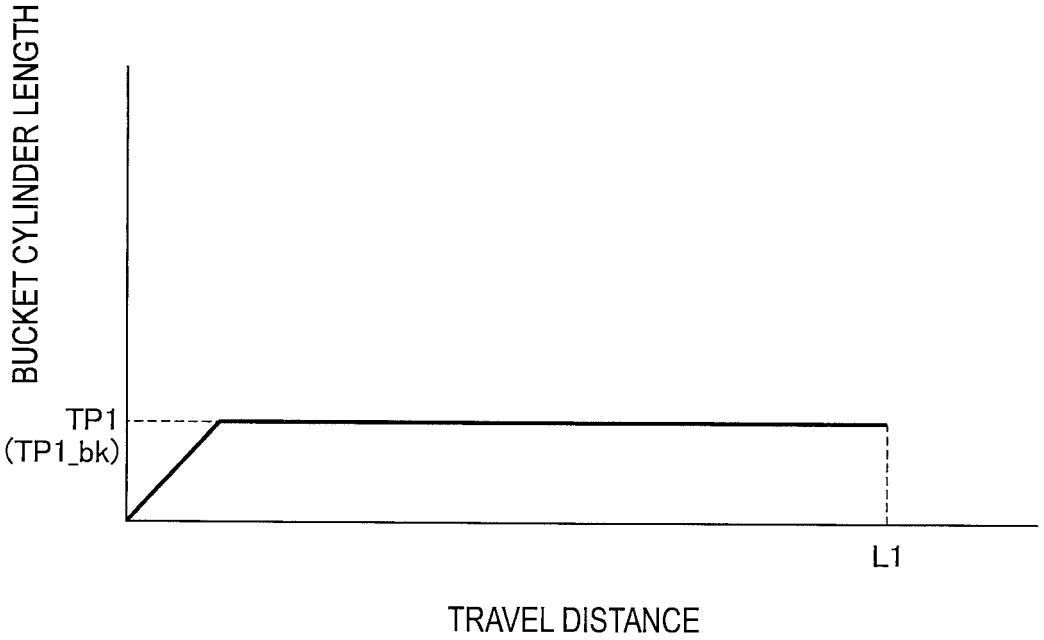

FIG. 20 is a graph showing a relationship between the travel distance and a target position of a bucket cylinder length in the loaded reverse traveling state according to the second exemplary embodiment.

Figure 21:
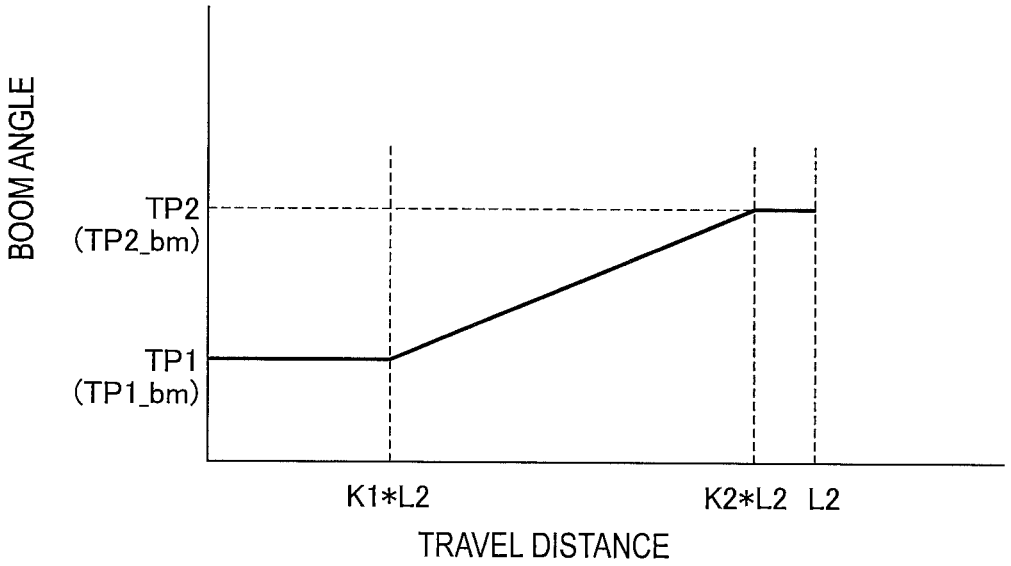

FIG. 21 is a graph showing a relationship between the travel distance and the target position of the boom angle in a loaded forward traveling state according to the second exemplary embodiment.

Figure 22:
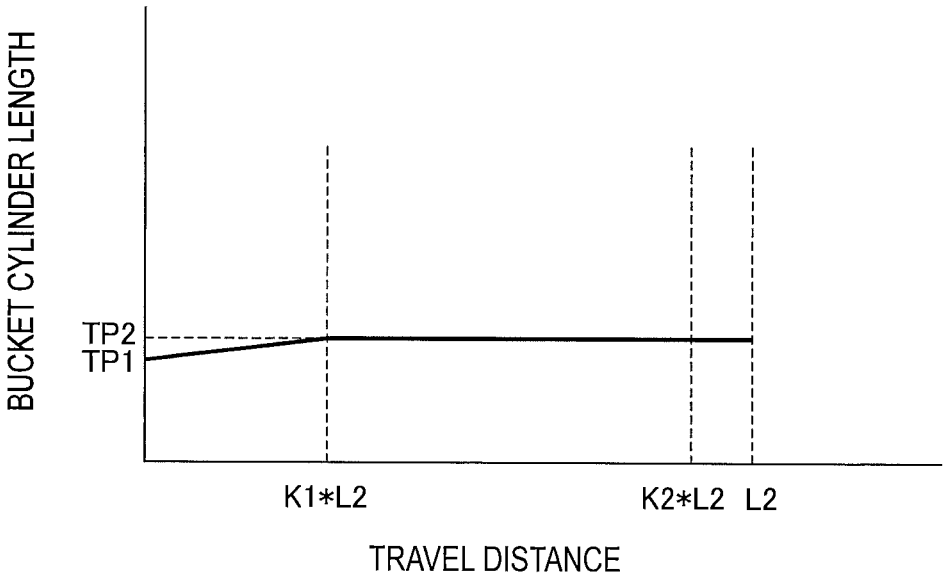

FIG. 22 is a graph showing a relationship between the travel distance and the target position of the bucket cylinder length in the loaded forward traveling state according to the second exemplary embodiment.

Figure 23:
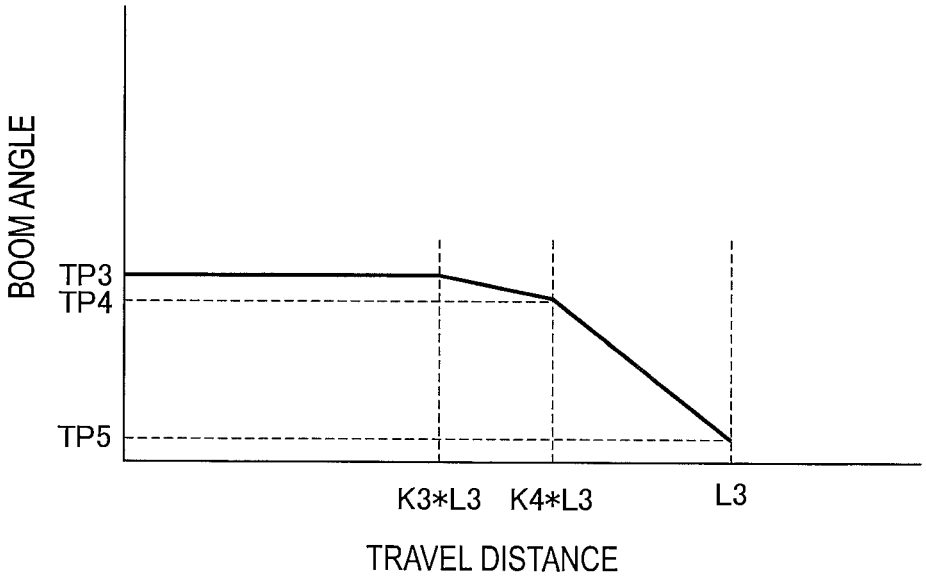

FIG. 23 is a graph showing a relationship between the travel distance and the target position of the boom angle in an unloaded reverse traveling state according to the second exemplary embodiment.

Figure 24:
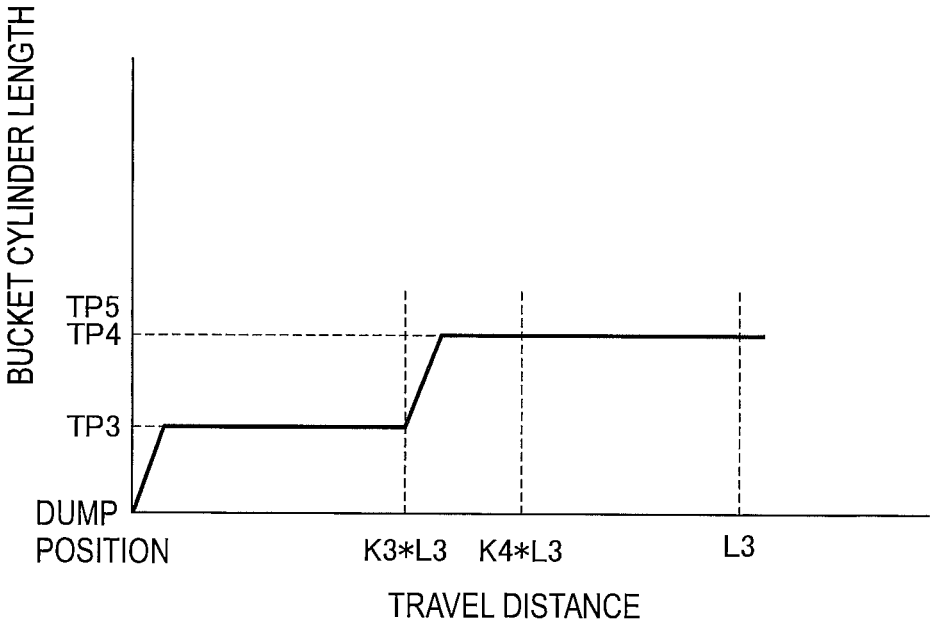

FIG. 24 is a graph showing a relationship between the travel distance and the target position of the bucket cylinder length in the unloaded reverse traveling state according to the second exemplary embodiment.

Figure 25:
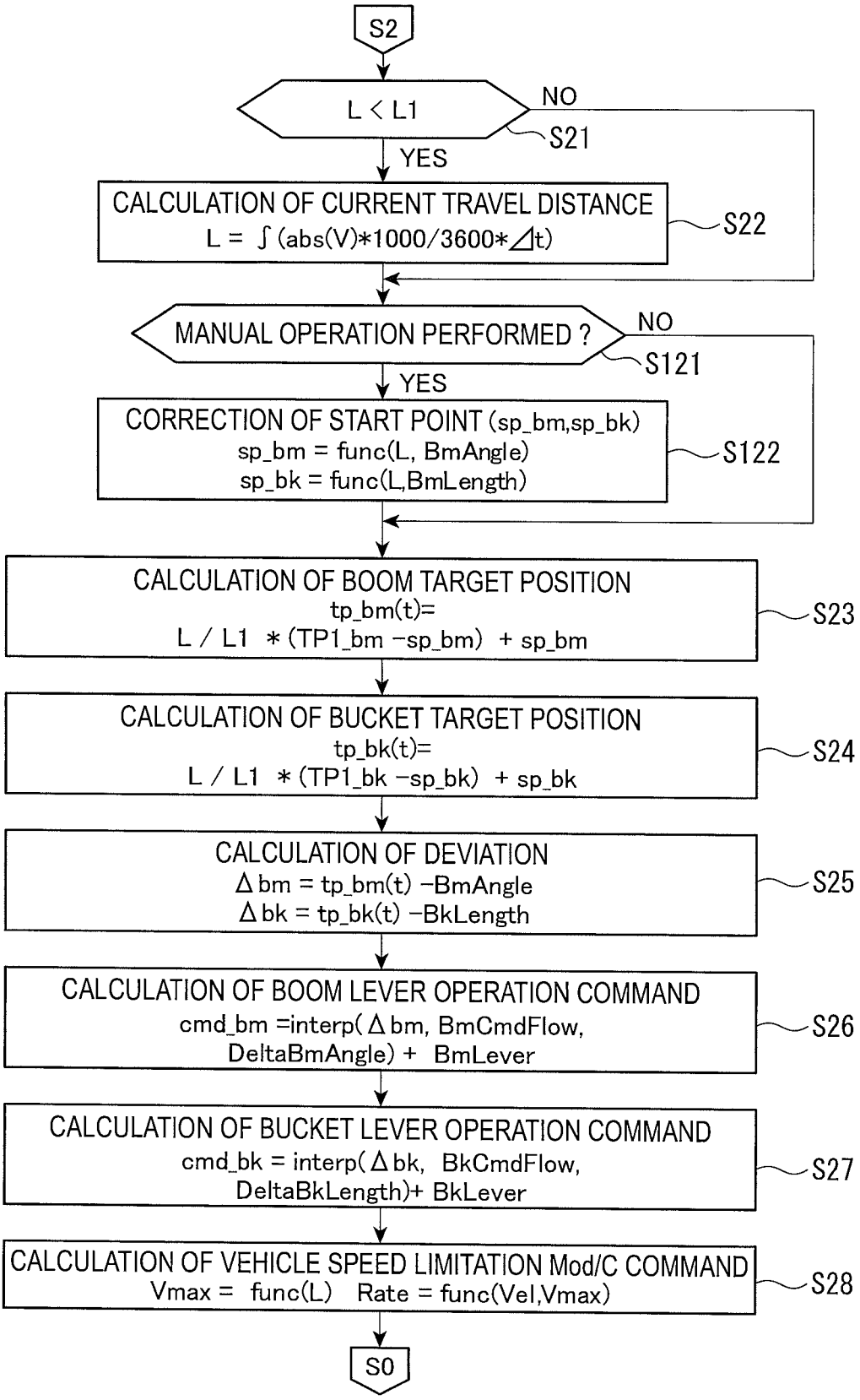

FIG. 25 is a flow chart showing a working equipment controlling process in the loaded reverse traveling state according to the second exemplary embodiment.

Figure 26:
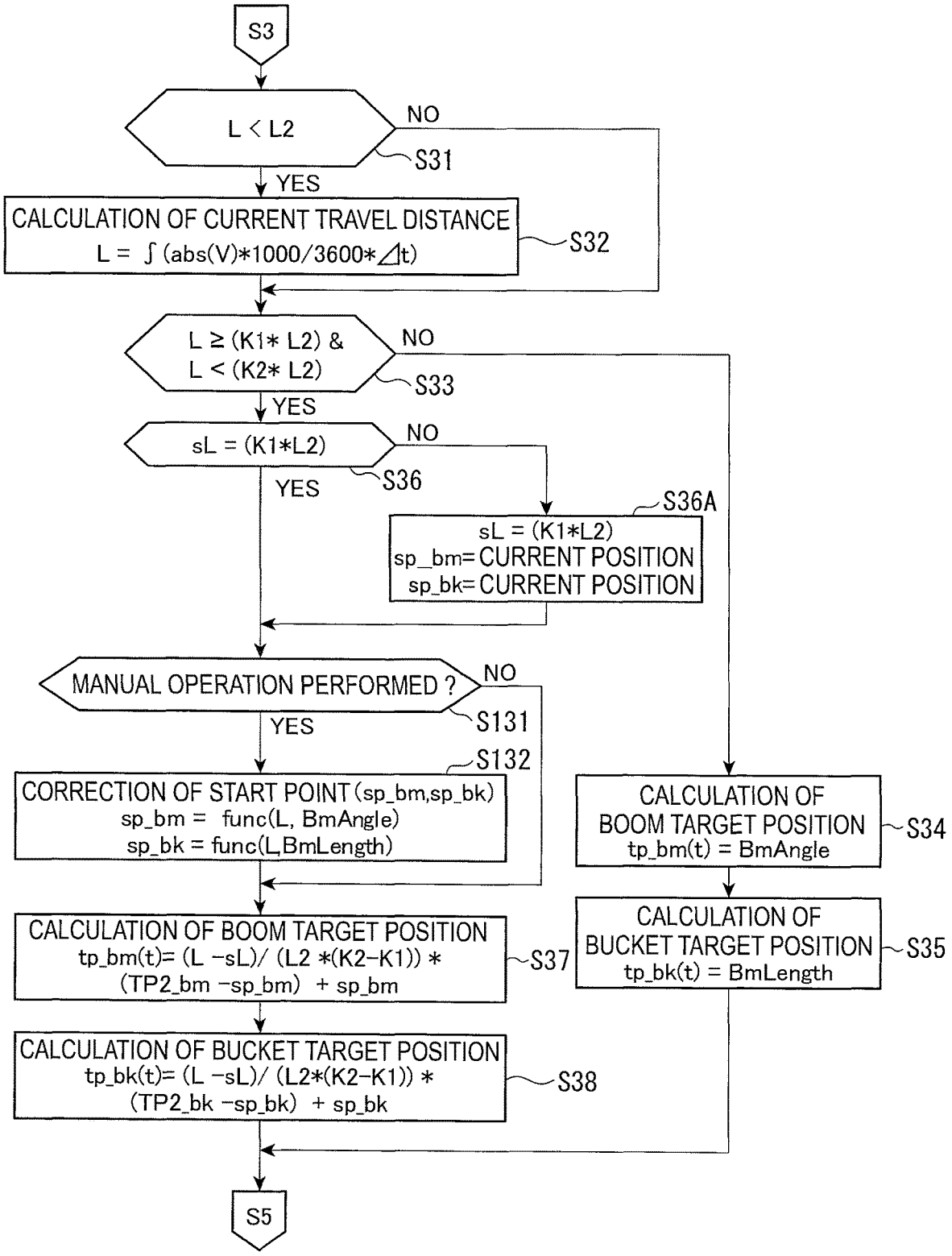

FIG. 26 is a flow chart showing a working equipment controlling process in the loaded forward traveling state according to the second exemplary embodiment.

Figure 27:
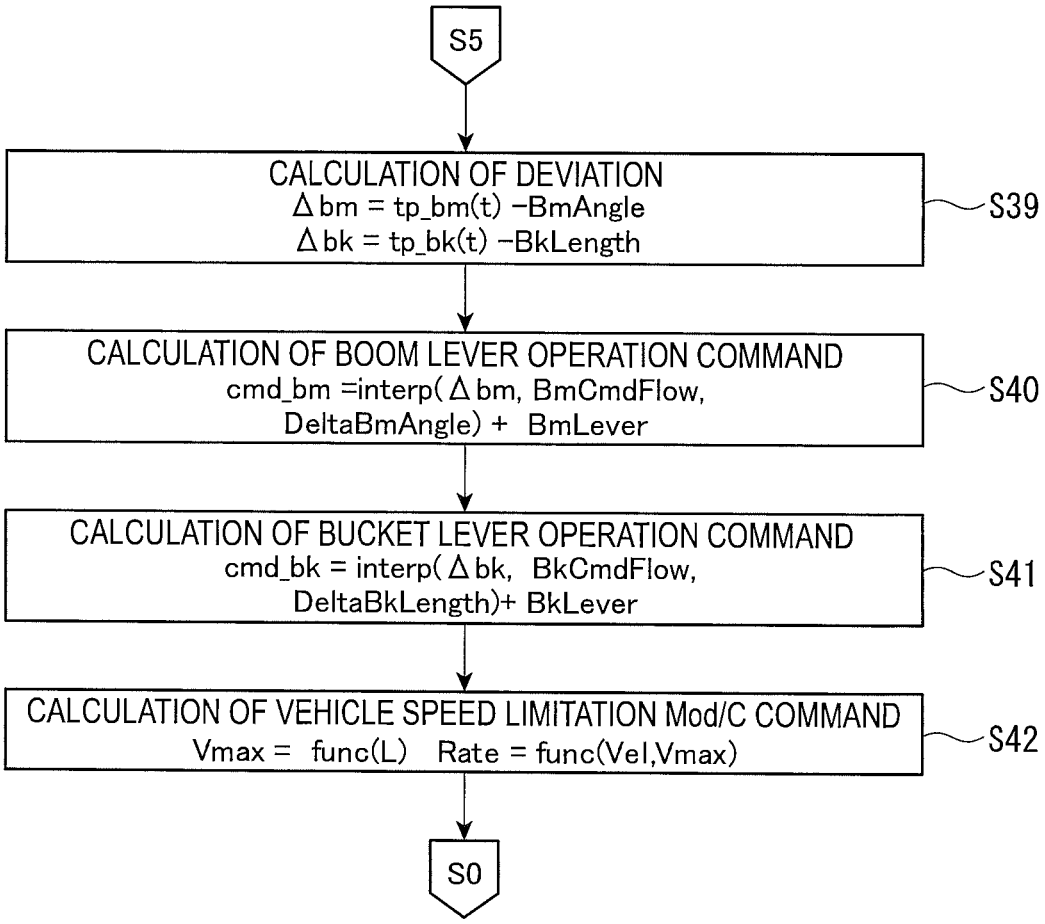

FIG. 27 is another flow chart showing the working equipment controlling process in the loaded forward traveling state according to the second exemplary embodiment.

Figure 28:
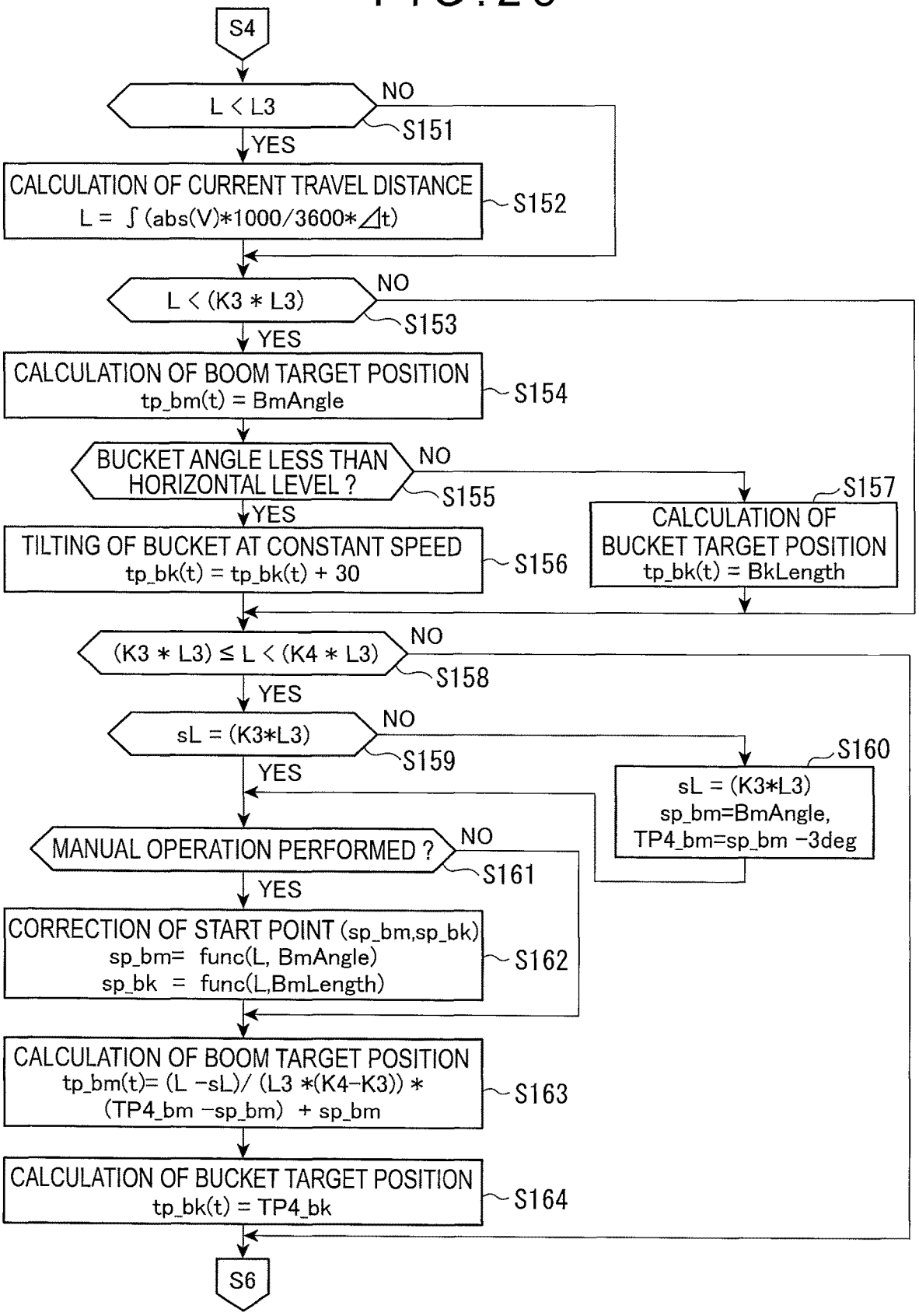

FIG. 28 is a flow chart showing the working equipment controlling process in the unloaded reverse traveling state according to the second exemplary embodiment.

Figure 29:
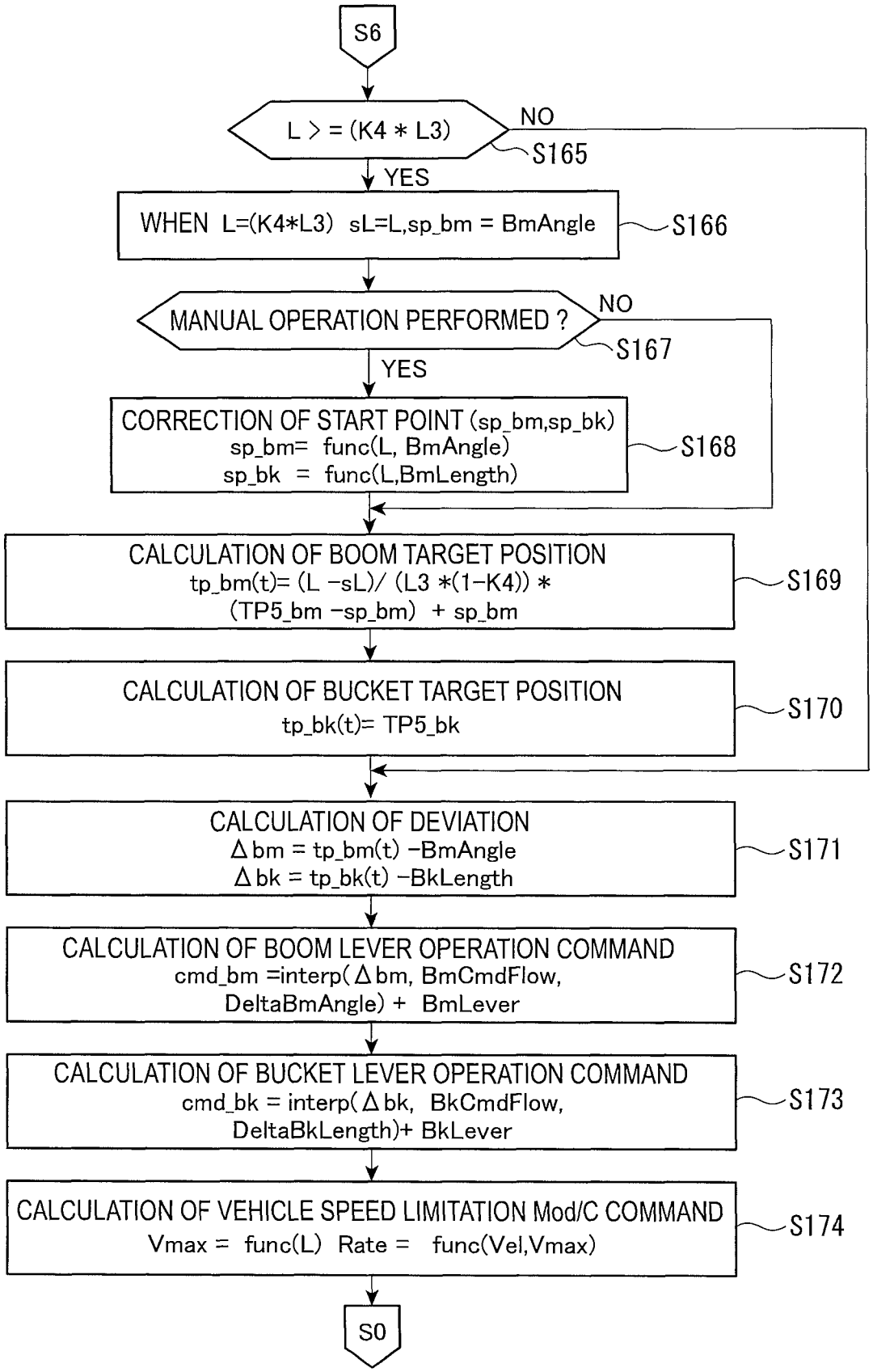

FIG. 29 is another flow chart showing the working equipment controlling process in the unloaded reverse traveling state according to the second exemplary embodiment.

Figure 30:
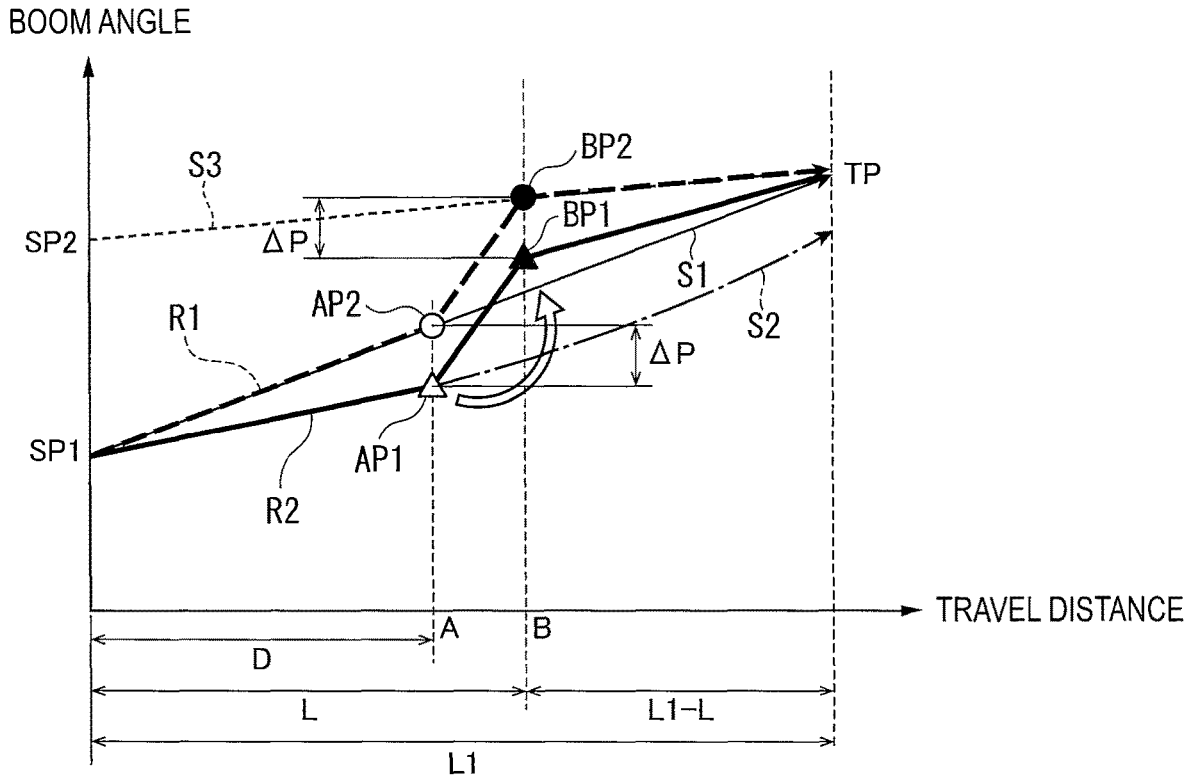

FIG. 30 is a graph showing a setting method of a new relationship between a target position and a travel distance after a manual operation according to the second exemplary embodiment.

Figure 31:
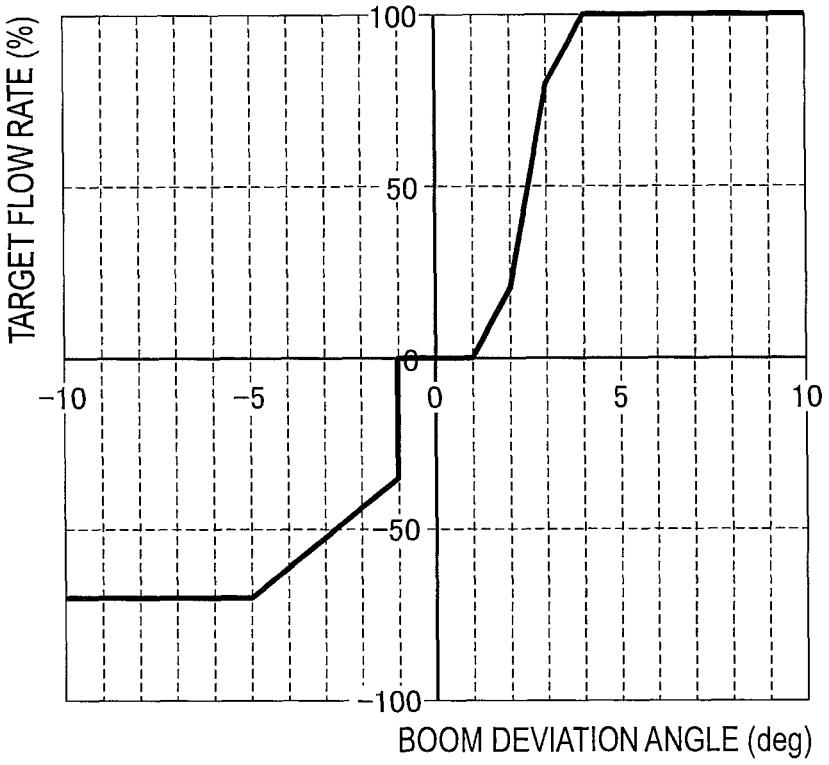

FIG. 31 is a graph showing a relationship between a boom deviation angle and a target flow rate according to the second exemplary embodiment.

Figure 32:
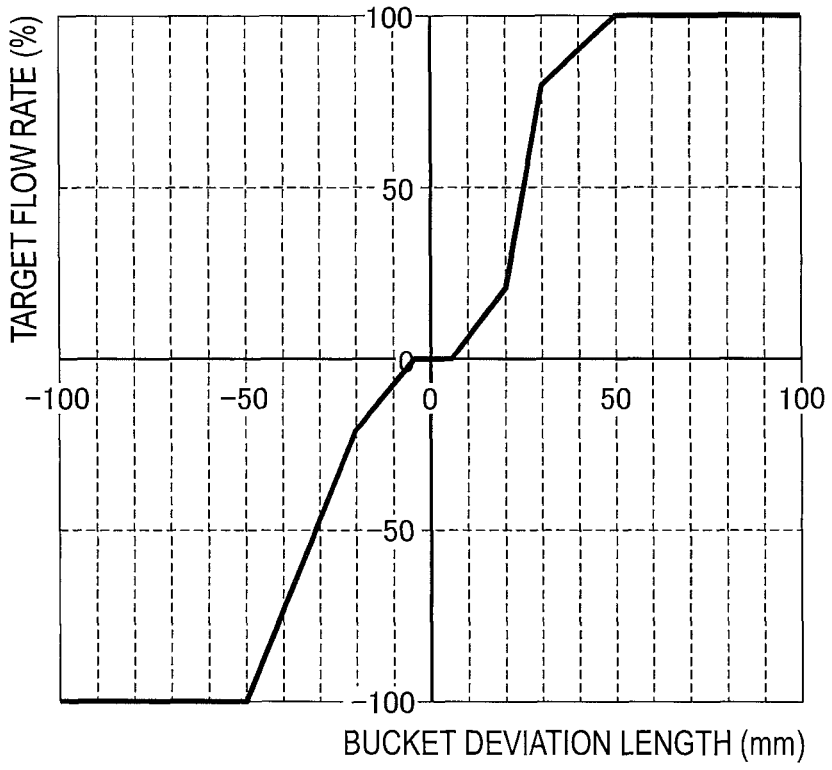

FIG. 32 is a graph showing a relationship between a bucket deviation length and the target flow rate according to the second exemplary embodiment.

DESCRIPTION OF EMBODIMENT(S)

First Exemplary Embodiment

Overall Arrangement of Wheel Loader

Figure 1:
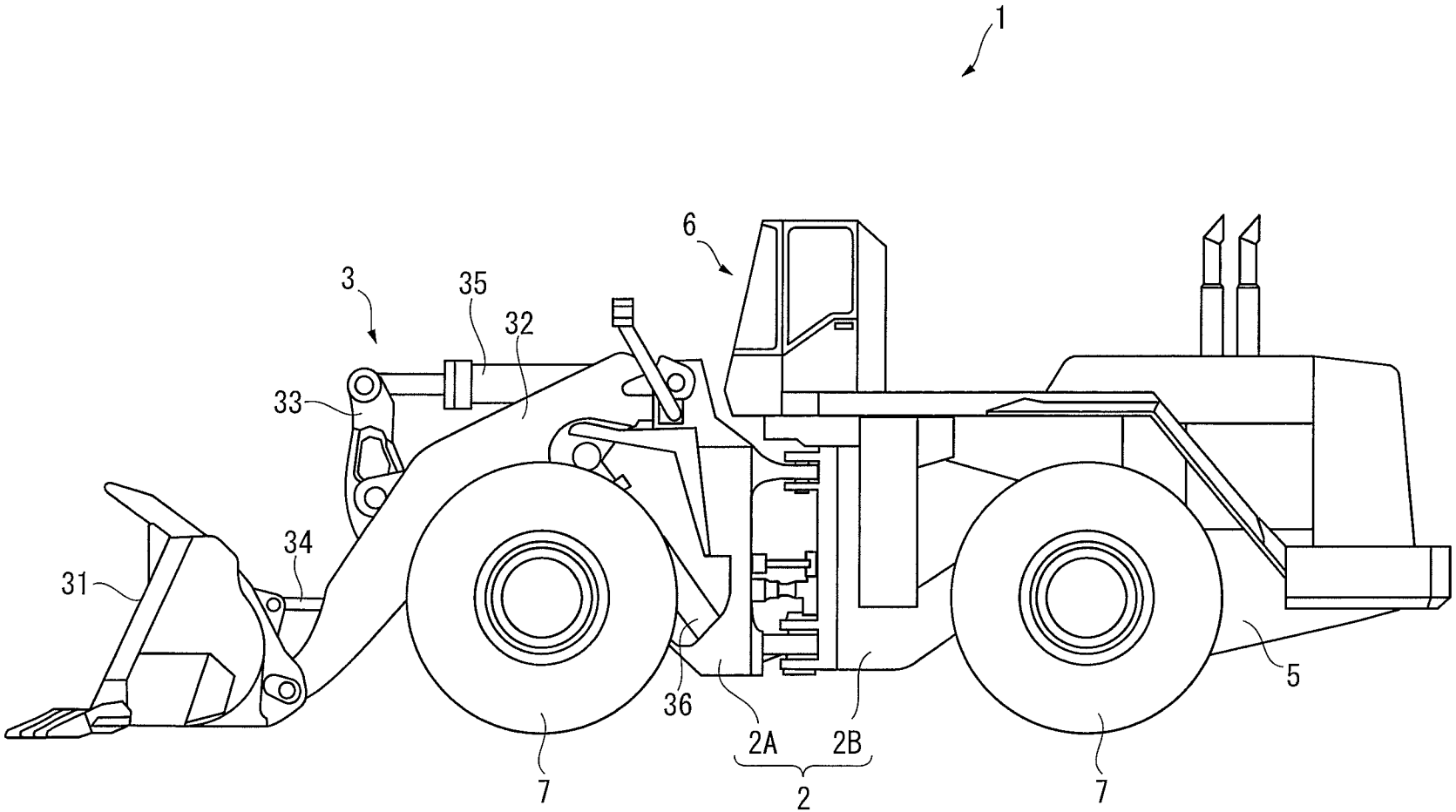

FIG. 1 is a side view of a wheel loader 1 according to a first exemplary embodiment of the invention. The wheel loader 1 is a large-sized wheel loader 1 intended to be used in mines and the like.

The wheel loader 1 includes a vehicle body 2 including a front vehicle body 2A and a rear vehicle body 2B. The front vehicle body 2A has a front side (the left side in FIG. 1) provided with hydraulic working equipment 3 including an excavating/loading bucket 31, a boom 32, a bell crank 33, a connecting link 34, a bucket cylinder 35 and a boom cylinder 36.

The rear vehicle body 2B includes a rear vehicle body frame 5 formed from a thick metal plate or the like. The rear vehicle body frame 5 has a front side provided with a box-shaped cab 6 in which an operator is to be seated and a rear side where, for instance, an engine (not shown) and a hydraulic pump configured to be driven by the engine are mounted.

Drive Mechanism for Working Equipment

Figure 2:
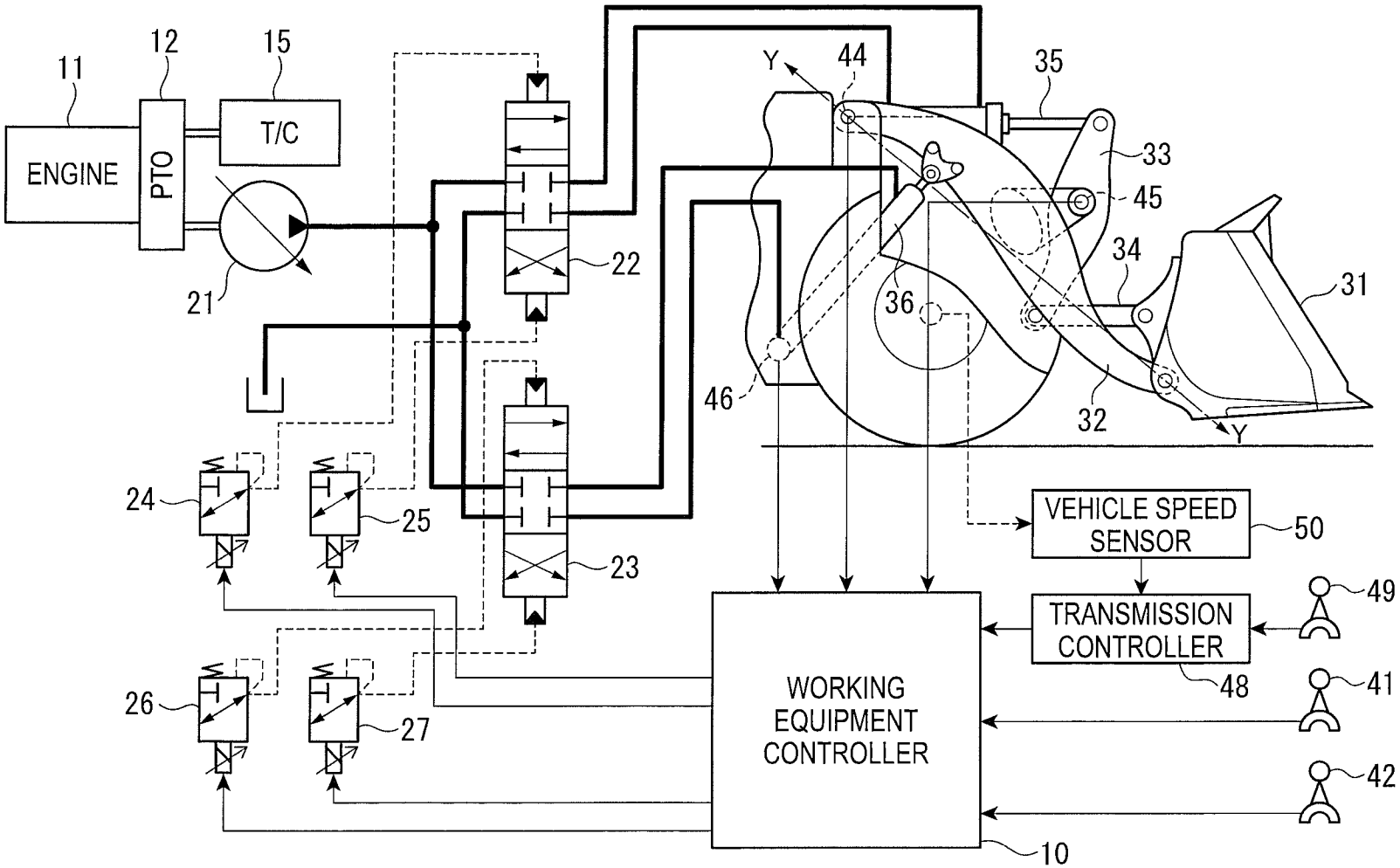

FIG. 2 schematically illustrates a drive mechanism for the working equipment 3. The wheel loader 1 includes a working equipment controller 10, an engine 11 and a power take-off (PTO) 12. The PTO 12 distributes an output from the engine 11 to a travel system for driving wheels (tires) 7 and a hydraulic system for driving the working equipment 3.

Arrangement of Travel System

The travel system, which is a mechanism (traveling unit) allowing the wheel loader 1 to travel, includes not only a transmission and an axle (both not shown) but also a torque converter (T/C) 15. A power outputted from the engine 11 is transmitted to the wheels 7 through the PTO 12, the torque converter 15, the transmission and the axle.

Arrangement of Hydraulic System

The hydraulic system is a mechanism for driving mainly the working equipment 3 (e.g., the boom 32 and the bucket 31). The hydraulic system includes: a hydraulic pump 21 for the working equipment driven by the PTO 12; hydraulic pilot valves including a bucket operation valve 22 and a boom operation valve 23 provided in a discharge circuit of the hydraulic pump 21; solenoid proportional pressure control valves 24, 25 for the bucket independently connected to pilot-pressure receiving portions of the bucket operation valve 22; and solenoid proportional pressure control valves 26, 27 for the boom independently connected to pilot-pressure receiving portions of the boom operation valve 23.

The solenoid proportional pressure control valves 24 to 27 are connected to a pilot pump (not shown) to independently control the supply of a hydraulic oil from the pilot pump to the pilot-pressure receiving portions in accordance with a control signal from the working equipment controller 10.

Specifically, the solenoid proportional pressure control valve 24 switches the bucket operation valve 22 so that the bucket cylinder 35 is retracted to move the bucket 31 to a loading position. Similarly, the solenoid proportional pressure control valve 25 switches the bucket operation valve 22 so that the bucket cylinder 35 is extended to move the bucket 31 to a tilting position.

The solenoid proportional pressure control valve 26 switches the boom operation valve 23 so that the boom cylinder 36 is retracted to lower the boom 32. Similarly, the solenoid proportional pressure control valve 27 switches the boom operation valve 23 so that the boom cylinder 36 is extended to raise the boom 32.

Devices Connected to Working Equipment Controller

Figure 3:
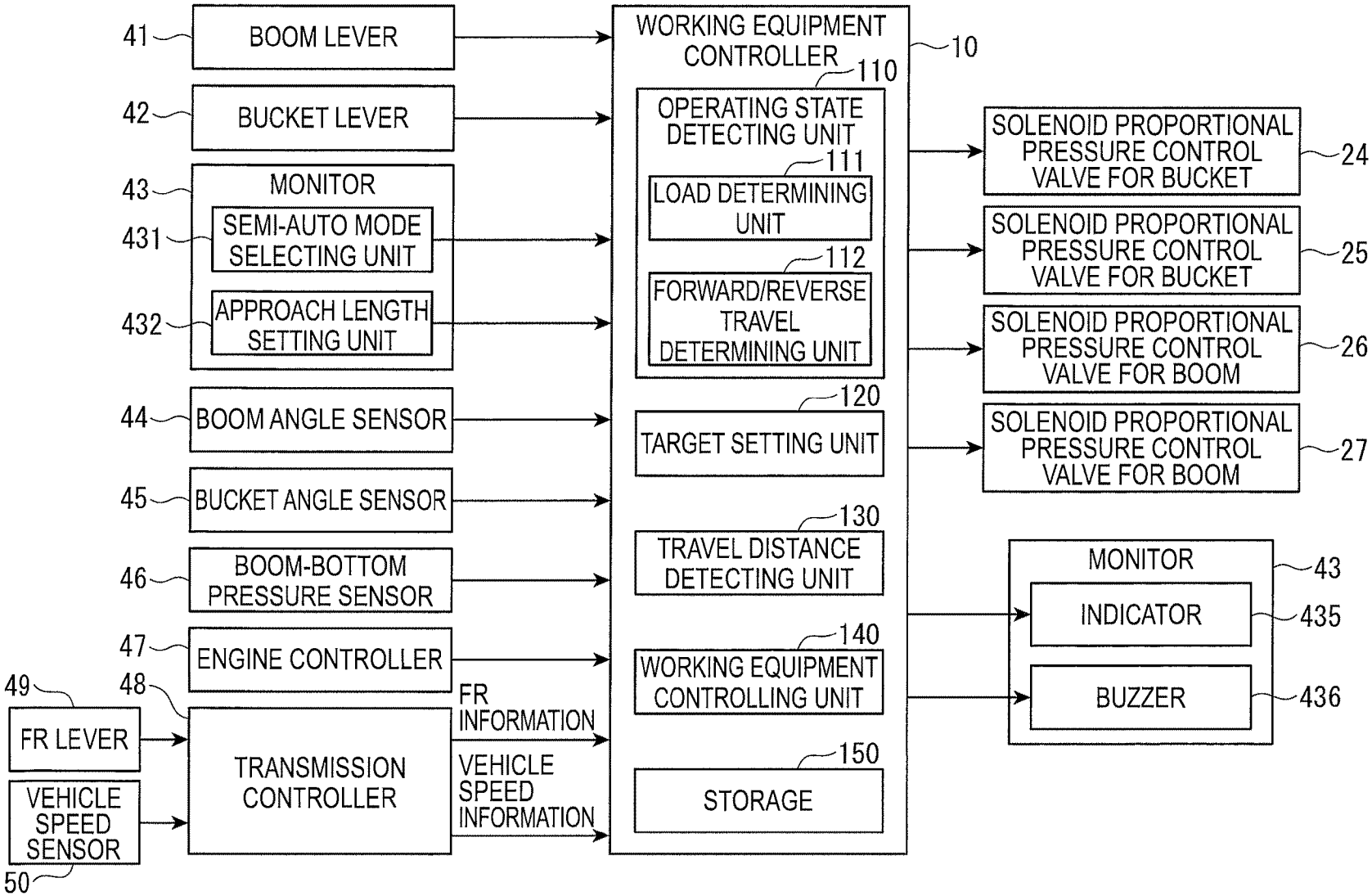

As shown in FIG. 3, the working equipment controller 10 is connected to: a boom lever 41 and a bucket lever 42 both disposed in the cab 6; a semi-auto mode selecting unit 431 and an approach length setting unit 432 both provided to a monitor 43 disposed in the cab 6; a boom angle sensor 44; a bucket angle sensor 45; a boom-bottom pressure sensor 46; an engine controller 47; and a transmission controller 48.

The boom lever 41 includes a lever angle sensor for detecting a lever angle. When an operator operates the boom lever 41, the lever angle sensor detects a lever angle corresponding to displacement of the boom lever 41, and outputs the lever angle in the form of a boom lever signal to the working equipment controller 10.

The bucket lever 42 includes a lever angle sensor for detecting a lever angle. When an operator operates the bucket lever 42, the lever angle sensor detects a lever angle corresponding to displacement of the bucket lever 42, and outputs the lever angle in the form of a bucket lever signal to the working equipment controller 10.

The semi-auto mode selecting unit 431 displays a mode selection button on the monitor 43. When an operator operates the mode selection button to select a semi-auto loading mode, the semi-auto mode selecting unit 431 outputs an ON signal as a semi-auto mode selection signal and, otherwise, outputs an OFF signal as the semi-auto mode selection signal.

Figure 4:
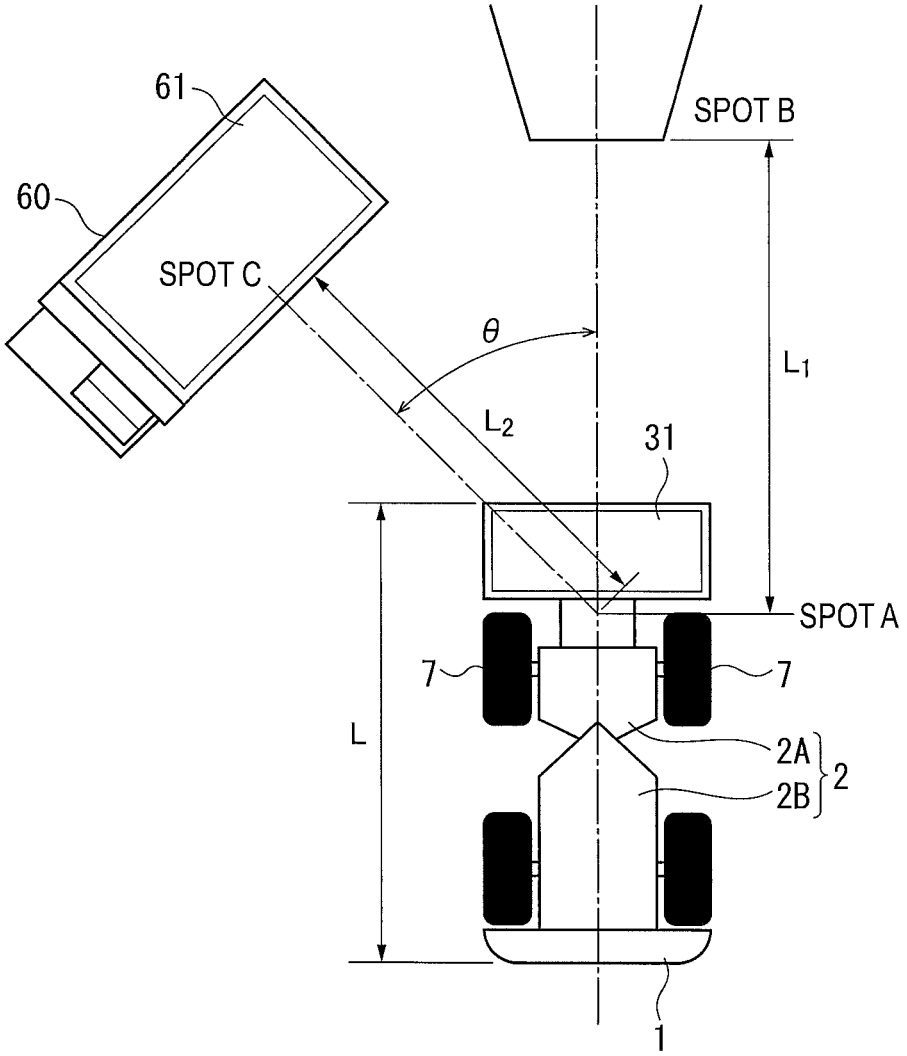

As shown in FIG. 4, the approach length setting unit 432 sets travel distances for a V-shape operation, including: a travel distance L1 for the wheel loader 1 to be reversed with, for instance, soil and sand being loaded in the bucket 31 after excavation of the soil and sand is completed; and a travel distance L2 for the wheel loader 1 to be moved toward a dump truck 60 after being reversed for the travel distance L1 and stopped. In FIG. 4, L represents the entire length of the wheel loader 1. L1 and L2 are each provided in the form of a ratio to the entire vehicle length L of the wheel loader 1, and respective default values thereof are: L1=1 (equal to the entire vehicle length) and L2=0.8 (equal to 80% of the entire vehicle length). The approach length setting unit 432 displays the respective default values "1" and "0.8" of the approach lengths L1, L2 on the monitor 43. When an operator changes these numerical values, the approach length setting unit 432 stores the inputted values as preset values and outputs the inputted values to the working equipment controller 10.

The boom angle sensor 44, which may include a rotary encoder provided to an attached portion (a support shaft) of the boom 32 relative to the vehicle body 2 as shown in FIG. 2, detects a boom angle between the center axis of the boom 32 and a horizontal axis and outputs the detection signal. The boom angle sensor 44 thus serves as a boom position detecting unit. The center axis of the boom 32, which is represented by a line Y-Y in FIG. 2, connects the attached portion of the boom 32 (i.e., the center of the support shaft) relative to the vehicle body 2 and an attached portion of the bucket 31 (the center of a bucket support shaft). Specifically, when the line Y-Y in FIG. 2 is set along the horizontal axis, the boom angle sensor 44 outputs a boom angle of zero degree. Further, the boom angle sensor 44 outputs a positive value when a distal end of the boom 32 is lifted from a position of the zero-degree boom angle, and outputs a negative value when the distal end of the boom 32 is lowered.

The bucket angle sensor 45, which may include a rotary encoder provided to a rotation shaft of the bell crank 33, outputs zero degree when the bucket 31 is in contact with the ground with a blade edge of the bucket 31 being horizontal on the ground. Further, the bucket angle sensor 45 outputs a positive value when the bucket 31 is moved toward the tilting position (upward), and outputs a negative value when the bucket 31 is moved toward the loading position (downward). The bucket angle sensor 45 thus serves as a bucket position detecting unit.

The boom-bottom pressure sensor 46 detects a boom-bottom pressure of the boom cylinder 36. The boom-bottom pressure is increased when the bucket 31 is loaded, and decreased when the bucket 31 is unloaded.

The engine controller 47 communicates with the working equipment controller 10 through a controller area network (CAN), and outputs engine operation information including the speed of the engine 11 to the working equipment controller 10.

The transmission controller 48 communicates with the working equipment controller 10 through the CAN, and outputs FR information and vehicle speed information to the working equipment controller 10, the FR information indicating a travel direction of the wheel loader 1 (i.e., forward or reverse) selected using an FR lever 49 and a lever gear position, the vehicle speed information being received from a vehicle speed sensor 50. It should be noted that the vehicle speed sensor 50 is configured to detect the vehicle speed based on, for instance, the rotation of drive shaft(s) of the tire(s) 7, and the vehicle speed information detected by the vehicle speed sensor 50 is outputted to the working equipment controller 10 via the transmission controller 48.

Arrangement of Working Equipment Controller

The working equipment controller 10 includes an operating state detecting unit 110, a target setting unit 120, a travel distance detecting unit 130, a working equipment controlling unit 140, and a storage 150.

The operating state detecting unit 110 includes a load determining unit 111 and a forward/reverse travel determining unit 112. The load determining unit 111 determines whether or not the bucket 31 is loaded based on an output value from the boom-bottom pressure sensor 46.

The forward/reverse travel determining unit 112 determines whether the wheel loader 1 is in a forward traveling state or a reverse traveling state based on the FR information outputted from the transmission controller 48 in accordance with an operation on the FR lever 49.

Operating State Detecting Unit

The operating state detecting unit 110 detects an operating state based on the determination result of the load determining unit 111 and the determination result of the forward/reverse travel determining unit 112. In the first exemplary embodiment, the operating state detecting unit 110 is configured to at least detect: a loaded reverse traveling state where the wheel loader 1 is reversed after excavation is completed; a loaded forward traveling state where the wheel loader 1 in a loaded state is moved forward to transport the load to the dump truck 60 or the like; and an unloaded reverse traveling state where the wheel loader 1 is reversed after discharging the load onto the dump truck 60 or the like.

Target Setting Unit

Based on the operating state detected by the operating state detecting unit 110, the target setting unit 120 determines a relationship between a travel distance of the wheel loader 1 and a target position of the working equipment 3. In the first exemplary embodiment, the relationship is determined by assigning a current travel distance to a numerical expression for calculating the target position of the working equipment 3 (i.e., the boom angle of the boom 32 and the bucket cylinder length of the bucket 31) as described later. Alternatively, the relationship between the travel distance and the target position may be stored in the form of a table.

Travel Distance Detecting Unit

The travel distance detecting unit 130 receives the vehicle speed information detected by the vehicle speed sensor 50 from the transmission controller 48, and calculates the current travel distance of the wheel loader 1.

Working Equipment Controlling Unit

Based on the various pieces of inputted information, the working equipment controlling unit 140 outputs control signal(s) to the solenoid proportional pressure control valves 24 to 27 to actuate the bucket 31 and/or the boom 32.

Further, the working equipment controller 10 outputs an indicator command and/or a buzzer command to the monitor 43. Upon reception of the indicator command, the monitor 43 controls the display of an indicator 435 provided to the monitor 43 to present information to an operator.

Upon reception of the buzzer command, the monitor 43, which is provided with a buzzer 436 capable of beeping, activates the buzzer 436 to beep to warn an operator.

The storage 150 stores not only various pieces of data inputted to the working equipment controller 10 but also various parameters required for controlling the working equipment 3.

V-Shape Operation Processes

Next, the V-shape operation by the wheel loader 1 will be described with reference to FIGS. 4 and 5. The V-shape operation includes the following plurality of operation processes.

1. Unloaded Stop to Excavation

A state where front ends of front ones of the tires 7 of the wheel loader 1 in an unloaded state (i.e., the bucket 31 is unloaded with a load such as soil and sand) are positioned on a spot A as shown in FIG. 4 is referred to as an unloaded stopped state (a start position).

Subsequently, an operator drives the wheel loader 1 in the unloaded state forward to a bank or the like as shown in FIG. 5(A). Specifically, the operator should preferably drive the wheel loader 1 forward for a distance L1 until the front ends of the tires 7 reach a spot B, as shown in FIG. 4.

The bucket 31 then performs excavation of the bank, and soil and sand is loaded in the bucket 31 as shown in FIG. 5(B).

2. Completion of Excavation to Loaded Reverse Travel

As shown in FIG. 5(C), after the completion of the excavation, the operator reverses the wheel loader 1 in the loaded state with the bucket 31 being loaded with, for instance, soil and sand to an unloaded stop position (the position of the spot A in FIG. 4). In other words, the wheel loader 1 is reversed for the distance L1.

3. Loaded Reverse Travel to Loaded Forward Travel

After stopping the wheel loader 1 at the unloaded stop position, the operator drives the wheel loader 1 in the loaded state forward to the dump truck 60 as shown in FIG. 5(D). As shown in FIG. 4, an angle difference θ between a direction for the wheel loader 1 to face the bank and a direction for the wheel loader 1 to face the dump truck 60 at the unloaded position usually falls approximately within a range from 45 to 60 degrees. A travel distance to the dump truck 60 is set at the above distance L2. The operator operates the steering to turn and move the wheel loader 1 forward for the travel distance L2. When the wheel loader 1 reaches a side of the dump truck 60, the operator stops the wheel loader 1 by a brake operation.

4. End of Loaded State to Loading

As shown in FIG. 5(E), the operator moves the bucket 31 to the loading position to load the sand and soil from the bucket 31 onto the vessel 61.

5. Unloaded Reverse Travel to Unloaded Stop

After the completion of the loading, the operator reverses the wheel loader 1 in the unloaded state as shown in FIG. 5(F). The operator operates the steering while reversing the wheel loader 1 so that the wheel loader 1 in the unloaded state is reversed for the distance L2 and stopped. A position where the wheel loader 1 in the unloaded state is stopped is the same as the start position (the unloaded stop position) as shown in FIG. 5(G).

The operator repeats the above processes to move the wheel loader 1 along a substantially V-shaped locus (V-shape operation).

Semi-Automatic Control

For excavation as shown in FIG. 5(B) in the V-shape operation, a control allowing the bucket 31 to move in conjunction with the movement of boom 32 has been employed. Therefore, it is not necessary for the operator to operate the boom lever 41 and the bucket lever 42 to move the bucket 31 and the boom 32 during excavation.

Typically, the processes other than excavation have required a manual operation by the operator. In contrast, in the first exemplary embodiment, when the semi-auto mode selection signal set by the semi-auto mode selecting unit 431 is ON, the working equipment controller 10 enables an automatic control of the working equipment 3 in the processes other than excavation (e.g., a process where the wheel loader 1 is to be driven). In the first exemplary embodiment, when the automatic control of the working equipment 3 is enabled, a semi-automatic control accepting a manual operation of the boom lever 41 and the bucket lever 42 by the operator is also enabled.

Specifically, the semi-automatic control is performed during the loaded reverse travel of Fig. FIG. 5(C), the loaded forward travel of FIG. 5(D) and the unloaded reverse travel of FIG. 5(F).

Description will be made on a process of the semi-automatic control performed by the working equipment controller 10.

Figure 6:
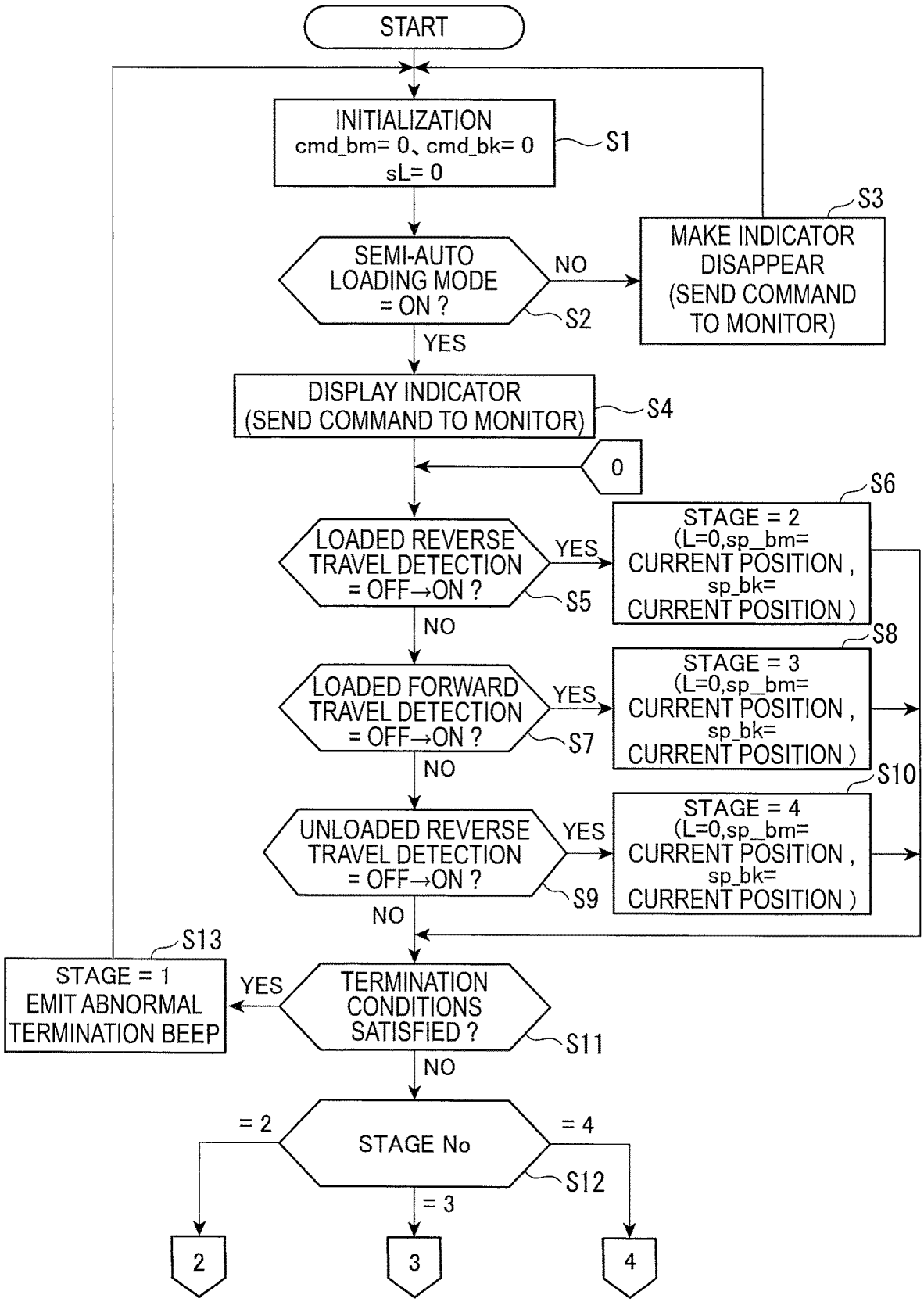
FIG. 6 is a flow chart showing a working equipment controlling process for the V-shape operation according to the first exemplary embodiment.

When the process is started in response to an ON-operation by an engine key, the working equipment controller 10 first initializes lever operation commands (i.e., a boom lever operation command: cmd_bm and a bucket lever operation command: cmd_bk) to "0", and initializes a variable sL representing a start-time distance for a loaded forward travel control and an unloaded reverse travel control to "0", as shown in FIG. 6 (Step S1).

Next, the working equipment controller 10 determines whether or not the semi-auto mode selection signal outputted from the semi-auto mode selecting unit 431 indicates that the semi-auto loading mode is "ON" (Step S2). When the semi-auto loading mode is "OFF", the determination result by the working equipment controller 10 is "NO" in Step S2. The working equipment controller 10 then outputs the indicator command to the monitor 43 so that an indicator indicating that the semi-auto loading mode is on (if any) disappears from the monitor 43 (Step S3). The working equipment controller 10 repeats Steps S1 to S3 until the semi-auto loading mode is turned "ON".

When the semi-auto loading mode is "ON", the determination result by the working equipment controller 10 is YES in Step S2. The working equipment controller 10 then outputs the indicator command to the monitor 43 so that the monitor 43 displays the indicator indicating that the semi-auto loading mode is on (Step S4).

Operating State Detecting Process

The load determining unit 111 determines whether the wheel loader 1 is in the loaded state or the unloaded state based on a boom-bottom pressure sensor signal outputted from the boom-bottom pressure sensor 46. The forward/reverse travel determining unit 112 determines whether the wheel loader 1 is in the forward traveling state or the reverse traveling state based on the FR information outputted from the transmission controller 48. Based on the above pieces of information, the operating state detecting unit 110 can detect that the wheel loader 1 is in the loaded reverse traveling state, the loaded forward traveling state or the unloaded reverse traveling state Loaded Reverse Travel Detection The operating state detecting unit 110 of the working equipment controller 10 determines whether or not a loaded reverse travel detection is turned ON from OFF (Step S5). When it is detected that the loaded reverse travel detection is turned ON from OFF, the determination result by the working equipment controller 10 is "YES" in Step S5. In this case, a variable STAGE representing an operation stage is set at "2", a variable L representing a travel distance is set at a default value "0", and a variable sp_bm (a boom angle) and a variable sp_bk (a bucket cylinder length) representing the start position of the working equipment are each set at a value corresponding to the current position (Step S6). In Step S6, the working equipment controller 10 sets sp_bm at the current boom angle based on a detection value of the boom angle sensor 44 and sp_bk at the current bucket cylinder length based on a detection value of the bucket angle sensor 45.

Loaded Forward Travel Detection

When the determination result is "NO" in Step S5, the operating state detecting unit 110 of the working equipment controller 10 determines whether or not a loaded forward travel detection is turned ON from OFF (Step S7). When the determination result is "YES" in Step S7 (it is detected that the loaded forward travel detection is turned ON), the working equipment controller 10 sets the variable STAGE representing the operation stage at "3", the variable L representing the travel distance at the default value "0", sp_bm at the current boom angle, and sp_bk at the current bucket cylinder length (Step S8).

Unloaded Reverse Travel Detection

When the determination result is "NO" in Step S7, the operating state detecting unit 110 of the working equipment controller 10 determines whether or not an unloaded reverse travel detection is turned ON from OFF (Step S9). When the determination result is "YES" in Step S9 (it is detected that the unloaded reverse travel detection is turned ON), the working equipment controller 10 sets the variable STAGE representing the operation stage at "4", the variable L representing the travel distance at the default value "0", sp_bm at the current boom angle, and sp_bk at the current bucket cylinder length (Step S10).

Termination Condition Determination

After the variables are initialized in Steps S6, S8, S10 or when the determination result is NO in Step S9, the working equipment controller 10 determines whether or not termination conditions are satisfied (Step S11).

Specifically, the termination conditions to be satisfied include the following six conditions 1 to 6.

A termination condition 1 is satisfied when a semi-auto mode is disabled in accordance with the output from the semi-auto mode selecting unit 431 of the monitor 43.

A termination condition 2 is satisfied when the operating state detecting unit 110 detects either an unloaded forward traveling state or an excavation state. The unloaded forward traveling state may be determined based on the signal from the boom-bottom pressure sensor and the FR information, and the excavation state may be determined based on the signal from, for instance, boom-bottom pressure sensor, the boom angle and the bucket cylinder length.

A termination condition 3 is satisfied when a lever gear position is F3 (third forward speed) or greater. The lever gear position to be selected is F2 or less when the wheel loader 1 is in the V-shape operation. Therefore, in the case where the lever gear position is F3, the wheel loader 1 is supposed not to work but travel.

A termination condition 4 is satisfied when the working equipment 3 is locked. The wheel loader 1 is provided with a lock button to prevent the working equipment 3 from moving during travel. Therefore, in the case where the operator operates the lock button, the wheel loader 1 is determined not to work but to travel.

A termination condition 5 is satisfied when a failure mode effect analysis (FMEA) indicates that the sensor(s) and/or the solenoid proportional pressure control valve(s) (EPC valves) 24 to 27 should have a malfunction requiring termination of the semi-auto mode.

A termination condition 6 is satisfied when the engine operating state inputted from the engine controller 47 indicates that the engine is stopped.

When any one of the termination conditions 1 to 6 is satisfied, the determination result by the working equipment controller 10 is YES in Step S11. In this case, the working equipment controller 10 sets the variable STAGE at "1" meaning a stand-by state. Further, when any one of the conditions other than the termination condition 2 is satisfied, the working equipment controller 10 outputs the buzzer command to the monitor 43 to emit an abnormal termination beep (Step S13). The working equipment controller 10 then continues the process from Step S1.

Setting Information for Semi-Automatic Control

When the determination result is "NO" (none of the termination conditions is satisfied) in Step S11, the working equipment controller 10 checks the value of the variable STAGE representing the operation stage. The working equipment controller 10 performs: a loaded reverse travel control when STAGE=2; a loaded forward travel control when STAGE=3; and an unloaded reverse travel control when STAGE=4, as described later (Step S12).

Figure 7:
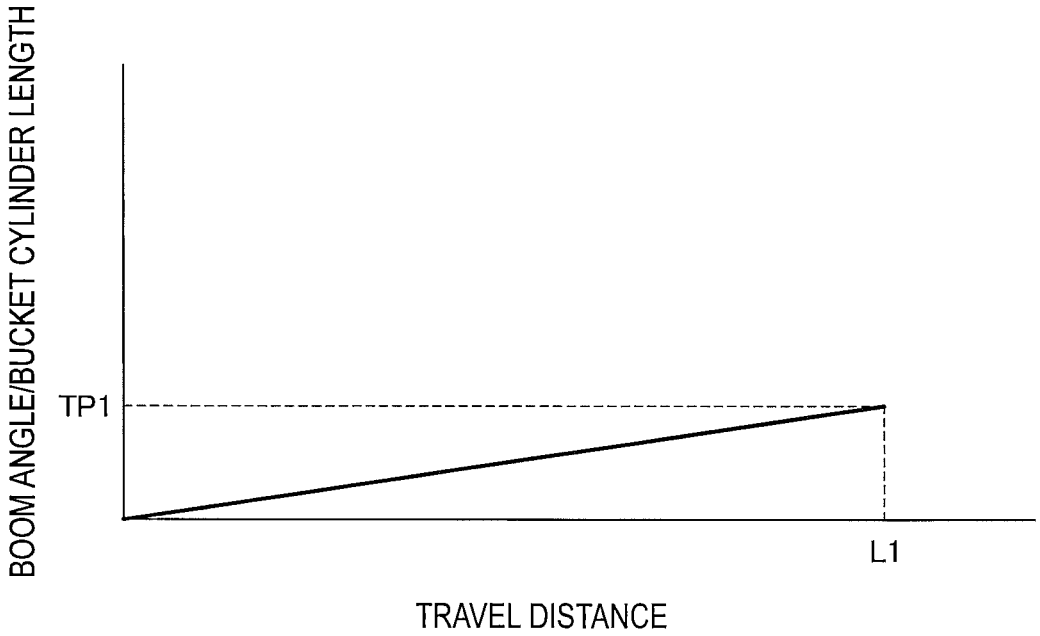
FIG. 7 is a graph showing a relationship between a travel distance and a target position of the working equipment in a loaded reverse traveling state according to the first exemplary embodiment.
Figure 8:
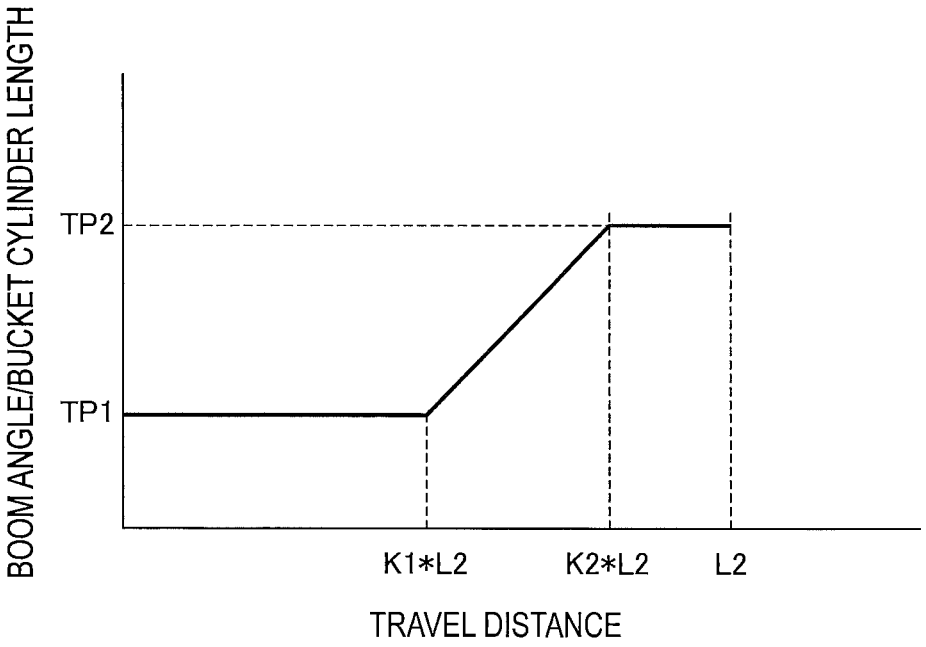
FIG. 8 is a graph showing a relationship between the travel distance and the target position of the working equipment in a loaded forward traveling state according to the first exemplary embodiment.
Figure 9:
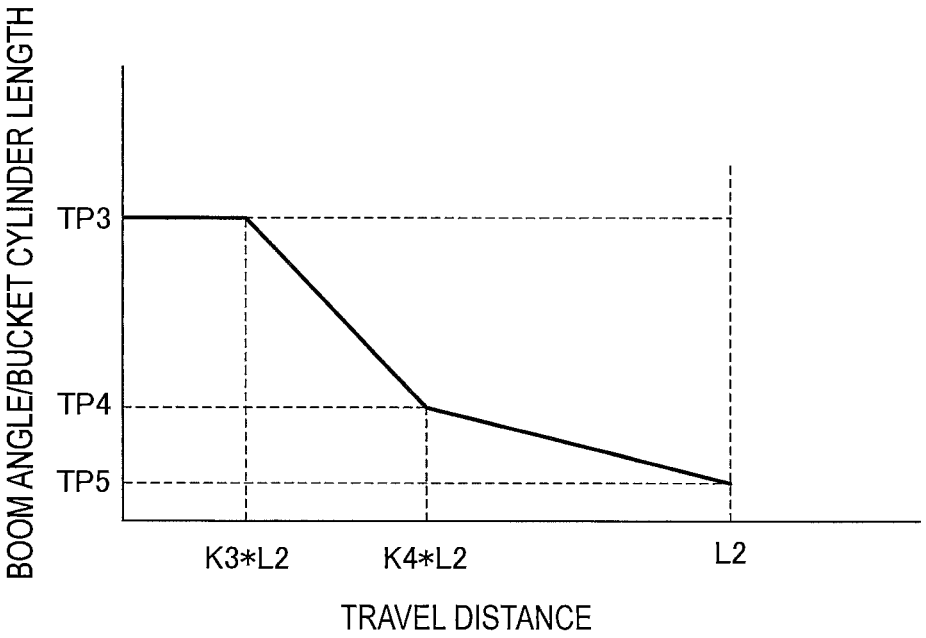
FIG. 9 is a graph showing a relationship between the travel distance and the target position of the working equipment in an unloaded reverse traveling state according to the first exemplary embodiment.

It should be noted that these controls are each independently based on a relationship between the travel distance of the wheel loader 1 and the target position of the working equipment 3, which depends on the operating state related to each of the controls. Specifically, the target position of the working equipment 3 is a position where the working equipment 3 is to reach when the wheel loader 1 travels a predetermined distance. Tables 1 and 2 show examples of the target position of the working equipment 3, and FIGS. 7 to 9 show relationships between the travel distance and the target position determined based on Tables 1 and 2. It should be noted that parameters defined in Tables 1 and 2 are stored in the storage 150 of the working equipment controller 10.

In Table 1, "lifted positioner position" and "lowered positioner position" in a column of boom angle mean boom angles preset by the operator. "Positioner position" in a column of bucket cylinder length is set at a position where the bucket angle becomes zero degrees when the boom 32 is lowered to bring the bucket 31 into contact with the ground.

TABLE 1

| Working Equipment Target | Boom Angle | Bucket Cylinder Length |
|---|---|---|
| Loaded Reverse (TP1) | Horizontal (0 deg) | See Table 2 |
| Loaded Forward (TP2) | Lifted Positioner Position | See Table 2 |
| Unloaded Reverse (TP3) | (Not Operated) | Positioner Position |
| Unloaded Reverse (TP4) | Horizontal (0 deg) | Positioner Position |
| Unloaded Reverse (TP5) | Lowered Positioner Position | Positioner Position |

TABLE 2

| | | Bucket Cylinder Length | |
|---|---|---|---|
| Boom Angle | Bucket Angle | High Lift | STD |
| $-\alpha 1$ | $\beta 1$ | A1 | B1 |
| 0 | $\beta 2$ | A2 | B2 |
| $\alpha 2$ | $\beta 3$ | A3 | B3 |

Relationship Between Travel Distance and Target Position of Working Equipment in Loaded Reverse Traveling State In the loaded reverse travel control, while the wheel loader 1 is reversed for the predetermined distance L1 from a position at the time of the completion of excavation, the working equipment 3 is moved to a target position TP1 from the current position thereof at the time of the completion of excavation, as shown in FIG. 7. In other words, the boom angle, which changes in proportion to the travel distance, reaches zero degrees (TP1) when the travel distance reaches L1 as shown in Table 1. The bucket cylinder length is set to allow the bucket 31 to be maintained at a lifted position to prevent the load in the bucket 31 from falling out irrespective of a change in the boom angle.

For instance, according to the example of Table 2, the bucket cylinder length is set to allow the bucket angle to become β2 when the boom angle reaches zero degrees. According to the example of Table 2, the bucket cylinder length is set at A2 when the boom 32 attached to the wheel loader 1 is a high-lift boom, and is set at B2 when the boom 32 attached to the wheel loader 1 is a standard boom.

In the loaded reverse travel control, the operator is supposed to linearly reverse the wheel loader 1 without turning the steering, so that the working equipment 3 may be set to continuously move in proportion to the travel distance.

Relationship Between Travel Distance and Target Position of Working Equipment in Loaded Forward Traveling State In the loaded forward travel control, as shown in FIG. 8, the working equipment 3 is maintained at the position TP1 until the travel distance of the wheel loader 1 reaches a distance K1×L2 (a first interim distance), and is moved from the position TP1 to a position TP2 in proportion to the travel distance while the travel distance is increased from the distance K1×L2 to a distance K2×L2 (a second interim distance).

The working equipment 3 is maintained at the position TP2 while the travel distance of the wheel loader 1 is increased from the distance K2×L2 to the distance L2. A default value of K1 and a default value of K2 are respectively, for instance, 0.5 and 0.8. However, these distance coefficients may be changed by the operator or the like.

TP2 is set so that the boom angle corresponds to the raised positioner position as shown in Tables 1 and 2. The raised positioner position is determined by the operator in accordance with the level of the vessel 61 of the dump truck 6 where a load such as soil and sand is to be loaded from the wheel loader 1. The bucket cylinder length is appropriately set so that the bucket 31 is kept at the lifted position to prevent the load in the bucket 31 from falling out irrespective of a change in the boom angle.

In the loaded forward travel control, the operator is supposed to turn the steering to direct the wheel loader 1 toward the dump truck 60 until the travel distance reaches K1×L2, so that the position of the working equipment 3 should preferably be maintained. In contrast, the working equipment 3 is moved to the lifted positioner position while the travel distance is increased from K1×L2 to K2×L2, and is maintained at the lifted positioner position while the travel distance is increased from K2×L2 to L2, thereby preventing interference between the bucket 31 and the vessel 61.

Relationship Between Travel Distance and Target Position of Working Equipment in Unloaded Reverse Traveling State In the unloaded reverse travel control, as shown in FIG. 9, the working equipment 3 is maintained at a position TP3 until the travel distance of the wheel loader 1 reaches a distance K3×L2 (a third interim distance), and is moved from the position TP3 to a position TP4 in proportion to the travel distance while the travel distance is increased from the distance K3×L2 to a distance K4×L2 (a fourth interim distance).

Further, the working equipment 3 is moved from the position TP4 to a position TP5 in proportion to the travel distance while the travel distance of the wheel loader 1 is increased from the distance K4×L2 to the distance L2. A default value of K3 and a default value of K4 are respectively, for instance, 0.2 and 0.5. However, these distance coefficients may be changed by the operator or the like.

As shown in Table 1, the boom angle is "Not Operated" at TP3. The boom angle is maintained at the lifted positioner position until the completion of the loading from the completion of the loaded forward travel, so that the boom angle is still the lifted positioner position at TP3 for the unloaded reverse travel control. The bucket cylinder length is set to allow the bucket angle to become zero degrees when the bucket 31 is brought into contact with the ground by lowering the boom 32 (i.e., the positioner position).

As shown in Table 1, the boom angle is zero degrees and the bucket cylinder length is the positioner position at TP4. The boom angle is the lowered positioner position and the bucket cylinder length is the positioner position at TP5.

In the unloaded reverse travel control after loading, the working equipment 3 is maintained at the lifted positioner position with the bucket 31 being at the positioner position until the travel distance of the wheel loader 1 reaches the distance K3×L2, thereby preventing interference between the bucket 31 and the vessel 61. The boom 32 is then moved to a horizontal position while the travel distance of the wheel loader 1 is increased from the distance K3×L2 to the distance K4×L2. Further, the boom 32 is gradually moved to the lowered positioner position while the travel distance of the wheel loader 1 is increased from the distance K4×L2 to the distance L2 and, simultaneously, the operator operates the steering to move the wheel loader 1 to the unloaded stop position (i.e., the original position).

Next, the controls to be selected in S12 in FIG. 6 will be described also with reference to the flow charts in FIGS. 10 to 12.

STAGE=2: Loaded Reverse Travel Control

Figure 10:
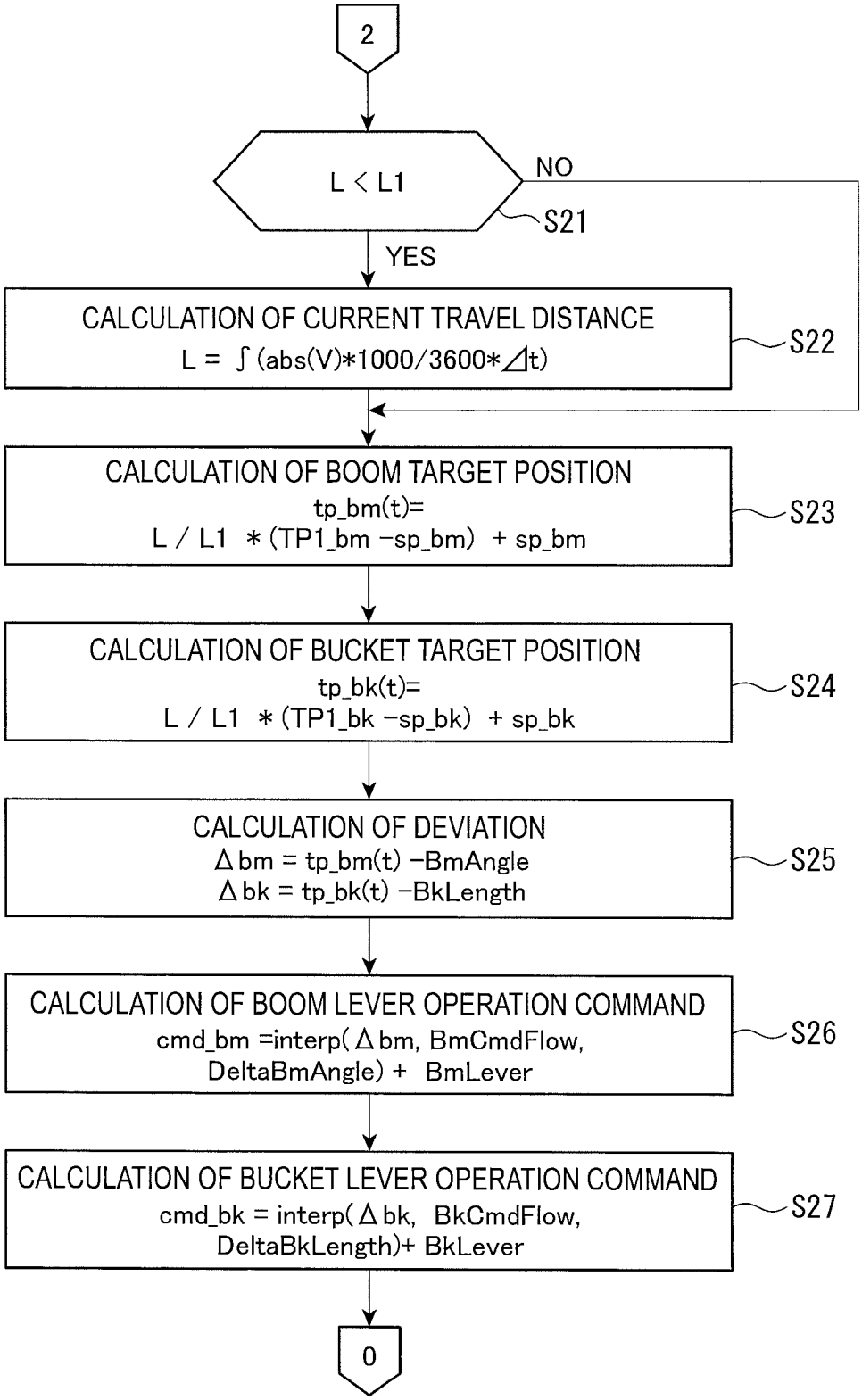
FIG. 10 is a flow chart showing a working equipment controlling process in the loaded reverse traveling state according to the first exemplary embodiment.

In the loaded reverse travel control, as shown in FIG. 10, the working equipment controller 10 determines whether or not a travel distance L obtained by the travel distance detecting unit 130 is less than the preset value L1 (Step S21).

Calculation of Current Travel Distance

When the determination result by the working equipment controller 10 is "YES" in Step S21, the travel distance detecting unit 130 calculates the current travel distance L (Step S22). The current travel distance L is calculated by $\int(\mathrm{abs}(V)*1000/3600*\Delta t)$. V, which represents a vehicle speed (km/h), is multiplied by 1000/3600 to be converted to meters per second (m/s). Δt represents a program-execution cycle (sec) for the working equipment controller 10, and may be 0.01 sec.

When the determination result is "NO" in Step S21 (i.e., the travel distance has already reached the distance L1), the working equipment controller 10 skips the calculation of the current travel distance L in Step S22.

Calculation of Boom Target Position

After Step S22 or when the determination result is "NO" in Step S21, the target setting unit 120 of the working equipment controller 10 calculates a boom target position (Step S23). For the loaded reverse travel, the angle of the boom 32 is controlled in proportion to the travel distance as shown in FIG. 7. A boom target position tp_bm(t) at the travel distance L can thus be calculated by L/L1*(TP1_bm−sp_bm)+sp_bm. TP1_bm represents a boom angle at the target position TP1, and sp_bm represents the start position of the boom 32 set in Step S6. In other words, the boom target position tp_bm(t) can be obtained by multiplying a ratio of the travel distance L to the preset distance L1 and a difference between the target position and start position of the boom 32, and adding the start position (the default value).

Calculation of Bucket Target Position

After Step S23, the target setting unit 120 of the working equipment controller 10 calculates a bucket target position (Step S24). The bucket target position can be calculated in the same manner as the boom target position. In other words, for the loaded reverse travel, the angle of the boom 32 is controlled in proportion to the travel distance as described above. Specifically, as shown in Table 2, the bucket angle is set in accordance with the boom angle, and the bucket cylinder length is set in accordance with the bucket angle. The cylinder length of the bucket cylinder 35, which actuates the bucket 31, is thus controlled in accordance with the angle of the boom 32.

A bucket target position p_bk(t) at the travel distance L can thus be calculated by L/L1*(TP1_bk−sp_bk)+sp_bk. TP1_bk represents a bucket cylinder length at the target position TP1, and sp_bk represents the start position of the bucket 31 set in Step S6. In other words, the bucket target position tp_bk(t) can be obtained by multiplying a ratio of the travel distance L to the preset distance L1 and a difference between the target position and start position of the bucket 31, and adding the start position (the default value). The target setting unit 120 thus sets the bucket cylinder length (i.e., the bucket target position tp_bk(t) at the travel distance L) in proportion to the travel distance, the bucket cylinder length varying from a bucket cylinder length at the start of the movement in the loaded reverse traveling state to a bucket cylinder length where the bucket is to reach the tilting position when the travel distance of the wheel loader reaches the distance L1. In other words, the target setting unit 120 sets the bucket cylinder length in accordance with the boom angle to maintain the bucket 31 at the tilting position.

Calculation of Deviation

Next, the working equipment controlling unit 140 of the working equipment controller 10 calculates a deviation between an actual boom angle detected by the boom angle sensor 44 and the target position and a deviation between an actual bucket cylinder length detected based on the detection value of the bucket angle sensor 45 and the target position (Step S25). Specifically, a boom target deviation angle Δbm is calculated by boom target position tp_bm(t)−actual boom angle BmAngle, and a bucket target deviation length Δbk is calculated by bucket target position tp_bk(t)−actual bucket cylinder length BkLength.

Calculation of Boom Lever Operation Command

After Step S25, the working equipment controlling unit 140 of the working equipment controller 10 calculates a boom lever operation command cmd_bm (Step S26). The boom lever operation command cmd_bm, which specifies the flow rate of the hydraulic oil in each of the solenoid proportional pressure control valves 26, 27 in a range from −100% to +100%, is calculated by adding an auto-boom command based on the boom target deviation angle Δbm calculated in Step S25 and a boom lever command BmLever inputted when the operator operates the boom lever 41. The auto-boom command is calculated by a function interp (Δbm, BmCmdFlow, DeltaBmAngle) for obtaining a target flow rate corresponding to the boom target deviation angle Δbm with reference to a boom flow rate table BmCmdFlow defining a relationship between the boom deviation angle and the target flow rate shown in FIG. 14. When the boom lever 41 is manually operated, the auto-boom command (%) is added with the boom lever command.

Figure 14:
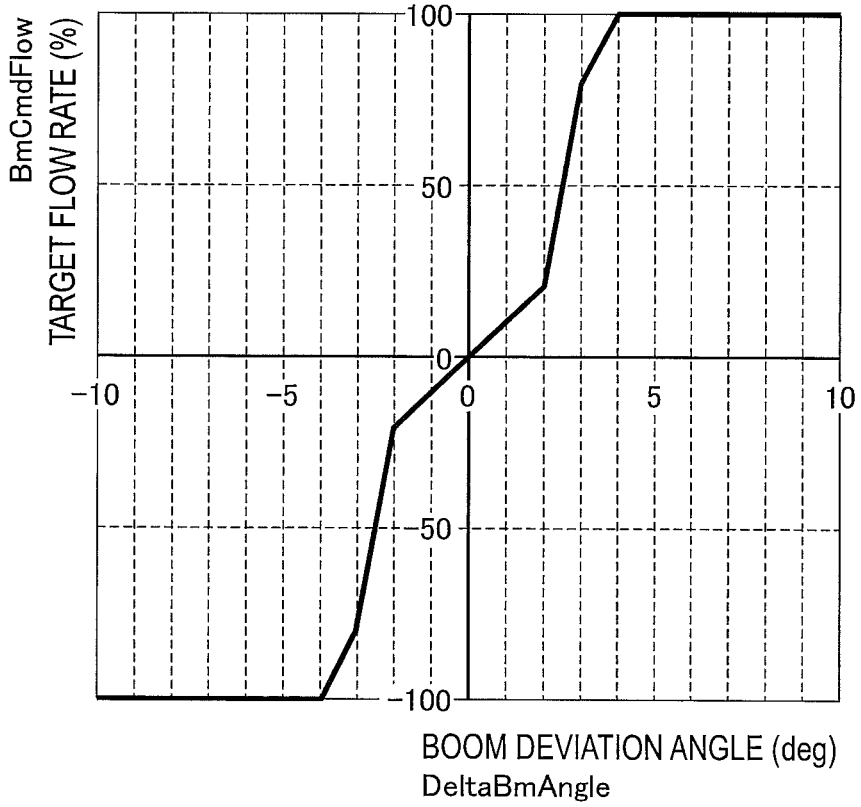
FIG. 14 is a graph showing a relationship between a boom deviation angle and a target flow rate according to the first exemplary embodiment.

As shown in FIG. 14, when the boom deviation angle is small (e.g., −2 to 2 degrees), the auto-boom command specifies a small target flow rate such as approximately−20 to +20%, and thus the movement speed of the boom 32 becomes slow. In this case, the operator may operate the boom lever 41 to increase the value of the target flow rate and, consequently, to increase the movement speed of the boom 32.

Calculation of Bucket Lever Operation Command

After Step S26, the working equipment controlling unit 140 of the working equipment controller 10 calculates a bucket lever operation command cmd_bk (Step S27). The bucket lever operation command cmd_bk, which specifies the flow rate of the hydraulic oil in each of the solenoid proportional pressure control valves 24, 25 in a range from −100% to +100%, is calculated by adding an auto-bucket command based on the bucket target deviation length Δbk calculated in Step S25 and a bucket lever command BkLever inputted when the operator operates the bucket lever 42.

Figure 15:
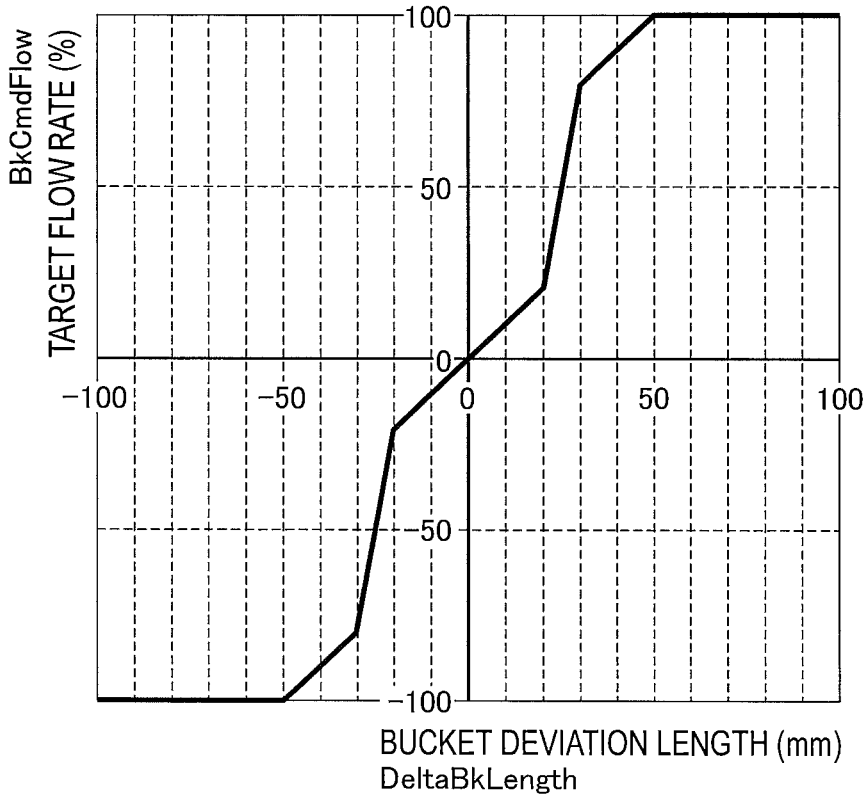
FIG. 15 is a graph showing a relationship between a bucket deviation length and the target flow rate according to the first exemplary embodiment.

The auto-bucket command is calculated by a function interp (Δbk, BkCmdFlow, DeltaBmLength) for obtaining a target flow rate corresponding to the bucket target deviation length Δbk with reference to a bucket flow rate table BkCmdFlow defining a relationship between the bucket deviation length and the target flow rate shown in FIG. 15. When the bucket lever 42 is manually operated, the auto-bucket command (%) is added with the bucket lever command. As shown in FIG. 15, when the bucket deviation length is small (e.g., −20 to +20 mm), the auto-bucket command also specifies a small target flow rate such as approximately −20 to +20%, and thus the movement speed of the bucket 31 becomes slow. In this case, the operator may operate the bucket lever 42 to increase the value of the target flow rate and, consequently, to increase the movement speed of the bucket 31.

The boom lever operation command cmd_bm and the bucket lever operation command cmd_bk calculated in Steps S26, S27 are inputted from the working equipment controlling unit 140 to the solenoid proportional pressure control valves 24 to 27 to control the action of each of the bucket operation valve 22 and the boom operation valve 23 so that the bucket cylinder 35 and the boom cylinder 36 actuate the working equipment 3.

Referring back to FIG. 6, the working equipment controller 10 again performs the process from Step S5 after Step S27. When the loaded reverse travel still continues, the determination results are NO (i.e., the loaded reverse travel detection is already ON) in Step S5, NO in each of Steps S7, S9, NO in Step S11, and "2" in Step S12. Consequently, the loaded reverse travel control shown in FIG. 10 is repeated.

It should be noted that the working equipment 3 is to be moved to the target position TP1 when the travel distance reaches L1 as shown in FIG. 7 during the loaded reverse travel, but the working equipment 3 may reach the target position TP1 before the travel distance reaches L1 when a value corresponding to the lever operation by the operator is added. When the working equipment 3 reaches the target position TP1, the deviation calculated in Step S25 becomes zero, and the working equipment 3 is maintained at the target position TP1.

However, when the travel speed is increased much more than usual by the accelerator operation, which is performed by the operator as well as the steering operation, a supply flow rate of the hydraulic oil to the working equipment may fail to meet the increase in the travel speed and, consequently, the travel distance may reach the distance L1 before the completion of the movement of the working equipment 3. In this case, only the working equipment 3 is to be moved after the completion of the travel of the wheel loader 1.

STAGE=3: Loaded Forward Travel Control

Figure 11:
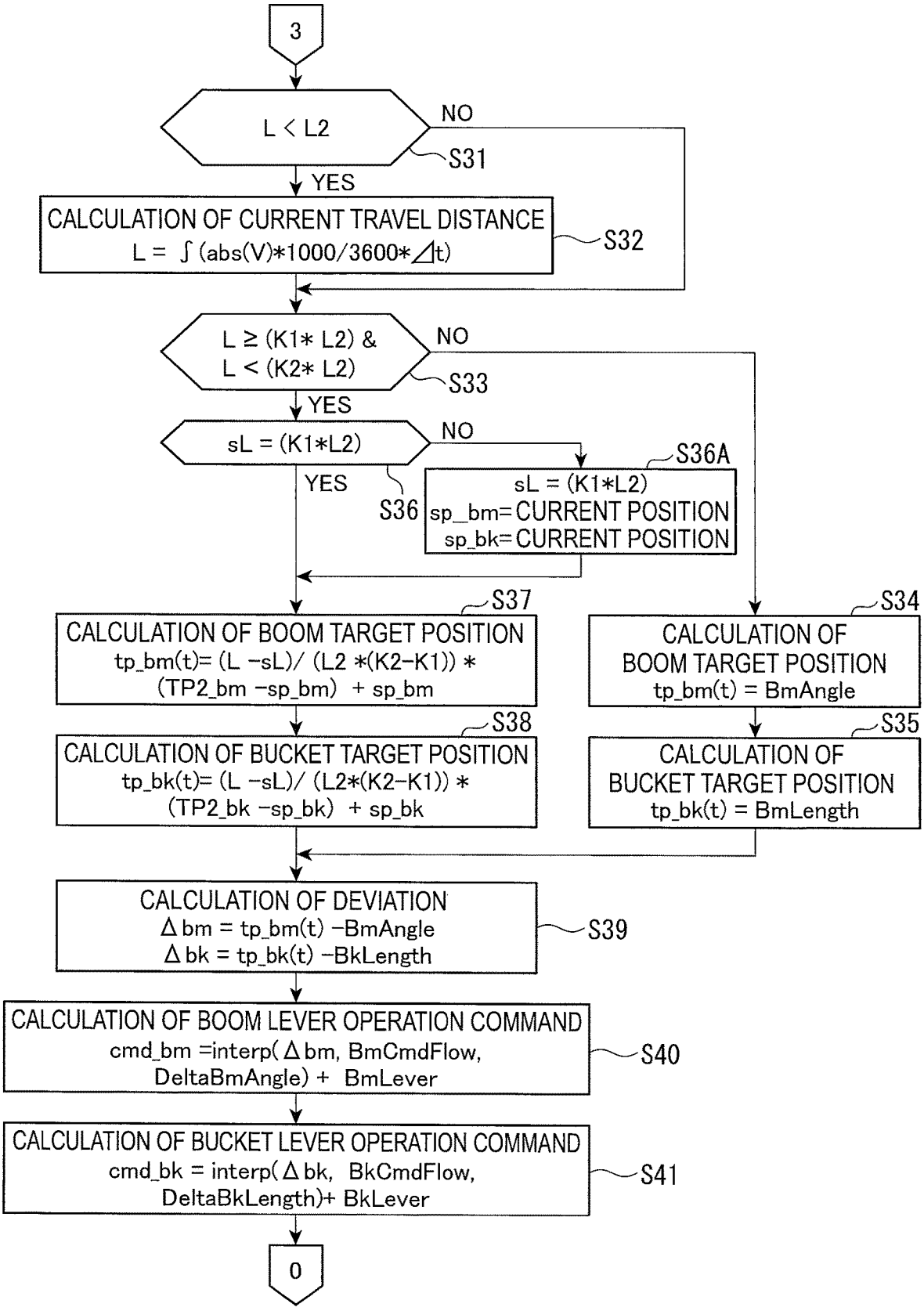
FIG. 11 is a flow chart showing a working equipment controlling process in the loaded forward traveling state according to the first exemplary embodiment.

FIG. 11 is a process flow of the loaded forward travel control. A part of the process shown in FIG. 11 is identical to that of the process of the loaded reverse travel control shown in FIG. 10, and thus description thereof is simplified.

The working equipment controller 10 determines whether or not the travel distance L obtained by the travel distance detecting unit 130 is less than the preset value L2 (Step S31).

When the determination result by the working equipment controller 10 is "YES" in Step S31, the travel distance detecting unit 130 calculates the current travel distance in the same manner as in Step S22 (Step S32).

When the determination result is "NO" in Step S31 (i.e., the travel distance has already reached the distance L2), the working equipment controller 10 skips the calculation of the current travel distance L in Step S32.

After Step S32 or when the determination result is "NO" in Step S31, the working equipment controller 10 determines whether or not the travel distance L is equal to or more than K1×L2 but less than K2×L2 (Step S33). When the travel distance L is less than K1×L2, the determination result by the working equipment controller 10 is NO in Step S33. For instance, when a distance coefficient K1 is 0.5 and the travel distance L1 does not reach a half of the preset distance L2, the determination result by the working equipment controller 10 is NO in Step S33.

When the determination result is NO in Step S33, the target setting unit 120 of the working equipment controller 10 assigns the actual boom angle BmAngle to the boom target position tp_bm(t) (Step S34), and assigns the actual bucket cylinder length BkLength to the bucket target position tp_bk(t) (Step S35). In other words, the target setting unit 120 sets each of the boom target position and the bucket target position at the current position.

Therefore, in a deviation calculating process (Step S39), which is identical to the process of Step S25, the boom target deviation angle Δbm calculated by boom target position tp_bm(t)−actual boom angle BmAngle and the bucket target deviation length Δbk calculated by bucket target position tp_bk(t)−actual bucket cylinder length BkLength b each become zero.

As a result, in a boom lever operation command calculating process (Step S40) and a bucket lever operation command calculating process (Step S41), which are respectively identical to the processes of Steps S26, S27, the auto-boom command and the auto-bucket command each specify a flow rate of 0% in accordance with the deviation of zero. A flow rate corresponding to the boom lever command or the bucket lever command is thus calculated as the operation command only when the boom lever 41 or bucket lever 42 is manually operated.

Consequently, when the travel distance L of the wheel loader 1 is less than K1×L2, the working equipment 3 is maintained at TP1 according to the automatic control by the working equipment controller 10, but may be moved in accordance with a manual operation by the operator.

When the determination result is "YES" in Step S33 (i.e., the travel distance L is K1×L2 or more but less than K2×L2), the working equipment controller 10 determines whether or not the start-time distance sL is set at K1×L2 (Step S36). When the determination result is "NO" in Step S36, the working equipment controller 10 sets: the start-time distance sL at K1×L2 (i.e., the first interim distance); sp_bm at the current boom angle (i.e., a boom angle at the time when the first interim distance is reached); and sp_bk at the current bucket cylinder length (i.e., a bucket cylinder length when the first interim distance is reached) (Step S36A). In other words, when performing the determining process of Step S36 for the first time in the process flow of the loaded forward travel control shown in FIG. 11, the working equipment controller 10 sets the start-time distance sL at K1×L2 in Step S36A. Otherwise, since sL has already been set at K1×L2, the determination result is "NO" in Step S36, and the flow proceeds to Step S37. The working equipment controller 10 thus performs the process of Step S36A only once. As shown in FIG. 8, when the travel distance L is=K1×L2, the working equipment 3 is normally maintained at the target position TP1, but may not be positioned at TP1 in the case where the operator manually operates the working equipment 3. Accordingly, in Step S36A, sp_bm and sp_bk are respectively set at the boom angle and the bucket cylinder length at the time when the travel distance L reaches the first interim distance (K1×L2).

Subsequently, the target setting unit 120 of the working equipment controller 10 calculates the boom target position as in Step S23 (Step S37). During the loaded forward travel from a spot of K1×L2 to a spot of K2×L2, the angle of the boom 32 is controlled in proportion to the travel distance as shown in FIG. 8. The boom target position tp_bm(t) at the travel distance L can thus be calculated by (L−sL)/(L2*(K2−K1))*(TP2_bm−sp_bm)+sp_bm. TP2_bm represents the boom angle at the target position TP2, and sp_bm represents the start position for a lifting control of the boom 32 determined in Step S36A. L−sL represents a travel distance from the spot of K1×L2 (the first interim distance), and (L2*(K2−K1)) represents a distance from the spot of K1×L2 to the spot of K2×L2 (the second interim distance). In other words, the boom target position tp_bm(t) can be obtained by multiplying a ratio (L−sL) of the travel distance from the spot of K1×L2 relative to the distance (L2*(K2−K1)) defined from the spot of K1×L2 to the spot of K2×L2 and a difference (TP2_bm−sp_bm) between the target position and start position of the boom 32, and adding the start position (sp_bm) (the default value). Consequently, in the case where the boom angle sp_bm at the time when the travel distance L is=K1×L2 is smaller than the target speed TP1, a variation of the boom angle relative to the travel distance becomes large as compared with the variation shown by the graph of FIG. 8. In contrast, in the case where the boom angle sp_bm at the time when the travel distance L is=K1×L2 is larger than the target speed TP1, a variation of the boom angle relative to the travel distance becomes small as compared with the variation shown by the graph of FIG. 8.

Subsequently, the target setting unit 120 of the working equipment controller 10 calculates the bucket target position as in Step S24 (Step S38). Specifically, the bucket target position tp_bk(t) at the travel distance L can be calculated by (L−sL)/(L2*(K2−K1))*(TP2_bk−sp_bk)+sp_bk.

In other words, when the travel distance is the first interim distance or more but less than the second interim distance, the target setting unit 120 sets the boom angle (i.e., a boom target position for the loaded forward traveling state) in proportion to the travel distance, the boom angle varying from a boom angle at the time when the travel distance reaches the first interim distance to a boom angle where the boom 32 is to reach the preset lifted positioner position when the travel distance reaches the second interim distance. Similarly, the target setting unit 120 sets the bucket cylinder length (i.e., a bucket target position for the loaded forward traveling state) in proportion to the travel distance, the bucket cylinder length varying from a bucket cylinder length at the time when the travel distance reaches the first interim distance to a bucket cylinder length where the bucket 31 is to reach the tilting position when the travel distance reaches the second interim distance. In other words, the target setting unit 120 sets the bucket cylinder length in accordance with the boom angle to maintain the bucket 31 at the tilting position.

After Step S35 or Step S38, the working equipment controlling unit 140 of the working equipment controller 10 calculates a deviation between each of the actual boom angle and bucket cylinder length and the target position as in Step S25 (Step S39).

Subsequently, after Step S39, the working equipment controlling unit 140 of the working equipment controller 10 calculates the boom lever operation command cmd_bm (Step S40) and the bucket lever operation command cmd_bk (Step S41). The process of Step S40 and the process of Step S41 are respectively identical to those of Step S26, Step S27, and thus description thereof is omitted.

The boom lever operation command cmd_bm and the bucket lever operation command cmd_bk calculated in Steps S40, S41 are inputted from the working equipment controlling unit 140 to the solenoid proportional pressure control valves 24 to 27 to control the action of each of the bucket operation valve 22 and the boom operation valve 23 so that the bucket cylinder 35 and the boom cylinder 36 actuate the working equipment 3.

Referring back to FIG. 6, the working equipment controller 10 again performs the process from Step S5 after Step S41. When the loaded forward travel still continues, the determination results are NO (i.e., the loaded forward travel detection is already ON) in Step S7, NO in each of Steps S5, S9, NO in Step S11, and "3" in Step S12. Consequently, the loaded reverse travel control shown in FIG. 11 is repeated.

It should be noted that, in the loaded forward travel control, the working equipment 3 is controlled to reach the target position TP2 when the travel distance of the wheel loader 1 reaches K2×L2 as shown in FIG. 8. After the working equipment 3 reaches the target position TP2, L is determined to be K2×L2 or more in Step S33 (the determination result is "NO"), so that the processes of Steps S34, S35 are performed and the deviation is determined to be "0" in Step S39 as described above. The working equipment 3 is thus maintained at the target position TP2. When the operator manually operates the working equipment 3, the working equipment 3 may be moved to and maintained at any position in accordance with the manual operation.

STAGE=4: Unloaded Reverse Travel Control

Figure 12:
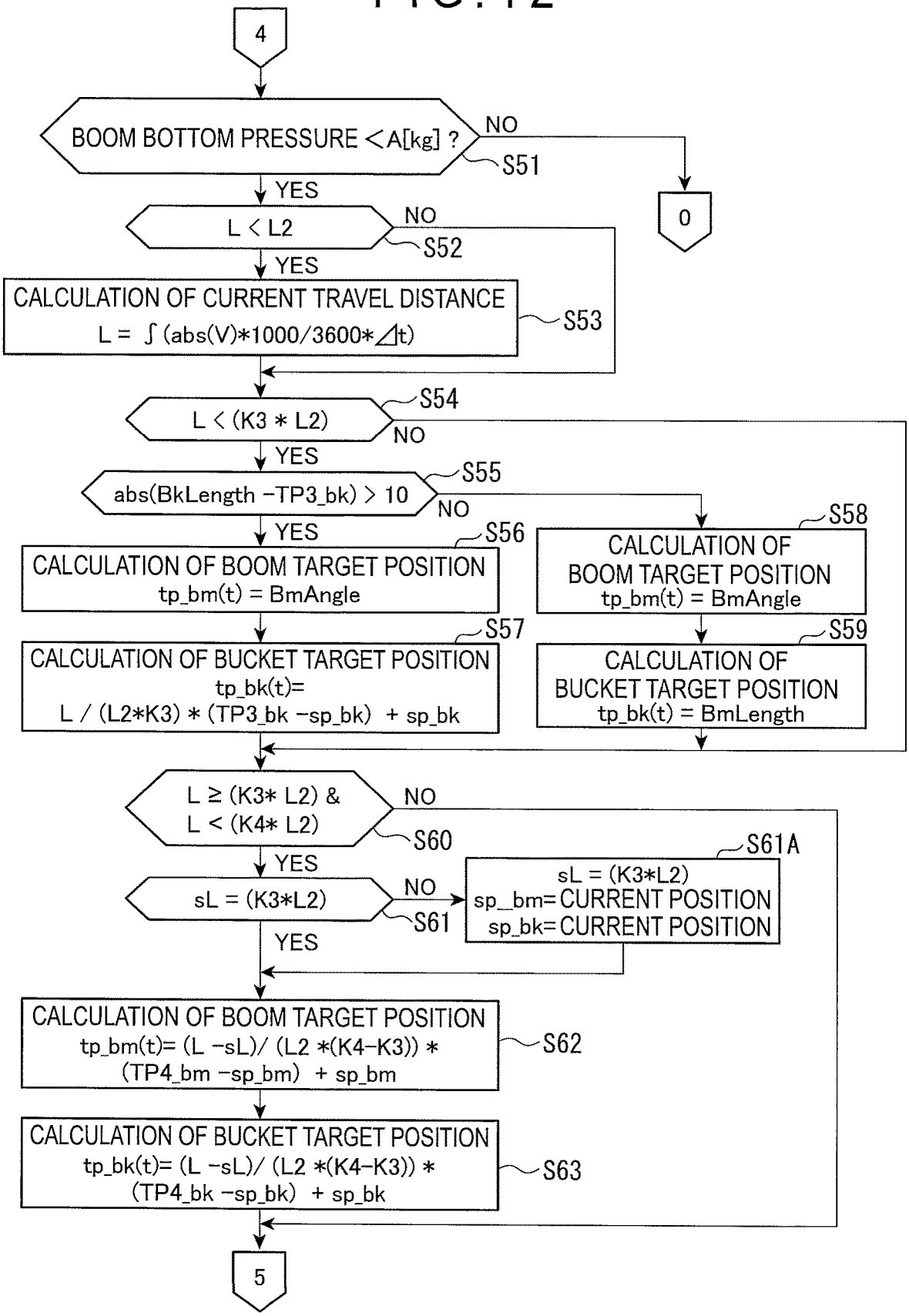
FIG. 12 is a flow chart showing a working equipment controlling process in the unloaded reverse traveling state according to the first exemplary embodiment.
Figure 13:
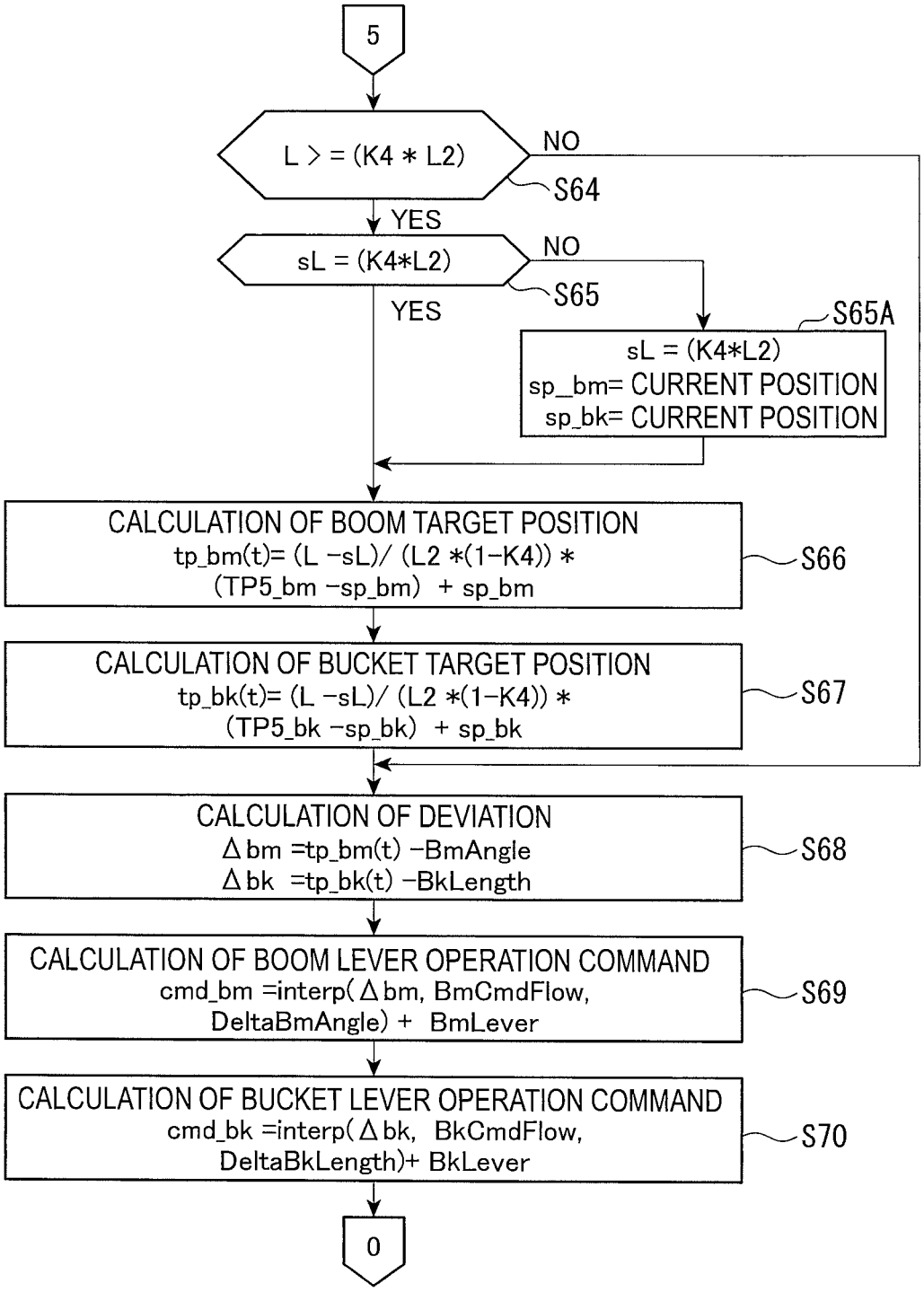
FIG. 13 is a flow chart showing the working equipment controlling process in the unloaded reverse traveling state according to the first exemplary embodiment.

FIGS. 12 and 13 show a process flow of the unloaded reverse travel control. A part of the process shown in FIGS. 12 and 13 is identical to that of the process shown in FIGS. 10 and 11, and thus description thereof is simplified.

The working equipment controller 10 checks whether or not the wheel loader 1 is "Unloaded" by comparison between the boom-bottom pressure and a preset value A(kg) (Step S51). When the boom-bottom pressure is not less than the preset value A and, consequently, the determination result is NO (the loaded state) in Step S51, the working equipment controller 10 completes the unloaded reverse travel control and the flow returns to the process shown in FIG. 6. This results in preventing the boom 32 from being controlled to be lowered in the loaded state.

When the determination result is YES in Step S51, the working equipment controller 10 determines whether or not the travel distance L obtained by the travel distance detecting unit 130 is less than the preset value L2 (Step S52).

When the determination result by the working equipment controller 10 is "YES" in Step S52, the travel distance detecting unit 130 calculates the current travel distance L in the same manner as in Steps S22, S32 (Step S53).

When the determination result is "NO" in Step S52 (i.e., the travel distance has already reached the distance L2), the working equipment controller 10 skips the calculation of the current travel distance L in Step S53.

After Step S52 or when the determination result is "NO" in Step S52, the working equipment controller 10 determines whether or not the travel distance L is less than K3×L2 (the third interim position) (Step S54).

For instance, when K3 is 0.2 and the travel distance L does not reach 20% of the preset distance L2, the determination result by the working equipment controller 10 is YES in Step S54.

When the determination result is YES in Step S54, the target setting unit 120 of the working equipment controller 10 determines whether or not a deviation length between an absolute value of the actual bucket cylinder length BkLength and a bucket target position TP3_bk exceeds a preset value (e.g., 10 mm) (Step S55). As shown in Table 1, at the working equipment target TP3 for the unloaded reverse travel control, the boom 32 is not operated and only the bucket 31 is moved to the positioner position. The bucket 31 is positioned not at the positioner position but at the loading position immediately after the completion of loading, the determination result by the working equipment controller 10 is YES in Step S55.

When the determination result is YES in Step S55, the target setting unit 120 of the working equipment controller 10 calculates the boom target position (Step S56) and calculates the bucket target position (Step S57).

Since the boom 32 is not operated, the target setting unit 120 assigns the actual boom angle BmAngle to the boom target position tp_bm(t) in Step S56 (Step S56).

Further, the bucket target position is calculated by tp_bk (t)=L/(K3*L2)*(TP3_bk−sp_bk)+sp_bk as in Step S24 to move the bucket 31 from the loading position to the positioner position while the wheel loader 1 is moved to a spot of K3×L2 (Step S57). In other words, the target setting unit 120 sets the bucket cylinder length in proportion to the travel distance, the bucket cylinder length varying from a bucket cylinder length at the start of the movement in the unloaded reverse traveling state to a bucket cylinder length where the bucket 31 is to reach a preset initial position (the positioner position in the first exemplary embodiment) when the travel distance of the wheel loader 1 reaches the third interim distance.

When the target setting unit 120 of the working equipment controller 10 determines that the deviation length between the absolute value of the actual bucket cylinder length BkLength and the bucket target position TP3_bk falls below 10 mm, the determination result is NO in Step S55. In this case, the bucket 31 is supposed to almost reach the positioner position, so that it is not necessary for the working equipment controller 10 to further move the bucket 31. Therefore, the target setting unit 120 assigns the actual boom angle BmAngle to the boom target position tp_bm(t) (Step S58) and assigns the actual bucket cylinder length BkLength to the bucket target position tp_bk(t) (Step S59) as in Steps S34, S35.

When the travel distance L does not reach K3×L2, the determination result by the working equipment controller 10 is NO in each of Steps S60, S64 as described later. The working equipment controller 10 thus performs the deviation calculating process (Step S68), the boom lever operation command calculating process (Step S69) and the bucket lever operation command calculating process (Step S70) as in Steps S25 to S27 and Steps S39 to S41.

Consequently, until the travel distance L reaches K3×L2, the boom 32 is maintained at the lifted positioner position, and the bucket 31 is moved to and maintained at the positioner position.

When the travel distance L of the wheel loader 1 reaches K3×L2 (the third interim distance) or more but less than K4×L2 (the fourth interim position), the determination result by the working equipment controller 10 turns NO in each of Steps S54, S64 and YES in Step S60.

When the determination result is "YES" in Step S60, the working equipment controller 10 determines whether or not the start-time distance sL is set at K3×L2 (Step S61). When the determination result is "NO" in Step S61, the working equipment controller 10 sets the start-time distance sL at K3×L2, sp_bm at the current boom angle, and sp_bk at the current bucket cylinder length (Step S61A). The working equipment controller 10 thus performs the process of Step S61A only once in the same manner as Step S36A.

Subsequently, the working equipment controller 10 calculates the boom target position as in Step S37 (Step S62). During the unloaded reverse travel from the spot of K3×L2 to a spot of K4×L2, the angle of the boom 32 is controlled to be reduced in proportion to the travel distance as shown in FIG. 9. The boom target position tp_bm(t) at the travel distance L can thus be calculated by (L−sL)/(L2*(K4−K3))*(TP4_bm−sp_bm)+sp_bm. TP4_bm represents a boom angle at the target position TP4, which is set at zero degrees (horizontal). sp_bm represents a start position for the control of reducing the angle of the boom 32 set in Step S61A. The boom angle is maintained at the lifted positioner position until L reaches K3×L2 unless the operator manually operates the boom 32, so that sp_bm is set at the lifted positioner position. L−sL represents a travel distance from the spot of K3×L2, and (L2*(K4−K3)) represents a distance from the spot of K3×L2 to the spot of K4×L2. In other words, the boom target position tp_bm(t) can be obtained by multiplying a ratio of the travel distance from the spot of K3×L2 relative to a distance from the spot of K3×L2 to the spot of K4×L2 and a difference between the target position and control start position of the boom 32, and adding the start position (the default value). The target setting unit 120 thus sets the boom angle (i.e., a target position of the boom 32 for the unloaded reverse traveling state) in proportion to the travel distance, the boom angle varying from a boom angle at the time when the travel distance reaches the third interim distance to a boom angle at which the boom 32 is to get horizontal when the travel distance reaches the fourth interim distance.

Subsequently, the working equipment controller 10 calculates the bucket target position as in Step S38 (Step S63). Specifically, the bucket target position tp_bk(t) at the travel distance L can be calculated by (L−sL)/(L2*(K4−K3))*(TP4_bk−sp_bk)+sp_bk. The target setting unit 120 thus sets a bucket cylinder length where the bucket 31 is maintained at the preset initial position (the positioner position in the first exemplary embodiment), the bucket cylinder length defining the target position of the bucket 31 for the unloaded reverse traveling state.

After Step S63, the working equipment controller 10 performs the above processes of Steps S68 to S70.

When the travel distance L of the wheel loader 1 reaches K4×L2 (the fourth interim distance) or more, the determination result by the working equipment controller 10 turns NO in each of Steps S54, S60 and YES in Step S64.

When the determination result is "YES" in Step S64, the working equipment controller 10 determines whether or not the start-time distance sL is set at K4×L2 as in Step S61 (Step S65). When the determination result is "NO" in Step S65, the working equipment controller 10 sets the start-time distance sL at K4×L2, sp_bm at the current boom angle, and sp_bk at the current bucket cylinder length (Step S65A). The working equipment controller 10 thus performs the process of Step S65A only once in the same manner as Steps S36A, S61A.

Subsequently, the working equipment controller 10 calculates the boom target position as in Step S62 (Step S66). During the unloaded reverse travel from the spot of K4×L2 to a spot of L2, the angle of the boom 32 is controlled to be moderately reduced in proportion to the travel distance as shown in FIG. 9. The boom target position tp_bm(t) at the travel distance L can thus be calculated by (L−sL)/(L2*(1−K4))*(TP5_bm−sp_bm)+sp_bm. TP5_bm represents a boom angle at the target position TP5, which is set at a lowered positioner position by the operator. sp_bm represents the control start position of the boom 32 set in Step S65A, and is the target value TP4 as long as the automatic control is enabled. L−sL represents a travel distance from the spot of K4×L2, and (L2*(1−K4)) represents a distance from the spot of K4×L2 to the spot of L2. In other words, the boom target position tp_bm(t) can be obtained by multiplying a ratio of the travel distance from the spot of K4×L2 relative to a distance from the spot of K4×L2 to the spot of L2 and a difference between the target position and control start position of the boom 32, and adding the control start position (the default value). The target setting unit 120 thus sets the boom angle (i.e., a target position of the boom 32 for the unloaded reverse traveling state) in proportion to the travel distance, the boom angle varying from a boom angle at the time when the travel distance reaches the fourth interim distance to a boom angle at which the boom 32 is to get horizontal when the travel distance reaches the distance L2.

Subsequently, the working equipment controller 10 calculates the bucket target position as in Step S63 (Step S67). Specifically, the bucket target position tp_bk(t) at the travel distance L can be calculated by (L−sL)/(L2*(1−K4))*(TP5_bk−sp_bk)+sp_bk. The target setting unit 120 thus sets a bucket cylinder length where the bucket 31 is maintained at the preset initial position (the positioner position in the first exemplary embodiment), the bucket cylinder length defining the target position of the bucket 31 for the unloaded reverse traveling state.

After Step S67, the working equipment controller 10 performs the above processes of Steps S68 to S70.

The V-shape operation can be repeated by repeating the above control process.

Advantage of First Exemplary Embodiment

In the above first exemplary embodiment, the bucket 31 and the boom 32 of the working equipment 3 are automatically moved to the respective target positions in accordance with the travel distance of the wheel loader 1 under the control by the working equipment controller 10 during the loaded reverse travel, the loaded forward travel and the unloaded reverse travel. The first exemplary embodiment thus eliminates a necessity for an operator to simultaneously operate the boom lever 41 and the bucket lever 42 along with the steering and/or the accelerator. The operator is thus merely required to mainly operate the steering, accelerator and brake. Consequently, even an inexperienced operator can easily operate the wheel loader 1.

Further, the working equipment 3 is automatically moved to an appropriate position during the travel of the wheel loader 1, which results in an improved operating efficiency and a fuel-saving driving as compared with an instance where the working equipment 3 is moved after the travel of the wheel loader 1.

In the loaded reverse travel, the loaded forward travel and the unloaded reverse travel, the working equipment controller 10 performs the semi-automatic control, so that an operator can manually operate the boom lever 41 and the bucket lever 42 to interrupt the automatic control of the working equipment 3. The intention of the operator can be reflected in the movement of the working equipment 3. For instance, the working equipment 3 may be moved at a high speed to improve the operability.

Second Exemplary Embodiment

Next, a second exemplary embodiment of the invention will be explained hereinbelow. The wheel loader 1 of the second exemplary embodiment is different from the wheel loader 1 of the first exemplary embodiment in that: a control method at the time of interruption by a manual operation by an operator is changed; a traveling unit is controlled in addition to the control of the working equipment 3; and a travel route of the wheel loader 1 in the V-shape operation is changed. Accordingly, structures and control steps which are the same as those of the first exemplary embodiment will be assigned with the same reference signs and explanation thereof will be simplified or omitted.

As shown in FIG. 16, a drive mechanism for the working equipment 3 of the second exemplary embodiment is configured so that a mechanism (traveling unit) for allowing the wheel loader 1 to travel can transmit an output from the PTO 12 through a modulation clutch (Mod/C: hereinafter occasionally abbreviated as "clutch") 13 to a torque converter (T/C) 15 so as to control the traveling unit (i.e., a movement speed of the wheel loader 1).

The modulation clutch 13 of the second exemplary embodiment is configured not only to be directly connected (engagement degree of 100%) and separated (engagement degree of 0%) but also to be slid (i.e., a clutch capable of adjusting the engagement degree to an intermediate value ranging from 100% to 0% so as to regulate the transmission amount of an output from the engine.) As the engagement degree of the modulation clutch 13 is lowered, the maximum value of the torque to be transmitted to the transmission of the output from the engine is decreased. Specifically, when the output from the engine is the same, a travel driving force outputted from the wheel (hereinafter abbreviated as "driving force") is to be decreased. There are some methods for controlling the engagement degree of the clutch 13. For example, a method for determining the engagement degree of the clutch 13 by control hydraulic pressure applied to the clutch 13 is applicable.

The arrangement of the working equipment controller 10 and equipment connected to the working equipment controller 10 in the second exemplary embodiment are the same as those of the first exemplary embodiment shown in FIG. 3, and therefore the explanation thereof will be omitted.

V-Shape Operation Processes

Figure 5:
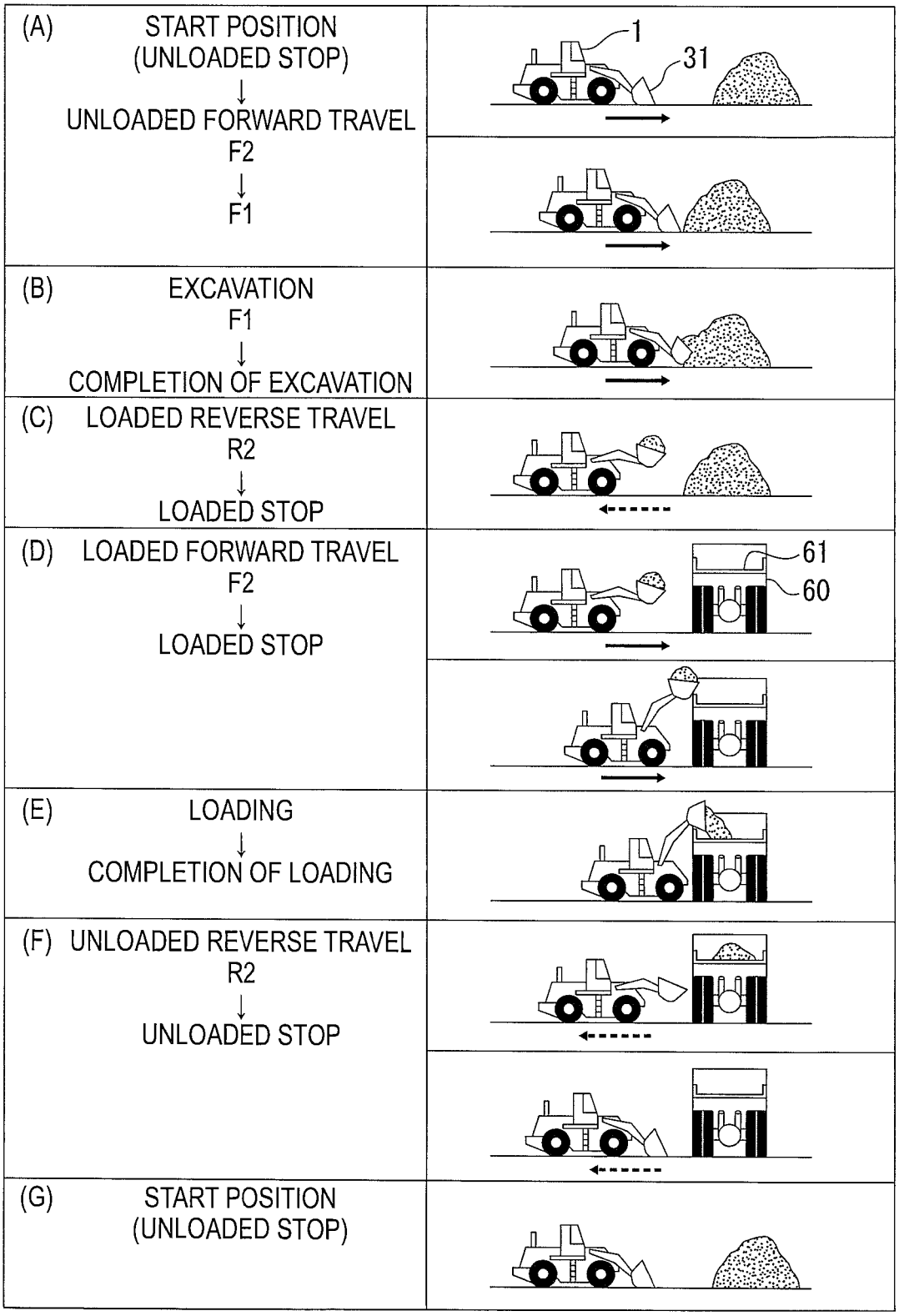

In the V-shape operation by the wheel loader 1 according to the second exemplary embodiment, processes including (A) unloaded forward travel, (B) excavation, (C) loaded reverse travel, (D) loaded forward travel, (E) loading, (F) unloaded reverse travel and (G) start position shown in FIG. 5 according to the first exemplary embodiment are repeated.

Specifically, as shown in FIG. 17, the travel route of the wheel loader 1 is different from that of the first exemplary embodiment. Accordingly, the approach length setting unit 432 (see FIG. 3) of the second exemplary embodiment sets a travel distance L1 for the loaded reverse traveling state, a travel distance L2 for the loaded forward traveling state, and a travel distance L3 for the unloaded reverse traveling state.

In the V-shape operation of the second exemplary embodiment, as shown in FIG. 17, the process of unloaded forward travel in which the wheel loader 1 travels in a straight line from the unloaded stop position (start position) to the bank is the same as in the first exemplary embodiment. In the loaded reverse traveling state in which the wheel loader 1 is reversed with the soil and sand being loaded in the bucket 31 after the completion of excavation of the soil and sand, an operator operates the steering to turn and reverse the wheel loader 1 for the distance L1. In the above manner, the operator operates the steering to direct the front surface of the wheel loader 1 to face the side surface of the dump truck 60.

Next, the operator drives the wheel loader 1 in the loaded state so that the wheel loader 1 travels in a straight line for the distance L2 and approaches the dump truck 60.

After loading the sand and soil from the bucket 31 onto the vessel 61, the operator operates the steering to turn and reverse the wheel loader 1 in the unloaded state for the distance L3 so that the wheel loader 1 is returned to the start position in which the front surface of the wheel loader 1 faces the bank.

The operator repeats the above processes to move the wheel loader 1 along a substantially V-shaped locus (V-shape operation) when the wheel loader 1 is moved from the loaded reverse traveling state to the loaded forward traveling state and from the unloaded reverse traveling state to the unloaded forward traveling state.

Additionally, the approach length setting unit 432 shown in FIG. 3 preliminarily sets the travel distances L1, L2 and L3. In the same manner as in the first exemplary embodiment, the travel distances L1 to L3 are set by inputting a ratio to the entire vehicle length of the wheel loader 1 on the monitor 43 by the operator. Default values of these L1 to L3 are L1=0.8 (80% of the entire vehicle length), L2=0.6 (60% of the entire vehicle length) and L3=0.7 (70% of the entire vehicle length), and each value may be inputted to fall in a range from 0.5 to 1.5.

The approach length setting unit 432 displays "0.8", "0.6" and "0.7" (the respective default values of the approach lengths L1, L2 and L3) on the monitor 43. When the operator changes these numerical values, the approach length setting unit 432 stores the inputted values as preset values and outputs the inputted values to the working equipment controller 10.

Semi-Automatic Control

Also in the second exemplary embodiment, when the semi-auto mode selection signal set by the semi-auto mode selecting unit 431 is ON in the V-shape operation, the semi-automatic control is performed during (C) the loaded reverse travel, (D) the loaded forward travel and (F) the unloaded reverse travel.

Description will be made on a process of the semi-automatic control performed by the working equipment controller 10 in the second exemplary embodiment.

When the process is started in response to an ON-operation by an engine key, the working equipment controller 10 performs the processes of Steps S1 to S3 shown in FIG. 18. Among Steps S1 to S13 shown in FIG. 18, steps other than Steps S6A, S8A and S10A are the same as those shown in FIG. 6 according to the first exemplary embodiment, and therefore the explanation thereof will be omitted.

Default Setting When Loaded Reverse Traveling State is Detected

When the determination result is "YES" in Step S5 (i.e., it is detected that the loaded reverse travel detection is changed from OFF to ON), the working equipment controller 10 sets the variable STAGE representing the operation stage at "2" and the variable L representing the travel distance at the default value "0". A variable sp_bm (a boom angle) and a variable sp_bk (a bucket cylinder length) representing the start position of the working equipment are each set at a value corresponding to the current position (Step S6A). In Step S6A, the working equipment controller 10 sets sp_bm at the current boom angle based on a detection value of the boom angle sensor 44 and sp_bk at the current bucket cylinder length based on a detection value of the bucket angle sensor 45. It should be noted that, though FIG. 6 represents "sp_bm=current position, sp_bk=current position", FIG. 18 collectively represents "sp_=current position" in which "sp_" correspond to "sp_bm, sp_bk".

In Step S6A, among the auto-boom commands to move the boom 32, a maximum value g of a variation of the auto-boom command to lower the boom 32 (i.e., a restriction to the lowering command g) per 10 ms is set at 0.6%

Default Setting at Loaded Forward Travel Detection

When the determination result is "YES" in Step S7 (i.e., it is detected that the loaded forward travel detection is turned ON), the working equipment controller 10 sets the variable STAGE representing the operation stage at "3", the variable L representing the travel distance at the default value "0", sp_bm at the current boom angle, sp_bk at the current bucket cylinder length and the restriction to the lowering command g at 0.6% (Step S8A).

Default Setting at Unloaded Reverse Travel Detection

When the determination result is "YES" in Step S9 (i.e., it is detected that the unloaded reverse travel detection is turned ON), the working equipment controller 10 sets the variable STAGE representing the operation stage at "4", the variable L representing the travel distance at the default value "0", sp_bm at the current boom angle, sp_bk at the current bucket cylinder length and the restriction to the lowering command g at 2.0% (Step S10A).

It should be noted that the control for the lowering command g at the loaded reverse travel detection and the loaded forward travel detection is 0.6%, which is smaller than the control for the lowering command g=2.0% at the unloaded reverse travel detection. In the loaded reverse traveling state and loaded forward traveling state, the control for lifting the boom 32 is performed. When the operator performs the operation for lowering the boom 32, the operator may perform a wrong operation, and therefore the maximum value g of the variation is set at a small value so that the speed at which the boom 32 is lowered is decreased.

Termination Condition Determination

After the variables are initialized in Steps S6A, S8A, S10A or when the determination result is NO in Step S9, the working equipment controller 10 determines whether or not termination conditions are satisfied (Step S11). The termination conditions are the same as those of the first exemplary embodiment.

When the termination conditions are satisfied, the determination result by the working equipment controller 10 is YES in Step S11. In this case, the working equipment controller 10 sets the variable STAGE at "1" meaning a stand-by state (Step S13). At this time, in the same manner as in the first exemplary embodiment, when any one of the conditions other than the termination condition 2 is satisfied, the working equipment controller 10 outputs the buzzer command to the monitor 43 to emit an abnormal termination beep (Step S13). The working equipment controller 10 then continues the process from Step S1.

Setting Information for Semi-Automatic Control

When the determination result is "NO" (i.e., none of the termination conditions is satisfied) in Step S11, the working equipment controller 10 checks the value of the variable STAGE representing the operation stage. The working equipment controller 10 performs: a loaded reverse travel control when STAGE=2; a loaded forward travel control when STAGE=3; and an unloaded reverse travel control when STAGE=4, as described later (Step S12).

It should be noted that, in the same manner as in the first exemplary embodiment, these controls are each independently based on a relationship between the travel distance of the wheel loader 1 and the target position of the working equipment 3, which depends on the operating state related to each of the controls. Tables 3 and 4 show examples of the target position of the working equipment 3, and FIGS. 19 to 24 show relationships between the travel distance and the target position determined based on Tables 3 and 4. It should be noted that parameters defined in Tables 3 and 4 are stored in the storage 150 of the working equipment controller 10.

In Table 3, "lifted positioner position" and "lowered positioner position" in a column of boom angle mean boom angles preset by the operator. "Positioner position" in a column of bucket cylinder length is set at a position where the bucket angle becomes zero degree when the boom 32 is lowered to bring the bucket 31 into contact with the ground.

TABLE 3

| Working Equipment Target | Boom Angle | Bucket Cylinder Length |
|---|---|---|
| Loaded Reverse (TP1) | Horizontal (0 deg) | See Table 4 |
| Loaded Forward (TP2) | When Lifted Positioner Position is set: Positioner Set Angle When Lifted Positioner Position is not set: TOP Angle - 3.5 deg | See Table 4 |
| Unloaded Reverse (TP3) | (Not Operated) | Bucket Horizontal Position |
| Unloaded Reverse (TP4) | Current Position - 3 deg | Positioner Position |
| Unloaded Reverse (TP5) | When Lowered Positioner Position is set: Positioner Set Angle When Lowered Positioner Position is not set: TOP Angle - 37 deg | Positioner Position |

TABLE 4

| | Bucket Cylinder Length | | |
|---|---|---|---|
| Boom Angle | High Lift | STD | Bucket Angle |
| −α11 | A11 | B11 | β11 |
| −α12 | A12 | B12 | β12 |
| 0 | A13 | B13 | β13 |
| α14 | A14 | B14 | β14 |
| α15 | A15 | B15 | β15 |
| α16 | A16 | B16 | β16 |

Relationship Between Travel Distance and Target Position of Working Equipment in Loaded Reverse Traveling State In the loaded reverse travel control, while the wheel loader 1 is reversed for the predetermined distance L1 from a position at the time of the completion of excavation, the working equipment 3 is controlled to be moved to a position TP1 by the working equipment controlling unit 140. As shown in FIG. 19, the working equipment controlling unit 140 gradually raises the boom 32 from the lowered positioner position at the excavation so that the boom angle reaches the target position TP1 (TP1_bm). As shown in FIG. 20, the working equipment controlling unit 140 controls the bucket 31 so that the bucket cylinder length reaches the target value TP1 (TP1_bk) at an early stage from the start of the movement of the bucket 31 and thereafter the bucket cylinder length is maintained at the target value TP1. As shown in Table 4, the target value TP1 (TP1_bk) of the bucket cylinder length is set in conjunction with the boom angle TP1 (TP1_bm), and set to allow the bucket 31 to be maintained at a lifted position to prevent the load in the bucket 31 from falling out irrespective of a change in the boom angle.

It should be noted that, in the second exemplary embodiment, when the boom 32 is in a horizontal state, the boom angle sensor 44 is set to output 0 degree.

In the loaded reverse travel control, since the wheel loader 1 is reversed while the steering is turned by the operator, the bucket 31 is moved to the lifted position at an early stage, and the boom 32 is set to be continuously moved to the horizontal position in proportion to the travel distance.

Relationship Between Travel Distance and Target Position of Working Equipment in Loaded Forward Traveling State In the loaded forward travel control, as shown in FIGS. 21 and 22, the boom 32 is maintained at a position where the boom angle reaches TP1_bm by the working equipment controlling unit 140 until the travel distance of the wheel loader 1 reaches the distance K1×L2 (a first interim distance), and the bucket 31 is moved while the bucket cylinder length is increased from TP1_bk to TP2_bk in proportion to the travel distance. Accordingly, the boom 32 is maintained at a position at a predefined height, and the bucket 31 is slightly moved toward the tilting position.

The boom 32 is moved in proportion to the travel distance by the working equipment controlling unit 140 until the boom angle reaches TP2_bm from TP1_bm before the travel distance of the wheel loader 1 is increased from the distance K1×L2 to the distance K2×L2 (a second interim distance), and the bucket 31 is maintained at a position where the bucket cylinder length reaches TP2_bk. Accordingly, the bucket 31 is maintained at the tilting position, and the boom 32 is moved to the target position TP2_bm. Herein, a default value of K1 and a default value of K2 are respectively, for instance, 0 and 0.9, Although K2 is a fixed value, K1 may be changed in a range from 0 to 0.3 by an operator or the like.

While the travel distance of the wheel loader 1 is increased from the distance K2×L2 to the distance L2, the boom angle and the bucket cylinder length are respectively maintained at TP2_bm and TP2_bk.

Herein, TP2 (TP2_bm, TP2_bk) are set in accordance with the lifted positioner position as shown in a column of boom angle in Tables 3 and 4. The lifted positioner position is determined by the operator in accordance with the level of the vessel 61 of the dump truck 6 where a load such as soil and sand is to be loaded from the wheel loader 1.

When the lifted positioner position is set, the TP2_bm is set at a positioner set angle corresponding to the lifted positioner position. When the lifted positioner position is not set, TP2_bm is set at a preset value, for example, a value lower than a TOP angle (the boom angle when the boom 32 is lifted to the maximum extent) for a preset angle (e.g., TOP angle −3.5 degree.) It should be noted that, the reason why the TP2_bm is set to be lower than the TOP angle is that the boom 32 slightly moves because of inertia even when an instruction to stop the boom 32 is issued in the case where the control to lift the boom 32 is performed. Accordingly, the preset angle may be set by obtaining a travel angle through experiments after the issuance of the instruction to stop the boom 32 in the wheel loader 1.

TP2_bk is set in accordance with the set boom angle TP2_bm based on Table 4, so that the bucket 31 is kept at the lifted position to prevent the load in the bucket 31 from falling out irrespective of a change in the boom angle.

In the loaded forward travel control of the second exemplary embodiment, the wheel loader 1 travels in a straight line toward the dump truck 60, and it is unnecessary for the operator to operate the steering to change the traveling direction of the wheel loader 1. Accordingly, the distance coefficient K1 may be set at 0 so as to lift the boom 32 just after the start of the loaded forward travel control. In contrast, when the distance coefficient K2 is set at 0.9 (i.e., fixed value), the working equipment 3 is moved to the lifted positioner position until the travel distance reaches K2×L2, and the working equipment 3 is maintained at the lifted positioner position while the travel distance is increased from the distance K2×L2 to the distance L2, thereby interference between the bucket 31 and the vessel 61 can be prevented.

Relationship Between Travel Distance and Target Position of Working Equipment in Unloaded Reverse Traveling State In the unloaded reverse travel control, as shown in FIGS. 23 and 24, the working equipment 3 is maintained at a position TP3 until the travel distance of the wheel loader 1 reaches a distance K3×L3 (a third interim distance), and is moved from the position TP3 to a position TP4 in proportion to the travel distance while the travel distance of the wheel loader 1 is increased from the distance K3×L3 to a distance K4×L3 (a fourth interim distance) by the working equipment controlling unit 140.

Further, the working equipment 3 is moved by the working equipment controlling unit 140 from the position TP4 to a position TP5 in proportion to the travel distance while the travel distance of the wheel loader 1 is increased from the distance K4×L3 to the distance L3. Herein, a default value of K3 and a default value of K4 are respectively, for instance, 0.4 and 0.5. The distance coefficient K3 can be changed in a range from 0.3 to 0.5 by an operator or the like. The distance coefficient K4 is fixed to a distance coefficient K3+0.1.

As shown in Table 3, the boom angle (TP3_bm) is "Not Operated", and the bucket cylinder length (TP3_bk) is a bucket horizontal position at TP3. Herein, without a manual operation, the boom angle is maintained at TP2_bm (lifted positioner position) until the completion of the loading from the completion of the loaded forward travel, so that the boom angle is still at TP2_bm at TP3_bm for the unloaded reverse travel control. As shown in FIG. 24, the working equipment controlling unit 140 moves the bucket 31 from a dump position at the time of the completion of the loading to the bucket horizontal position before the travel distance of the wheel loader 1 reaches the distance K3×L3 (the third interim distance) and then the working equipment controlling unit 140 maintains the bucket 31 at the bucket horizontal position until the travel distance of the wheel loader 1 reaches the distance K3×L3.

As shown in Table 3, the boom angle (TP4_bm) is a current position (TP3_bm)−3 degrees, and the bucket cylinder length (TP4_bk) is the positioner position at TP4. While the lowered positioner position is set, the boom angle (TP5_bm) is the positioner set angle, and while the lowered positioner position is not set, the boom angle (TP5_bm) is a predetermined value (e.g., 37 degrees) and the bucket cylinder length (TP5_bk) is the positioner position at TP5.

In the unloaded reverse travel control after loading, the working equipment 3 is maintained at the lifted positioner position and the bucket 31 is shifted from the dump position to the positioner position at an early stage until the travel distance of the wheel loader 1 reaches the distance K3×L3, thereby preventing interference between the bucket 31 and the vessel 61. While the travel distance of the wheel loader 1 is increased from the distance K3×L3 to the distance K4×L3, the boom 32 is slightly lowered by −3 degrees so that the operator perceives that the boom 32 starts to be lowered. While the travel distance of the wheel loader 1 is increased from the distance K4×L3 to the distance L3, the boom 32 is moved to the lowered positioner position.

In the unloaded reverse travel control, the operator operates the steering to turn and reverse the wheel loader 1 so that the wheel loader 1 is moved to the original unloaded stop position (i.e., start position).

Next, the controls to be selected in S12 in FIG. 18 will be described also with reference to the flow charts in FIGS. 25 to 29. It should be noted that, in the flow charts shown in FIGS. 25 to 29, the same processes (steps) as those in the first exemplary embodiment are assigned with the same reference signs and explanation thereof will be simplified.

STAGE=2: Loaded Reverse Travel Control

In the loaded reverse travel control, as shown in FIG. 25, in the same manner as in FIG. 10 according to the first exemplary embodiment, the working equipment controller 10 determines whether or not the travel distance L is less than the preset value L1 (i.e., performs a determination step S21), and the travel distance detecting unit 130 calculates the travel distance L (i.e., performs a calculating step S22).

Manual Operation Detection

The working equipment controller 10 determines whether or not the boom lever 41 and bucket lever 42 are manually operated (Step S121).

When the manual operation is not performed, the determination result is "NO" in Step S121. Accordingly, the working equipment controller 10 performs the boom target position calculating step (S23), the bucket target position calculating step (S24), the deviation calculating step (S25), the boom lever operation command calculating step (S26), and the bucket lever operation command calculating step (S27), in the same manner as in the first exemplary embodiment. When the manual operation is not performed, in Steps S26 and S27, BmLever=0, BkLever=0, and control is performed in response to an auto-boom command and an auto-bucket command based on the deviation calculated in Step S25.

In contrast, when the manual operation is performed, the determination result is "YES" in Step S121, and the working equipment controller 10 performs the start point correcting step (S122), and subsequently Steps S23 to S27.

Start Point Correction

The working equipment controller 10 performs the following processes in the start point correcting step S122. It should be noted that, in the start point correcting step S122, when the positions of the boom 32 and bucket 31 are manually moved, the target setting unit 120 estimates a new target position based on the current position after the manual operation, and a new relationship between the target position of the working equipment 3 and the travel distance of the wheel loader 1 (a new route of the working equipment 3) is set based on the new target position.

It should be noted that, even when the manual operation is performed, a new start point is obtained in Step S122 so that the target position can be calculated in each of Steps S23 and S24.

Hereinbelow, with reference to FIG. 30 showing a control example of the boom angle in the loaded reverse travel control, a calculating method of a new start point is explained.

In FIG. 30, SP1 is a previous start position (e.g., start position of the route before manual operation), and SP2 is a correction start position corrected through the manual operation. A spot A is a position at which the manual operation is started, and a spot B is a position at which the manual operation is completed. TP is a final target position, AP1 is a current position at the spot A (just before the manual operation), AP2 is a control target position at the spot A, BP1 is a current position at the spot B (just after the manual operation), BP2 is a control target position at the spot B, L1 is a target travel distance, D is a travel distance to the spot A, and L is a travel distance to the spot B. Accordingly, a remaining travel distance after the manual operation is obtained by L1−L.

As shown in FIG. 30, before the manual operation, the boom angle is controlled based on a route S1 connecting SP1 and TP. It should be noted that, the actual travel distance (angle) of the boom 32 is deviated from the route S1 as shown by the chain line S2 due to the delay in response of a supply flow rate of the hydraulic circuit to activate the boom 32 or the like. The delay amount can be calculated as a deviation ΔP between the AP2 and the AP1 at the spot A.

It is supposed that, while the wheel loader 1 travels from the spot A to the spot B, the boom lever 41 is operated, and the boom 32 travels to the BP1 at the spot B at which the travel distance of the wheel loader 1 is the distance L. At this time, since the delay of the supply flow rate of the hydraulic circuit or the like is constant (deviation ΔP), the control target position BP2 at the spot B can be obtained by BP1+ΔP.

With reference to FIG. 30, since the correction start position SP2 is located on a straight line connecting the control target position BP2 and the final target position TP, a first equation (TP−BP2)/(L1−L)=(TP−SP2)/L1 is satisifed, and a second equation SP2=(BP2×L1−TP×L)/(L1−L) is obtained by developing the first equation. Accordingly, a new route S3 connecting the correction start position SP2 and the final target position TP is set. Accordingly, when the start point is corrected in Step S122, the target setting unit 120 sets the correction start position SP2 at a boom start position sp_bm in Step S23 to calculate the boom target position (route S3).

The working equipment controlling unit 140 performs the deviation calculation (Step S25) and the boom lever operation command calculation (Step S26) based on the new boom target position.

Accordingly, the target route R1 of the boom 32 is located on the route S1 before reaching the spot A, changed by the manual operation between the spot A and the spot B, and set on a new target route S3 after reaching the spot B. The actual operation route R2 of the boom 32 is located on an actual operation route R2 corresponding to the target route S1 before reaching the spot A, changed by the manual operation between the spot A and the spot B, and becomes an operation route corresponding to the new target route S3 after reaching the spot B.

The above processes are performed every time the manual operation is performed. Further, although the explanation thereof is omitted, also when the bucket lever 42 is manually operated, the same processes are performed, and control is performed after obtaining the correction start position of the bucket cylinder length after the manual operation.

Boom Lever Operation Command Calculation & Bucket Lever Operation Command Calculation In the boom lever operation command calculating step (S26) and the bucket lever operation command calculating step (S27), the same processes as those in the first exemplary embodiment are performed. However, as shown in FIGS. 31 and 32, the setting of each of the boom flow rate table BmCmdFlow and the bucket flow rate table BkCmdFlow is changed.

Specifically, as shown in FIG. 31, according to the auto-boom command, in a predetermined range including 0 degree of the boom deviation angle (e.g., −1 to +1), the target flow rate is set at 0% so that hunting does not occur.

When the boom deviation angle is in a range from +1 degree to +4 degrees, the target flow rate varies in a range from 0% to 100%. When the boom deviation angle is +4 degrees or more, the target flow rate is set at 100% so that the lifting speed of the boom 32 is improved.

In contrast, when the boom deviation angle is in a range from −1 degree to −5 degrees, the target flow rate varies in a range from −35% to −70%. When the boom deviation angle is −5 degrees or less, the flow rate is maintained at −70%. Accordingly, the lowering speed of the boom 32 is adjusted to be lower than the lifting speed thereof.

As shown in FIG. 31, also according to the auto-bucket command, when the bucket deviation length is small (e.g., in a range from −5 to +5 mm), the target flow rate is set at 0% so that hunting does not occur.

When the bucket deviation is in a range from +5 mm to +50 mm, the target flow rate varies in a range from 0% to 100%. When the bucket deviation is +50 mm or more, the target flow rate is set at 100% so that the movement speed of the bucket 31 in the lifting direction is improved.

In contrast, when the bucket deviation is in a range from −5 mm to −50 mm, the target flow rate varies in a range from 0% to 100%. When the bucket deviation is −50 mm or less, the target flow rate is maintained at +100% so that the movement speed of the bucket 31 in the dump direction is improved.

The boom lever operation command cmd_bm and the bucket lever operation command cmd_bk obtained in Steps S26 and S27 shown in FIG. 25 are inputted from the working equipment controlling unit 140 to the solenoid proportional pressure control valves 24 to 27 to control the action of each of the bucket operation valve 22 and the boom operation valve 23 so that the bucket cylinder 35 and the boom cylinder 36 are actuated and the working equipment 3 travels.

Vehicle Speed Limitation Mod/C Command Calculation

After the processes of Steps S26 and S27, the working equipment controller 10 performs the calculating process of the transmission ratio command for the modulation clutch 13 to limit the vehicle speed (Step S28).

In consideration of the operating efficiency and fuel consumption, it is preferable that the boom 32 reaches the final target value TP1 at the same time as the travel distance of the wheel loader 1 reaches the preset distance L1. Accordingly, when it is determined that the travel of the wheel loader 1 is completed before the boom 32 reaches the final target value TP1, the working equipment controller 10 controls the modulation clutch 13 through the transmission controller 48 to restrain the movement speed of the wheel loader 1.

The working equipment controller 10 calculates a minimal travel time based on a boom travel distance and a pump discharge amount, restrains the maximum velocity speed with use of the modulation clutch 13, and performs the setting so that the travel of the wheel loader 1 is not completed before the completion of the travel of the boom 32.

For instance, the transmission ratio command Rate of the modulation clutch 13 in the loaded reverse traveling state is obtained as follows.

Herein, supposing that the travel target value of the boom 32 is set at TP1*bm* and the current boom angle is set at BmAngle, the remaining travel distance (angle) Δ TP1Bm (deg) is calculated by abs(TP1*bm*−BmAngle).

When the preset value of the travel distance of the wheel loader 1 in the loaded reverse traveling state is defined as L1 and the current travel distance is defined as L, the remaining travel distance ΔL1 (*m*) is L1−L.

The minimal travel time T1min (sec) when the boom 32 travels for ΔTP1Bm is calculated by (ΔTP1Bm/DeltaAngle_TP1)×(TargetNe_TP1/Ne)×Tmax_TP1.

Herein, Ne is the current engine speed, DeltaAngle_TP1 is a standard boom travel angle, TargetNe_TP1 is a standard engine speed, and Tmax_TP1 is a standard maximum time. The standard boom travel angle is preliminarily set as a travel distance (angle) when the boom 32 is automatically moved at the loaded reverse travel. According to the second exemplary embodiment, at the loaded reverse travel, the boom 32 is set to rise from the lowered positioner position (−40 degrees) at the excavation to the horizontal position (0 degree), and the standard boom travel angle (DeltaAngle_TP1) is set at 40 degrees.

The standard engine speed is set as a standard engine speed at the loaded rear travel, for example, 1330 rpm. The standard maximum time is a travel time when the boom 32 is moved for the standard boom travel angle in the case where the engine 11 operates at the standard engine speed, which is obtained through experiments and the like. The standard boom travel angle (DeltaAngle_TP1), the standard engine speed (TargetNe_TP1) and the standard maximum time (Tmax_TP1) are stored in a table in advance.

The travel time of the boom 32 varies depending on the engine speed for driving the hydraulic pump 21 for the working equipment. Therefore, as described above, the minimal travel time T1min (sec) can be calculated based on the current boom remaining distance (angle) ΔTP1Bm, the current engine speed Ne, the standard boom travel angle (DeltaAngle_TP1), the standard engine speed (TargetNe_TP1) and the standard maximum time (Tmax_TP1).

After the minimal travel time T1min (sec) is calculated, the working equipment controller 10 can calculate the maximum vehicle speed V1max (km/h) for traveling the remaining travel distance for the time T1min (sec) by ΔL1 (*m*)/T1min (sec)×(3600/1000).

The vehicle speed difference Δ vel (km/h) is obtained by subtracting the maximum vehicle speed V1max from the current absolute value of the vehicle speed abs(Vel). A relationship between a speed difference and a transmission ratio command (%) of the modulation clutch 13 is stored in the table in advance, and the transmission ratio command (%) of the clutch 13 is obtained based on the vehicle speed difference Δvel. For instance, when the vehicle speed difference Δvel is 0 (km/h) or when vehicle speed difference Δvel is less than 0 (km/h) (i.e., minus value) since the current velocity speed is smaller than the maximum vehicle speed, it is unnecessary to limit the vehicle speed, and therefore the transmission ratio command is set at 100%. Herein, the transmission ratio command is set at 70% when the vehicle speed difference Δvel is 1 km/h, set at 50% when the vehicle speed difference Δvel is 2 km/h, and set at 30% when the vehicle speed difference Δvel is 5 km/h or more, for example.

It should be noted that, regarding the final transmission ratio command for the transmission controller 48 to control the clutch 13, the command value when the transmission controller 48 controls the clutch 13 is compared with the command value obtained in Step S28, and a smaller one of the compared command values may be used to control the clutch 13.

Referring back to FIG. 18, the working equipment controller 10 again performs the process from Step S5 after Step S28 in the same manner as in the first exemplary embodiment. When the loaded reverse travel still continues, the determination results are NO (i.e., the loaded reverse travel detection is already ON) in Step S5, NO in each of Steps S7 and S9, NO in Step S11, and "2" in Step S12. Consequently, the loaded reverse travel control shown in FIG. 25 is repeated.

STAGE=3: Loaded Forward Travel Control

FIGS. 26 and 27 show a process flow of the loaded forward travel control. In FIGS. 26 and 27, explanation of the same processes as the process shown in FIG. 11 according to the first exemplary embodiment and the process of the loaded reverse travel control shown in FIG. 25 according to the second exemplary embodiment will be simplified.

In the processes shown in FIGS. 26 and 27, Steps S31 to S41 are the same as those in the first exemplary embodiment. At this time, in Steps S40 and S41, in the same manner as Steps S26 and S27 at the loaded reverse travel control, the operation command is calculated based on the Tables shown in FIGS. 31 and 32.

When the determination result is "YES" in Step S33 (i.e., when the travel distance L is equal to or more than the first interim distance K1×L2 but less than the second interim distance K2×L2 in FIG. 21), the working equipment controller 10 determines whether or not the manual operation is performed (Step S131), and when the manual operation is performed, the target setting unit 120 performs the start point correcting process (Step S132). The start point correcting process is the same as that in Step S122 in the above loaded reverse travel control, and therefore the explanation thereof will be omitted. The target setting unit 120 calculates a target position based on a new target route in Steps S37 and S38.

In contrast, when the determination result is "NO" in Step S33 (i.e., when the travel distance L is less than the first interim distance K1×L2 or equal to or more than the second interim distance K2×L2 in FIG. 21), the target positions of the boom 32 and the bucket 31 are respectively set at the actual boom angle BmAngle and the actual bucket cylinder length BkLength. When the manual operation is performed, the current position after the operation is the target position, and therefore it is unnecessary to perform the start point correcting process.

After the target positions of the boom 32 and the bucket 31 are calculated, as shown in FIG. 27, the Steps S39 to S41 which are the same as those in the first exemplary embodiment are performed, and further the vehicle speed limitation Mod/C command calculation (Step S42) similar to that in Step S28 for the loaded reverse travel control is performed.

Referring back to FIG. 18, the working equipment controller 10 again performs the process from Step S5 after Step S42 in the same manner as in the first exemplary embodiment. When the loaded forward travel still continues, the determination results are NO (i.e., the loaded forward travel detection is already ON) in Step S7, NO in each of Steps S5 and S9, NO in Step S11, and "3" in Step S12. Consequently, the loaded forward travel control shown in FIGS. 26 and 27 is repeated.

STAGE=4: Unloaded Reverse Travel Control

FIGS. 28 and 29 show a process flow of the unloaded reverse travel control. A part of the process shown in FIGS. 28 and 29 is identical to that of the process shown in FIGS. 25 to 27 and the process shown in FIGS. 12 and 13, and thus description thereof is simplified.

The working equipment controller 10 determines whether or not the travel distance L obtained by the travel distance detecting unit 130 is less than the preset value L3 (Step S151).

When the determination result by the working equipment controller 10 is "YES" in Step S151, the travel distance detecting unit 130 calculates the current travel distance L in the same manner as in Step S53 (Step S152).

When the determination result is "NO" in Step S151 (i.e., the travel distance has already reached the distance L3), the working equipment controller 10 skips the calculation of the current travel distance L in Step S152.

After Step S152 or when the determination result is "NO" in Step S151, the working equipment controller 10 determines whether or not the travel distance L is less than K3×L3 (the third interim distance) (Step S153).

For instance, when K3 is 0.4 and the travel distance L does not reach 40% of the preset distance L3, the determination result by the working equipment controller 10 is "YES" in Step S153.

When the determination result is "YES" in Step S153, the target setting unit 120 of the working equipment controller 10 assigns the actual boom angle BmAngle to the boom target position tp_bm(t) (Step S154). Accordingly, the boom 32 is maintained at the same position when the manual operation is not performed.

The working equipment controller 10 determines whether or not the angle of the bucket 31 is less than a horizontal level (Step S155). Just after the load is discharged into the vessel 61, the unloaded reverse travel control starts, and the bucket 31 is located at the dump position. Accordingly, the determination result is "YES" in Step S154. In this case, the working equipment controller 10 adds 30 mm to the bucket target position tp_bk(t) to set a new bucket target position tp_bk(t) (Step S156). Thus, according to a bucket lever operation command calculation to be described later, a process for moving the bucket 31 toward the tilting position at a constant speed is performed.

In contrast, when the angle of the bucket 31 becomes a horizontal level, the determination result is "NO" in Step S155, and the working equipment controller 10 sets the actual bucket cylinder length BkLength at the bucket target position tp_bk(t) (Step S157). The state in which the angle of the bucket 31 is at a horizontal level corresponds to the bucket horizontal position of the bucket 31, i.e., the bucket target position TP3_bk at K3×L3 (third interim distance). Accordingly, when the manual operation is not performed, the bucket 31 is maintained at the same position (bucket horizontal position).

When the determination result is "NO" in Step S153, the travel distance L is K3×L3 or more. Accordingly, the processes in Steps S154 to S157 are not performed.

Next, the working equipment controller 10 determines whether or not the travel distance L is K3×L3 (third interim distance) or more but less than K4×L3 (fourth interim distance) (Step S158).

When the determination result is "YES" in Step S158, the target setting unit 120 of the working equipment controller 10 determines whether or not the start-time distance sL is K3×L3 (third interim distance) (Step S159). When the travel distance L reaches K3×L3 (third interim distance), the start-time distance sL is not set at K3×L3. Accordingly, the determination result by the target setting unit 120 is "NO" in Step S159. In this case, the target setting unit 120 sets the start-time distance sL at the current travel distance L(=K3×L3), sets the boom start position sp_bm at the actual boom angle BmAngle, and sets the boom target position TP4_bm at a position lower than the boom start position sp_bm by 3 degrees (Step S160).

In contrast, in the case where the determination in Step S159 is performed again after the process in Step S160 is performed (i.e., in the case where the travel distance of the wheel loader 1 is more than K3×L3 (third interim distance)), even when the determination result is "YES" in Step S158, the determination result is "NO" in Step S159.

The working equipment controller 10 then determines whether or not the boom lever 41 and bucket lever 42 are manually operated (Step S167).

When the manual operation is performed, the determination result is "YES" in Step S167. Accordingly, the working equipment controller 10 performs the start point correcting process (Step S168) in a similar manner as in Step S162.

When the manual operation is not performed, the determination result is "NO" in Step S167. Accordingly, the start point correcting process (Step S168) is not performed.

Next, the working equipment controller 10 performs the boom target position calculating step (S163). The boom target position calculating step (S163) is similar to Step S62 shown in FIG. 12 according to the first exemplary embodiment.

Further, the working equipment controller 10 performs the bucket target position calculating step (S164). In Step S164, the bucket target position tp_bk(t) is set at TP4_bk. As shown in Table 3, TP4_bk is the positioner position.

When the determination result is "NO" in Step S165, the travel distance L is less than K4×L3. Accordingly, the processes in the Steps S166 to S170 are not performed.

Next, as shown in FIG. 29, the working equipment controller 10 determines whether or not the travel distance L is K4×L3 (fourth interim distance) or more (Step S165).

In the case where the determination result is "YES" in Step S165, only when the travel distance L is K4×L3 (fourth interim distance) (i.e., only when the determination result is "YES" in Step S165 for the first time), the target setting unit 120 of the working equipment controller 10 sets the start-time distance sL at the current travel distance L(=K4×L3), and sets the boom start position sp_bm at the actual boom angle BmAngle (Step S166).

The working equipment controller 10 then determines whether or not the boom lever 41 and bucket lever 42 are manually operated (Step S167).

When the manual operation is performed, the determination result is "YES" in Step S167. Accordingly, the working equipment controller 10 performs the start point correcting process (Step S168) in a similar manner as in Step S162.

When the manual operation is not performed, the determination result is "NO" in Step S167. Accordingly, the start point correcting process (Step S167) is not performed.

Next, the working equipment controller 10 performs the boom target position calculating step (S169). The boom target position calculating step (S169) is similar to the Step S66 shown in FIG. 13 according to the first exemplary embodiment.

Further, the working equipment controller 10 performs the bucket target position calculating step (S170). In Step S170, the bucket target position tp_bk(t) is set at TP5_bk. As shown in Table 3, TP5_bk is the positioner position in the same manner as TP4_bk.

When the determination result is "NO" in Step S165, the travel distance L is less than K4×L3. Accordingly, the processes in the Steps S165 to S170 are not performed.

In the same manner as in Steps S25 to S28 shown in FIG. 25, the working equipment controller 10 performs the deviation calculating step (S171), the boom lever operation command calculating step (S172), the bucket lever operation command calculating step (S173), and the vehicle speed limitation Mod/C command calculating step (S174).

Referring back to FIG. 18, the working equipment controller 10 again performs the process on and after Step S5 after Step S174 in the same manner as in the first exemplary embodiment. When the unloaded reverse travel still continues, the determination result is NO (i.e., the unloaded reverse travel detection is already ON) in Step S9, NO in each of Steps S5 and S7, NO in Step S11, and "4" in Step S12. Consequently, the unloaded reverse travel control shown in FIGS. 28 and 29 is repeated.

The V-shape operation can be repeated by repeating the above control processes.

Advantage of Second Exemplary Embodiment

According to the second exemplary embodiment, the same effects as those in the first exemplary embodiment can be obtained. Specifically, the bucket 31 and the boom 32 of the working equipment 3 are automatically moved to the respective target positions in accordance with the travel distance of the wheel loader 1 under the control by the working equipment controller 10 during the loaded reverse travel, the loaded forward travel and the unloaded reverse travel. The second exemplary embodiment thus eliminates a necessity for an operator to simultaneously operate the boom lever 41 and the bucket lever 42 along with the steering and/or the accelerator. The operator is thus merely required to mainly operate the steering, accelerator and brake. Consequently, even an inexperienced operator can easily operate the wheel loader 1.

Further, the working equipment 3 is automatically moved to an appropriate position during the travel of the wheel loader 1, which results in an improved operating efficiency and a fuel-saving driving as compared with an instance where the working equipment 3 is moved after the travel of the wheel loader 1.

In the loaded reverse travel, the loaded forward travel and the unloaded reverse travel, the working equipment controller 10 performs the semi-automatic control, so that an operator can manually operate the boom lever 41 and the bucket lever 42 to interrupt the automatic control of the working equipment 3. The intention of the operator can be thus reflected in the movement of the working equipment 3. For instance, the working equipment 3 can be moved at a high speed to improve the operability.

Further, when the manual operation is performed while the working equipment 3 travels according to the automatic control, the target setting unit 120 calculates a new target position based on the current position of the working equipment 3 after the manual operation, and sets a new target route based on the new target position and the final target position to continue the automatic control. Accordingly, the working equipment 3 can be traveled by the most direct way from the position at which the manual operation is performed, and while the manual operation by the operator is reflected, the most efficient travel control of the working equipment 3 cam be performed.

Additionally, the target setting unit 120 obtains the deviation between the current position of the working equipment 3 before the manual operation and the target position, and sets the new target position by adding the deviation to the current position of the working equipment 3 after the manual operation. Accordingly, it is possible to set a target position in consideration of the delay of the actual travel relative to the control target at the time of operating the working equipment 3. Accordingly, it is possible to perform efficient control in which the travel distance from the current position after the manual operation to the final target position is the shortest.

The working equipment controller 10 controls the transmission ratio command of the modulation clutch 13 in accordance with the movement speed of the working equipment 3 to limit the velocity speed of the wheel loader 1. Accordingly, it is possible to automatically adjust the timing of each of the completion of the movement of the working equipment 3 and the completion of the travel of the wheel loader 1. Consequently, it is possible to achieve an improved operating efficiency and a fuel-saving driving at the same time.

According to the second exemplary embodiment, the setting is such that the wheel loader 1 travels in a straight line toward the dump truck 60 in the loaded forward travel control. Accordingly, it is possible to perform stable control to approach the dump truck 60 while lifting the boom 32 in the loaded state.

Incidentally, it should be understood that the scope of the invention is not limited to the above-described exemplary embodiment(s), but includes modifications and improvements compatible with the invention.

In the exemplary embodiments, the semi-automatic control according to the invention is performed during operations including the loaded reverse travel, the loaded forward travel and the unloaded reverse travel, but may be performed only during one or two of these operations.

The relationship between the travel distance of the wheel loader 1 and the target position of the working equipment 3 for each of the operations is not limited to the above exemplary embodiments. For instance, in the loaded reverse travel control, the working equipment 3 may be moved to the target position TP1 when the wheel loader 1 reaches not the travel distance L1 but an interim spot therebefore. In the loaded forward travel control, the boom 32 may be moderately lifted to a new target position defined between the target positions TP1 and TP2 without being maintained at the target position TP1 until the travel distance reaches the first interim distance (K1×L2). Further, in the unloaded reverse travel control, the working equipment 3 may be moved to the lowered positioner position when the travel distance reaches the fourth interim distance (K4×L2) and then be maintained at the position TP5.

Further, an operator may set the relationship between the travel distance of the wheel loader 1 and the target position of the working equipment 3 for each of the operations. For instance, an operator may change the relationship between the travel distance of the wheel loader 1 and the target position of the working equipment 3 for each of the operations by changing the values of the distance coefficients K1 to K4 displayed on the monitor 43 and storing the changed values in the storage 150. Further, since the semi-automatic control according to the invention accepts a manual operation of the boom lever 41 and the bucket lever 42, an operator may change the relationship between the travel distance of the wheel loader 1 and the target position of the working equipment 3 for each of the operations by storing a distance where the working equipment 3 is moved to the target position by the manual operation in the storage 150 and changing, for instance, the values of the distance coefficients K1 to K4 in accordance with the distance stored in the storage 150. For instance, in the loaded forward travel control, K1 is 0.5 and thus the working equipment 3 is maintained at the target position TP1 until the wheel loader 1 reaches not L2 but an interim spot therebefore. However, in the case where an operator operates the boom lever 41 to move the working equipment 3 toward the target position TP2 before the wheel loader 1 reaches the interim spot (e.g., at a spot of 0.4×L2), the distance coefficient K1 may be changed to 0.4. In this manner, the preference of operation of each operator can be reflected in the semi-automatic control of the working equipment 3.

It should be noted that the exemplary embodiments employs the semi-automatic control accepting interruption of a manual operation of the boom lever 41 and/or the bucket lever 42 in the control of the working equipment 3, but the control of the working equipment 3 may be a fully automatic control inhibiting interruption of a manual operation in the control of the working equipment 3. Further, the semi-automatic control and the automatic control may be selectable. Especially, in the case where an inexperienced operator operates, interruption of the manual operation may lead to a reduction in operating efficiency. In such a case, a mode inhibiting interruption of the manual operation may be selected.

Further, the target travel distance and actual travel distance of the wheel loader 1 and the target position and actual position of the working equipment 3 may be displayed on the monitor 43 during the semi-automatic control to assist an operator.

The invention claimed is:

1. A wheel loader comprising:

working equipment comprising a boom and a bucket attached to the boom; and a working equipment controller configured to:

detect an operating state of the wheel loader;

determine whether or not the bucket is loaded;

determine whether the wheel loader travels forward or reverses;

detect that the operating state is a loaded forward traveling state based on a determination that the bucket is loaded and the wheel loader travels forward;

set a relationship between a target position of the working equipment and a travel distance of the wheel loader for the loaded forward traveling state;

detect the travel distance of the wheel loader;

move the boom and the bucket to the target position of the working equipment determined based on the detected travel distance when the operating state is the loaded forward traveling state, wherein the working equipment controller is further configured to:

set a distance L2 as a target travel distance for the loaded forward traveling state, a first interim distance less than the distance L2, and a second interim distance equal to or more than the first interim distance but less than the distance L2, set, when the travel distance is less than the first interim distance, (i) a first boom angle at which the boom is to get horizontal to define a target position of the boom for the loaded forward traveling state and (ii)

a first bucket cylinder length where the bucket is maintained at a tilting position to define a target position of the bucket for the loaded forward traveling state, set, when the travel distance is equal to or more than the first interim distance but less than the second interim distance, (i) a second boom angle in proportion to the travel distance to define the target position of the boom for the loaded forward traveling state, the second boom angle varying from a value at a time when the travel distance reaches the first interim distance to a value at which the boom is to reach a preset lifted positioner position when the travel distance reaches the second interim distance and (ii) a second bucket cylinder length where the bucket is maintained at the tilting position in accordance with the second boom angle to define a target portion of the bucket for the loaded forward traveling state, and set, when the travel distance is in a range from the second interim distance to the distance L2 (*i*) a third boom angle at which the boom is to reach the lifted positioner position to define the target position of the boom for the loaded forward traveling state and (ii) a third bucket cylinder length where the bucket is maintained at the tilting position to define the target position of the bucket for the loaded forward traveling state.

2. The wheel loader according to claim 1, further comprising:

a boom position detecting unit configured to detect a current position of the boom; and a bucket position detecting unit configured to detect a current position of the bucket, wherein the working equipment controller is configured to:

calculate a current target position of each of the boom and the bucket from the detected travel distance;

calculate a first deviation between the calculated current target position of the boom and the detected current position of the boom and a second deviation between the calculated current target position of the bucket and the detected current position of the bucket; and move each of the boom and the bucket based on the first and second deviations.

3. The wheel loader according to claim 1, further comprising:

a boom lever for operating the boom; and a bucket lever for operating the bucket, wherein the working equipment controller is configured to add displacements of the boom lever and the bucket lever by a manual operation to move the working equipment.

4. The wheel loader according to claim 1, further comprising:

a boom lever for operating the boom; and a bucket lever for operating the bucket, wherein the working equipment controller is configured to:

store a travel distance at a time when the working equipment reaches the target position when displacement of the boom lever and the bucket lever by a manual operation is added; and update the travel distance of the wheel loader determined based on the relationship between the target position of the working equipment and the travel distance of the wheel loader with the travel distance stored when the working equipment reaches the target position.

5. The wheel loader according to claim 1, wherein the working equipment controller is further configured to:

detect that the operating state is a loaded reverse traveling state based on a determination that the bucket is loaded and the wheel loader reverses;

set a relationship between a target position of the working equipment and a travel distance of the wheel loader for the loaded reverse traveling state;

detect the travel distance of the wheel loader; and move the boom and the bucket to the target position of the working equipment determined based on the detected travel distance when the operating state is the loaded reverse traveling state.

6. A wheel loader comprising:

working equipment comprising a boom and a bucket attached to the boom; and a working equipment controller configured to:

detect an operating state of the wheel loader;

determine whether or not the bucket is loaded; and determine whether the wheel loader travels forward or reverses;

detect that the operating state is an unloaded reverse traveling state based on a determination that the bucket is unloaded and that the wheel loader reverses;

set a relationship between a target position of the working equipment and a travel distance of the wheel loader for the unloaded reverse traveling state;

detect the travel distance of the wheel loader;

move the boom and the bucket to the target position of the working equipment determined based on the detected travel distance when the operating state is the unloaded reverse traveling state, wherein the working equipment controller is further configured to:

set a distance L2 as a target travel distance for the unloaded reverse traveling state, a third interim distance less than the distance L2, and a fourth interim distance equal to or more than the third interim distance but less than the distance L2, set, when the travel distance is less than the third interim distance, (i) a first boom angle at which the boom is to reach a preset lifted positioner position to define a target position of the boom for the unloaded reverse traveling state and (ii) a first bucket cylinder length in proportion to the travel distance to define a target position of the bucket for the unloaded reverse traveling state, the first bucket cylinder length varying from a value at a start of a movement of the bucket in the unloaded reverse traveling state to a value where the bucket is to reach a preset initial position when the travel distance of the wheel loader reaches the third interim distance, set, when the travel distance is equal to or more than the third interim distance but less than the fourth interim distance, (i) a second boom angle in proportion to the travel distance to define the target position of the boom for the unloaded reverse traveling state, the second boom angle varying from a value at a time when the travel distance reaches the third interim distance to a value at which the boom is to get horizontal when the travel distance reaches the fourth interim distance and (ii) a second bucket cylinder length where the bucket is maintained at the preset initial position to define the target position of the bucket for the unloaded reverse traveling state, and set, when the travel distance is in a range from the fourth interim distance to the distance L2, (i) a third boom angle in proportion to the travel distance to define the target position of the boom for the unloaded reverse traveling state, the third boom angle varying from a value at a time when the travel distance reaches the fourth interim distance to a value at which the boom is to reach a preset lowered positioner position when the travel distance reaches the distance L2 and (ii) a third bucket cylinder length where the bucket is maintained at the preset initial position to define the target position of the bucket for the unloaded reverse traveling state.

7. A wheel loader comprising:

working equipment comprising a boom and a bucket attached to the boom;

a boom lever for operating the boom;

a bucket lever for operating the bucket; and a working equipment controller configured to:

detect an operating state of the wheel loader;

determine whether or not the bucket is loaded;

determine whether the wheel loader travels forward or reverses;

detect that the operating state is a loaded forward traveling state based on a determination that the bucket is loaded and that the wheel loader travels forward;

set a relationship between a target position of the working equipment and a travel distance of the wheel loader according to the loaded forward travelling state;

detect the travel distance of the wheel loader;

move the boom and the bucket to the target position of the working equipment determined based on the detected travel distance when the operating state is the loaded forward traveling state;

set a distance L2 as a target travel distance for the loaded forward traveling state, a first interim distance less than the distance L2, and a second interim distance equal to or more than the first interim distance but less than the distance L2;

set, when the travel distance is less than the first interim distance, (i) a first boom angle at which the boom is to get horizontal to define a target position of the boom for the loaded forward traveling state and (ii) a first bucket cylinder length where the bucket is maintained at a tilting position to define a target position of the bucket for the loaded forward traveling state;

set, when the travel distance is equal to or more than the first interim distance but less than the second interim distance, (i) a second boom angle in proportion to the travel distance to define the target position of the boom for the loaded forward traveling state, the second boom angle varying from a value at a time when the travel distance reaches the first interim distance to a value at which the boom is to reach a preset lifted positioner position when the travel distance reaches the second interim distance and (ii) a second bucket cylinder length where the bucket is maintained at the tilting position in accordance with the second boom angle to define a target portion of the bucket for the loaded forward traveling state;

set, when the travel distance is in a range from the second interim distance to the distance L2 (*i*) a third boom angle at which the boom is to reach the lifted positioner position to define the target position of the boom for the loaded forward traveling state and (ii) a third bucket cylinder length where the bucket is maintained at the tilting position to define the target position of the bucket for the loaded forward traveling state;

obtain, when the boom lever and the bucket lever are manually operated, a deviation between a position of the working equipment before the manual operation and the target position of the working equipment; and set (i) a new target position by adding the deviation to a position of the working equipment after the manual operation and (ii) a new relationship between the target position of the working equipment and the travel distance of the wheel loader using the new target position.

8. The wheel loader according to claim 5, wherein the working equipment controller is further configured to:

set a boom angle in proportion to the travel distance to define a target position of the boom for the loaded reverse traveling state, the boom angle varying from a value at a start of a movement of the boom in the loaded reverse traveling state to a value at which the boom is to get horizontal when the travel distance of the wheel loader reaches a distance L1; and set a bucket cylinder length where the bucket is maintained at a tilting position in accordance with the boom angle to define a target portion of the bucket for the loaded reverse traveling state.

* * * * *